US011807002B2

(12) United States Patent
Murayama et al.

(10) Patent No.: US 11,807,002 B2
(45) Date of Patent: Nov. 7, 2023

(54) LIQUID EJECTING APPARATUS AND METHOD OF CONTROLLING LIQUID EJECTING APPARATUS

(71) Applicant: Seiko Epson Corporation, Tokyo (JP)

(72) Inventors: Toshiro Murayama, Fujimi-Machi (JP); Kazuaki Uchida, Fujimi-machi (JP); Shinichi Yamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 192 days.

(21) Appl. No.: 17/510,748

(22) Filed: Oct. 26, 2021

(65) Prior Publication Data

US 2022/0126572 A1 Apr. 28, 2022

(30) Foreign Application Priority Data

Oct. 28, 2020 (JP) ..... 2020-180509

(51) Int. Cl.
*B41J 29/38* (2006.01)
*B41J 2/045* (2006.01)

(52) U.S. Cl.
CPC ..... *B41J 2/04588* (2013.01); *B41J 2/04581* (2013.01)

(58) Field of Classification Search
CPC ..... B41J 2002/14354; B41J 2/0451; B41J 2/16579; B41J 2/04571
See application file for complete search history.

(56) References Cited

U.S. PATENT DOCUMENTS 9,457,563 B2 * 10/2016 Nakazawa ..... B41J 2/04541
2005/0128232 A1 * 6/2005 Shinkawa ..... B41J 2/0451 347/10
2008/0088657 A1 * 4/2008 Shinkawa ..... B41J 2/16579 347/11
2015/0062219 A1 3/2015 Otokita
2016/0279932 A1 * 9/2016 Kamiyanagi ..... B41J 2/04541

FOREIGN PATENT DOCUMENTS

JP 2017-105219 6/2017
JP 2019-006063 1/2019

* cited by examiner

*Primary Examiner* — Lam S Nguyen
(74) *Attorney, Agent, or Firm* — WORKMAN NYDEGGER

(57) ABSTRACT

A liquid ejecting apparatus includes: an acquisition unit that acquires first vibration information on an inspection target ejecting portion out of the ejecting portions concerning a vibration generated in a first detection period included in a first period in which the liquid ejecting apparatus forms a first printed image on the medium, and acquires second vibration information on the inspection target ejecting portion concerning a vibration generated in a second detection period corresponding to the first detection period, the second detection period being included in a second period that starts after completion of the first period, in which the liquid ejecting apparatus forms a second printed image related to the first printed image on the medium. The liquid ejecting apparatus also includes an inspection unit that inspects a ejection state of the liquid from the inspection target ejecting portion based on the first vibration information and the second vibration information.

14 Claims, 27 Drawing Sheets

FIG. 8

| SD[m] | DETAIL OF INSTRUCTION BY SD[m] | Qa[m] | | | Qb[m] | | | Qs[m] | | |
|---|---|---|---|---|---|---|---|---|---|---|
| | | TQ1 | TQ2 | TQ3 | TQ1 | TQ2 | TQ3 | TQ1 | TQ2 | TQ3 |
| 1 | DP1 | H | H | L | L | L | L | L | L | L |
| 2 | DP2 | H | L | L | L | L | L | L | L | L |
| 3 | DP3 | L | H | L | L | L | L | L | L | L |
| 4 | DP4 | L | L | L | H | L | L | L | L | L |
| 5 | DP5 | L | L | L | L | H | L | L | L | L |
| 6 | DK1 | H | H | L | L | L | L | L | L | H |
| 7 | DK2 | H | L | L | L | L | L | L | L | H |
| 8 | DK3 | L | H | L | L | L | L | L | L | H |
| 9 | DK4 | L | L | L | H | L | L | L | L | H |
| 10 | DK5 | L | L | L | L | H | L | L | L | H |

FIG. 30

| SD[m] | DETAIL OF INSTRUCTION BY SD[m] | Qa[m] | | Qb[m] | | Qs[m] | |
|---|---|---|---|---|---|---|---|
| | | TQ1 | TQ2 | TQ1 | TQ2 | TQ1 | TQ2 |
| 11 | DP1a | H | H | L | L | L | L |
| 12 | DP2a | H | L | L | L | L | L |
| 13 | DP3a | L | H | L | L | L | L |
| 14 | DP4a | L | L | H | L | L | L |
| 15 | DP5a | L | L | L | H | L | L |
| 16 | DK2a | H | L | L | L | L | H |
| 17 | DK4a | L | L | H | L | L | H |
| 18 | DK6a | L | H | L | L | H | L |
| 19 | DK7a | L | L | L | H | H | L |

LIQUID EJECTING APPARATUS AND METHOD OF CONTROLLING LIQUID EJECTING APPARATUS

The present application is based on, and claims priority from JP Application Serial Number 2020-180509, filed Oct. 28, 2020, the disclosure of which is hereby incorporated by reference herein in its entirety.

BACKGROUND

1. Technical Field

The present disclosure relates to a liquid ejecting apparats and a method of controlling a liquid ejecting apparatus.

2. Related Art

A liquid ejecting apparatus such as an ink jet printer executes a printing process to form an image on a medium such as a print sheet by driving an ejecting portion provided to the liquid ejecting apparatus so as to eject a liquid such as an ink that fills the ejecting portion. The liquid ejecting apparatus having the above-described configuration may occasionally cause an abnormality in ejection which is a failure to eject the liquid normally from the ejecting portion due to an increase in viscosity of the liquid filling the ejecting portion, adhesion of a foreign matter to the ejecting portion, or the like. Here, the occurrence of the abnormality in ejection may complicate accurate formation of dots that are programmed to be formed on the medium with the liquid ejected from the ejecting portion, thus leading to a deterioration in quality of an image formed on the medium in the printing process. Given the situation, as disclosed in JP-A-2017-105219, for example, there have heretofore been proposed various techniques for inspecting a state of ejection of a liquid from an ejecting portion in order to prevent a deterioration in image quality due to an abnormality in ejection when the ejecting portion is driven and a vibration is generated therein, by comparing feature quantities of a frequency, an amplitude, and the like inherent to a waveform of the vibration generated in the ejecting portion with predetermined reference values.

However, the feature quantities inherent to the waveform of the vibration generated in the ejecting portion may vary with a surrounding environment of the liquid ejecting apparatus such as a temperature and a humidity of the environment where the liquid ejecting apparatus is present. Accordingly, there has been a problem of incapability of inspecting the state of ejection of the liquid from the ejecting portion in the case of the variation of the surrounding environment and the like of the liquid ejecting apparatus.

SUMMARY

A liquid ejecting apparatus provided with a plurality of ejecting portions driven by a driving signal and configured to eject a liquid, the liquid ejecting apparatus being configured to form an image on a medium by using the liquid ejected from the plurality of ejecting portions, includes: an acquisition unit that acquires first vibration information on an inspection target ejecting portion out of the plurality of ejecting portions concerning a vibration generated in a first detection period included in a first period in which the liquid ejecting apparatus forms a first printed image on the medium, and acquires second vibration information on the inspection target ejecting portion concerning a vibration generated in a second detection period corresponding to the first detection period, the second detection period being included in a second period that starts after completion of printing of the first printed image on the medium in the first period, in which the liquid ejecting apparatus forms a second printed image related to the first printed image on the medium; and an inspection unit that inspects a state of ejection of the liquid from the inspection target ejecting portion based on the first vibration information and the second vibration information.

A liquid ejecting apparatus provided with a plurality of ejecting portions driven by a driving signal and configured to eject a liquid, the liquid ejecting apparatus being configured to form an image on a medium by using the liquid ejected from the plurality of ejecting portions, includes: an acquisition unit that acquires first vibration information on a plurality of inspection target ejecting portions out of the plurality of ejecting portions concerning a composite vibration obtained by combining vibrations generated in a first detection period included in a first period in which the liquid ejecting apparatus forms a first printed image on the medium, and acquires second vibration information on the plurality of inspection target ejecting portions concerning a composite vibration obtained by combining vibrations generated in a second detection period corresponding to the first detection period, the second detection period being included in a second period that starts after completion of printing of the first printed image on the medium in the first period, in which the liquid ejecting apparatus forms a second printed image related to the first printed image on the medium; and an inspection unit that inspects states of ejection of the liquid from the plurality of inspection target ejecting portions based on the first vibration information and the second vibration information.

A method of controlling a liquid ejecting apparatus provided with a plurality of ejecting portions driven by a driving signal and configured to eject a liquid, the liquid ejecting apparatus being configured to form an image on a medium by using the liquid ejected from the plurality of ejecting portions, includes: an acquiring step of acquiring first vibration information on an inspection target ejecting portion out of the plurality of ejecting portions concerning a vibration generated in a first detection period included in a first period in which the liquid ejecting apparatus forms a first printed image on the medium, and acquiring second vibration information on the inspection target ejecting portion concerning a vibration generated in a second detection period corresponding to the first detection period, the second detection period being included in a second period that starts after completion of printing of the first printed image on the medium in the first period, in which the liquid ejecting apparatus forms a second printed image related to the first printed image on the medium; and an inspecting step of inspecting a state of ejection of the liquid from the inspection target ejecting portion based on the first vibration information and the second vibration information.

BRIEF DESCRIPTION OF THE DRAWINGS

FIG. 8 is an explanatory diagram for explaining an example of an individual designation signal SD[m].

FIG. 30 is an explanatory diagram for explaining an example of the individual designation signal SD[m].

DESCRIPTION OF EXEMPLARY EMBODIMENTS

Figure 1:
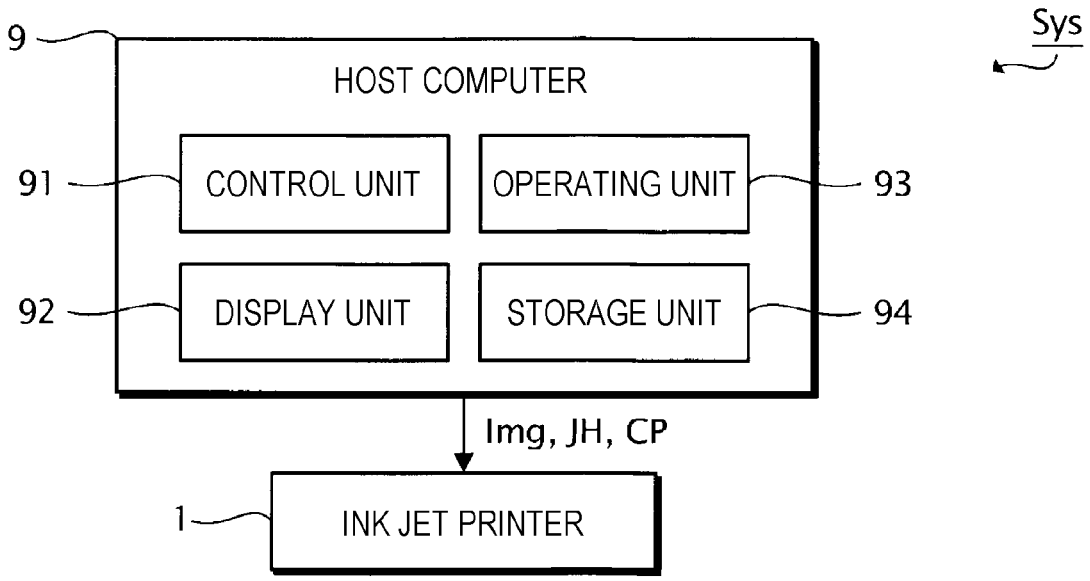
FIG. 1 is a block diagram showing an example of a configuration of a printing system Sys according to a first embodiment of the present disclosure.

Modes for carrying out the present disclosure will be described below with reference to the drawings. It to be noted, however, that dimensions and scales of respective constituents in the drawings are different from reality when appropriate. Meanwhile, the embodiments described below represent preferred specific examples of the present disclosure and are therefore provided with various technically preferable restrictions. Nevertheless, the scope of the present disclosure shall not be limited to these embodiments unless there is a specific statement in the following description which intends to limit the scope of the present disclosure.

1. First Embodiment

A printing system Sys according to a first embodiment will be described below.

The printing system Sys in this embodiment is a system for forming an image GZ on a print sheet P.

1.1 Outline of Printing System

An outline of the printing system Sys according to this embodiment will be described below with reference to FIGS. 1 to 5.

FIG. 1 is a functional block diagram showing an example of the printing system Sys according to this embodiment.

As exemplarily shown in FIG. 1, the printing system Sys includes an ink jet printer 1 and a host computer 9.

The host computer 9 includes a control unit 91 that controls respective units in the host computer 9, a display unit 92 that displays various images, an operating unit 93 for accepting an operation by a user of the printing system Sys, and a storage unit 94 that stores a variety of information.

The control unit 91 creates image information Img that represents the image GZ to be formed on the print sheet P by the printing system Sys based on the variety of information stored in the storage unit 94, a result of operation of the operating unit 93 by the user of the printing system Sys, and the like. Moreover, the control unit 91 creates number-of-copies information CP that represents the number of copies WCP of the image GZ to be formed on the print sheet P by the printing system Sys based on the result of operation of the operating unit 93 by the user of the printing system Sys, and the like. Furthermore, the control unit 91 creates print quality approval information JH that represents whether or not the image GZ formed on the print sheet P by the printing system Sys based on the result of operation of the operating unit 93 by the user of the printing system Sys, and the like satisfies print quality desired by the user.

The ink jet printer 1 forms the image GZ indicated by the image information Img on the print sheet P by ejecting inks from multiple ejecting portions D provided to the ink jet printer 1 based on the image information Img that is created by the host computer 9. As an example, this embodiment assumes a case where the ink jet printer 1 is a line printer.

In this embodiment, the ink jet printer 1 represents an example of a "liquid ejecting apparatus", the ink represents an example of a "liquid", and the print sheet P represents an example of a "medium".

Meanwhile, a process to cause the ink jet printer 1 to eject the inks from the ejecting portions D provided to the ink jet printer 1 to the print sheet P in order to form the image GZ on the print sheet P will be hereinafter referred to as a printing process. Moreover, multiple times of the printing processes to be carried out by the ink jet printer 1 in order to form a piece of the image GZ on the print sheet P will be hereinafter referred to as a printing task. Furthermore, WCP times of the printing tasks to be carried out by the ink jet printer 1 in order to form WCP pieces of the images GZ on the print sheet P will be hereinafter referred to as a printing job.

Figure 2:
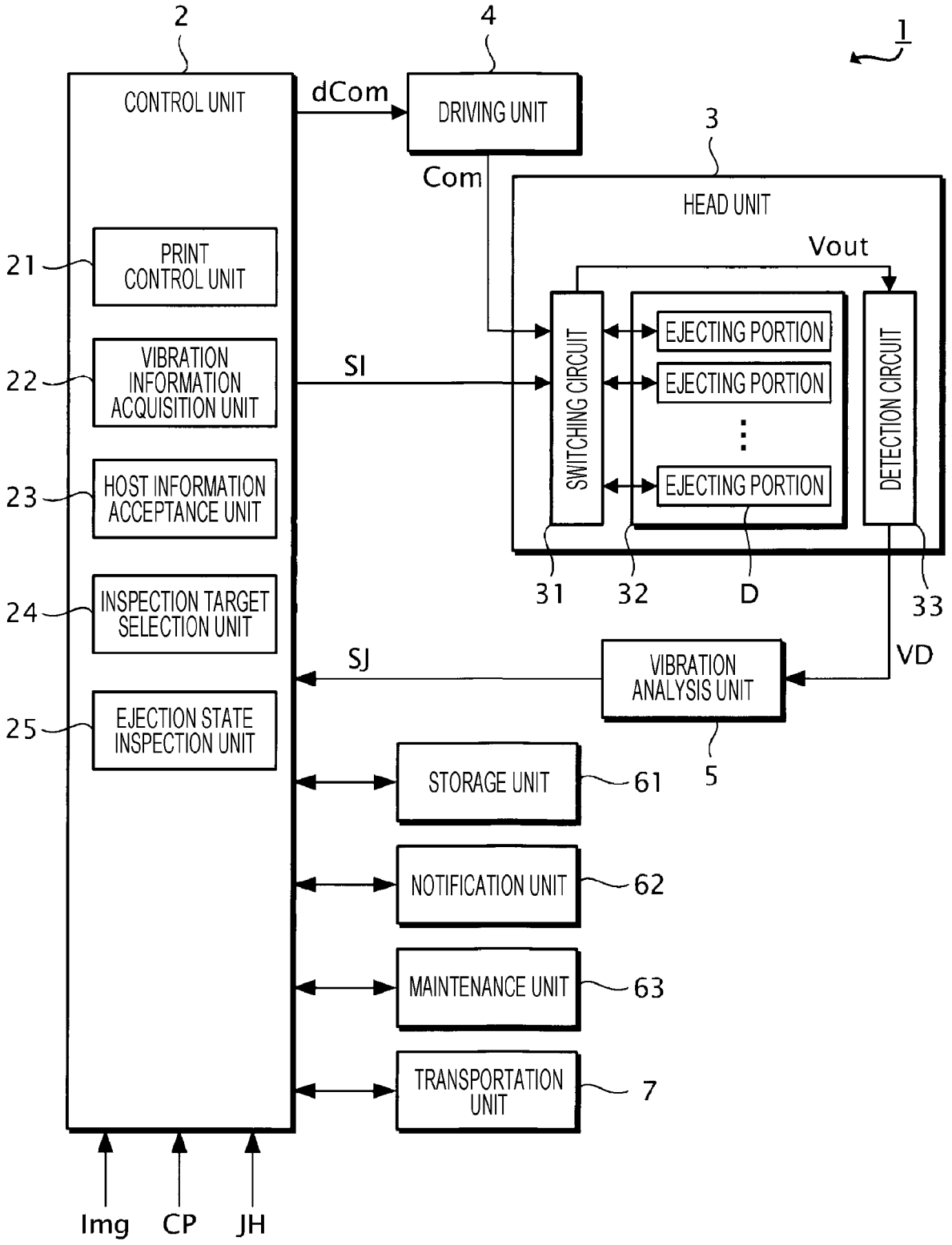
FIG. 2 is a block diagram showing an example of a configuration of an ink jet printer 1.

FIG. 2 is a functional block diagram showing an example of a configuration of the ink jet printer 1.

As exemplarily shown in FIG. 2, the ink jet printer 1 includes a control unit 2 that controls respective units in the ink jet printer 1, a head unit 3 provided with the ejecting portions D that eject the inks, a driving unit 4 that generates a driving signal Com for driving the ejecting portions D, a vibration analysis unit 5 that creates vibration information SJ indicating characteristics of vibrations generated in the ejecting portions D, a storage unit 61 that stores a variety of information, a notification unit 62 that issues a notification regarding a state of ejection of the ejecting portions D, a maintenance unit 63 that executes a maintenance process which is a process to maintain the ejecting portions D, and a transportation unit 7 for changing a relative position of the print sheet P to the head unit 3.

In this embodiment, the notification unit 62 represents an example of a "notification unit".

This embodiment assumes that the ink jet printer 1 includes multiple head units 3, multiple driving units 4 corresponding one to one to the multiple head units 3, and multiple vibration analysis units 5 corresponding one to one to the multiple head units 3. To be more precise, as an example, this embodiment assumes that the ink jet printer 1 is capable of ejecting inks of four colors, namely, cyan, magenta, yellow, and black, and includes four head units 3 corresponding one to one to the inks of the four colors, four driving units 4 corresponding one to one to the four head units 3, and four vibration analysis units 5 corresponding one to one to the four head unit 3.

In the following, among the multiple head units 3, the multiple driving units 4, and the multiple vibration analysis units 5 provided to the ink jet printer 1, a description will be given while focusing on one of the head units 3, one of the driving units 4 corresponding to the one of the head units 3, and one of the vibration analysis units 5 corresponding to the one of the head units 3 as shown in FIG. 2 for the convenience of description. However, the following description also applies to the rest of the head units 3, the rest of the driving units 4, and the rest of the vibration analysis units 5 likewise.

The control unit 2 includes a CPU. Nonetheless, the control unit 2 may include a programmable logic device such as an FPGA instead of the CPU or in addition to the CPU. Here, the CPU stands for a central processing unit while the FPGA stands for a field-programmable gate array. As a consequence of an operation of the CPU in accordance with a control program stored in the vibration analysis unit 5, the control unit 2 generates signals such as a print signal SI and a waveform designation signal dCom for controlling the respective units in the ink jet printer 1.

Here, the waveform designation signal dCom is a digital signal that defines a waveform of the driving signal Com. Meanwhile, the driving signal Com is an analog signal for driving the ejecting portion D. The driving unit 4 includes a DA conversion circuit, and generates the driving signal Com having the waveform defined by the waveform designation signal dCom. This embodiment assumes that the driving signal Com includes a driving signal Com-A and a driving signal Com-B. In the meantime, the print signal SI is a digital signal for designating an operation type of the ejecting portion D. Specifically, the print signal SI is the signal to designate the operation type of the ejecting portion D by designating whether or not it is appropriate to supply the driving signal Com to the ejecting portion D.

As exemplarily shown in FIG. 1, the head unit 3 includes a switching circuit 31, a print head 32, and a detection circuit 33.

The print head 32 includes M pieces of the ejecting portions D. Here, the value M is a natural number that satisfies "M≥1". In the following description, of the M pieces of the ejecting portions D provided to the print head 32, an m-th ejecting portion D may be referred to as an ejecting portion D[m] when appropriate. Here, the variable m is a natural number that satisfies "1≤m≤M". Meanwhile, in the following description, if a certain constituent of the ink jet printer 1, a signal, or the like corresponds to the ejecting portion D[m] among the M pieces of the ejecting portions D, then a suffix [m] may added to a reference code that represents the relevant constituent, signal, or the like when appropriate.

The switching circuit 31 switches whether or not to supply the driving signal Com to the ejecting portion D[m] based on the print signal SI. In the following description, the driving signal Com among the driving signals Com which is to be supplied to the ejecting portion D[m] may be referred to as a supplied driving signal Vin[m] when appropriate. Moreover, the switching circuit 31 switches whether or not to supply a detected potential signal Vout[m] which indicates a potential of an upper electrode Zu[m] of a piezoelectric element PZ[m] provided to the ejecting portion D[m], to the detection circuit 33 based on the print signal SI. The piezoelectric element PZ[m] and the upper electrode Zu[m] will be described later with reference to FIG. 4.

The detection circuit 33 generates a residual vibration signal VD[m] based on the detected potential signal Vout [m]. The residual vibration signal VD [m] is a signal obtained by amplifying the detected potential signal Vout [m], for example, which shows a waveform of a vibration that remains in the ejecting portion D[m] after the ejecting portion D[m] is driven by the supplied driving signal Vin [m].

As exemplarily shown in FIG. 2, the vibration analysis unit 5 creates vibration information SJ[m] based on the residual vibration signal VD[m]. Here, the vibration information SJ[m] is information that indicates characteristics of the waveform of the vibration remaining in the ejecting portion D[m] after the ejecting portion D[m] is driven by the supplied driving signal Vin[m].

As exemplarily shown in FIG. 2, the control unit 2 includes a print control unit 21, a vibration information acquisition unit 22, a host information acceptance unit 23, an inspection target selection unit 24, and an ejection state inspection unit 25. In this embodiment, the print control unit 21, the vibration information acquisition unit 22, the host information acceptance unit 23, the inspection target selection unit 24, and the ejection state inspection unit 25 are functional blocks which are realized by causing the CPU provided to the control unit 2 to execute the control program stored in the vibration analysis unit 5 and by being operated in accordance with the control program.

The print control unit 21 generates the print signal SI based on the image information Img.

The host information acceptance unit 23 accepts information from the host computer 9. Specifically, the host information acceptance unit 23 obtains the image information Img, the number-of-copies information CP, and the print quality approval information JH from the host computer 9 in this embodiment. Here, the host information acceptance unit 23 represents an example of an "acceptance unit" that accepts information based on the result of operation of the operating unit 93 by the user of the printing system Sys.

Here, the host information acceptance unit 23 stores the image information Img, which is supplied from the host computer 9, to the storage unit 61. Meanwhile, the print control unit 21 generates a signal such as the print signal SI for controlling the head unit 3, a signal such as the waveform designation signal dCom for controlling the driving unit 4, and a signal for controlling the transportation unit 7 based on various data such as the image information Img stored in the storage unit 61. Then, the print control unit 21 controls the driving unit 4 and the switching circuit 31 so as to drive the ejecting portions D while controlling the transportation unit 7 so as to change the relative position of the print sheet P to the head unit 3 based on various signals such as the print signal SI and the various data stored in the storage unit 61. In this way, the print control unit 21 adjusts ejection or non-ejection of the inks from the ejecting portions D, timing to eject the inks, and so forth, thus controlling the respective units in the ink jet printer 1 so as to execute the printing process to form the image GZ corresponding to the image information Img on the print sheet P.

The vibration information acquisition unit 22 acquires the vibration information SJ [m] from the vibration analysis unit 5. The vibration information acquisition unit 22 represents an example of an "acquisition unit" that acquires the vibration information SJ[m].

The inspection target selection unit 24 selects the ejecting portion D[m], which serves as a target of detection of the detected potential signal Vout[m] by the detection circuit 33, out of the M pieces of the ejecting portions D[1] to D[M] provided to the head unit 3. In the following description, the ejecting portion D[m] to be selected by the inspection target selection unit 24 will be referred to as an inspection target ejecting portion DK. Note that the inspection target selection unit 24 represents an example of a "selection unit" that selects the inspection target ejecting portion DK.

The ejection state inspection unit 25 inspects a state of ejection of the ink from the ejecting portion D[m] selected as the inspection target ejecting portion DK based on the vibration information SJ[m]. The ejection state inspection unit 25 represents an example of an "inspection unit" that inspects the state of ejection of the ink from the inspection target ejecting portion DK.

Here, the inspection of the state of ejection of the ink from the inspection target ejecting portion DK to be executed by the ejection state inspection unit 25 is a process to inspect whether or not the state of ejection of the ink from the inspection target ejecting portion DK is normal, or more specifically, whether or not an abnormality in ejection occurs in the inspection target ejecting portion DK. Meanwhile, the abnormality in ejection generally refers to a state of abnormal ejection of the ink from the ejecting portion D, or in other words, a state where the nozzle N provided to the ejecting portion D cannot eject the ink accurately. To be more precise, the abnormality in ejection refers to a state of a failure to eject the ink in accordance with a mode defined by the driving signal Com despite an attempt to eject the ink from the ejecting portion D by driving the ejecting portion D in accordance with the driving signal Com. Here, the mode of ejection of the ink defined by the driving signal Com is an action to eject the ink in a quantity defined by the waveform of the driving signal Com from the ejecting portion D at a speed defined by the waveform of the driving signal Com.

Figure 3:
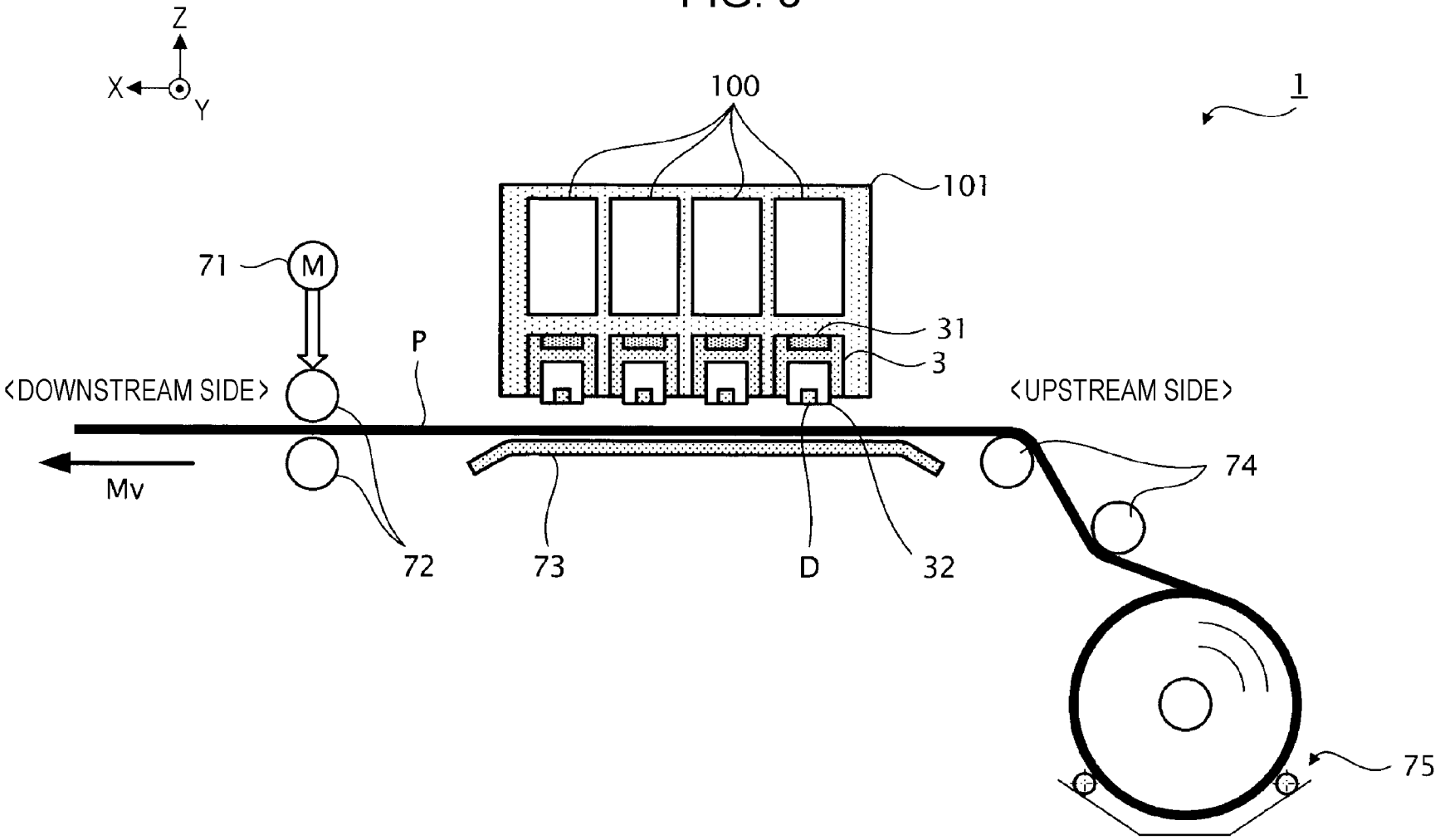
FIG. 3 is a cross-sectional view showing an example of a schematic internal structure of the ink jet printer 1.

FIG. 3 is a partial cross-sectional view exemplarily showing an outline of an internal structure of the ink jet printer 1.

As exemplarily shown in FIG. 3, this embodiment assumes that the ink jet printer 1 includes four ink cartridges 100. The four ink cartridges 100 are provided so as to correspond one to one to four colors of cyan, magenta, yellow, and black. Each ink cartridge 100 is filled with the ink of the color allocated to the ink cartridge 100. Although FIG. 3 shows an example in which the four ink cartridges 100 are housed in a line head 101 provided with the four head units 3, the ink cartridges 100 may be provided outside the line head 101 instead.

As exemplarily shown in FIG. 3, the transportation unit 7 includes a transportation motor 71 that serves as a drive source for transporting the print sheet P, transportation rollers 72 to be rotated by the action of the transportation motor 71, a platen 73 provided at a position in −Z direction relative to the head units 3, guide rollers 74 provided freely rotatably around a Y axis in FIG. 3, and a storage unit 75 for storing the print sheet P in a state of being wound into a roll. When the ink jet printer 1 executes the printing process, the transportation unit 7 unrolls the print sheet P out of the storage unit 75 and transports the print sheet P in +X direction along a transportation route defined by the guide rollers 74, the platen 73, and the transportation rollers 72.

The +X direction is a direction orthogonal to the −Z direction and is directed from an upstream side to a downstream side in terms of transportation of the print sheet P. In the following description, the +X direction may be referred to as a transporting direction My when appropriate. Moreover, as shown in FIG. 3, the +X direction and −X direction being the opposite direction thereof may be collectively referred to as X-axis direction, the −Z direction orthogonal to the X-axis direction and +Z direction being the opposite direction thereof may be collectively referred to as Z-axis direction, and +Y direction orthogonal to the X-axis direction and the Z-axis direction and −Y direction being the opposite direction thereof may be collectively referred to as Y-axis direction in the following description when appropriate.

Each of the M pieces of the ejecting portions D provided to the head unit 3 receives the supply of the ink from one ink cartridge 100 out of the four ink cartridges 100. The inside of each ejecting portion D is filled with the ink supplied from the ink cartridge 100, so that the ejecting portion D can eject the ink filling the inside from the nozzle N provided to the ejecting portion D. Specifically, each ejecting portion D forms dots for drawing an image on the print sheet P by ejecting the ink to the print sheet P at a timing of transportation of the print sheet P onto the platen 73 by the transportation unit 7. Then, the inks of the four colors are ejected from the (4*M) pieces of the ejecting portions D provided to the four head units 3, whereby full-color printing is achieved.

Figure 4:
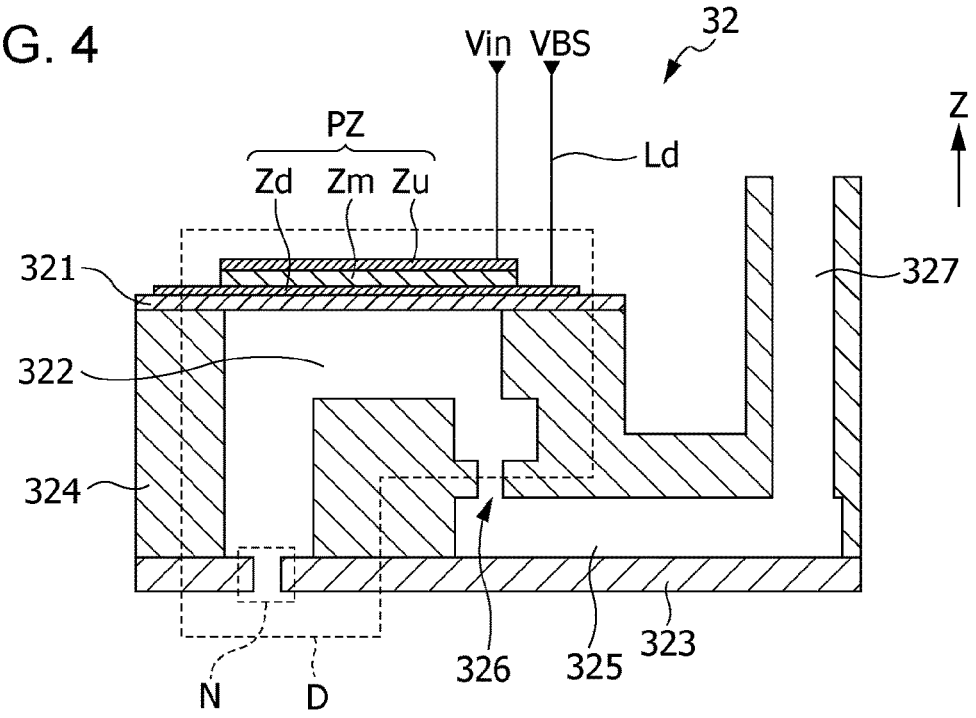
FIG. 4 is an explanatory diagram for explaining an example of a structure of an ejecting portion D.

FIG. 4 is a schematic partial cross-sectional view of the print head 32, which is obtained by cutting the print head 32 so as to sever the ejecting portion D.

As exemplarily shown in FIG. 4, the ejecting portion D includes a piezoelectric element PZ, a cavity 322 the inside of which is filled with the ink, the nozzle N communicating with the cavity 322, and a vibrating plate 321. The ejecting portion D ejects the ink inside the cavity 322 from the nozzle N with the piezoelectric element PZ being driven by a supplied driving signal Vin. The cavity 322 is a space defined by a cavity plate 324, a nozzle plate 323 provided with the nozzle N, and the vibrating plate 321. The cavity 322 communicates with a reservoir 325 through an ink supply port 326. The reservoir 325 communicates with the ink cartridge 100 corresponding to the ejecting portion D through an ink filling port 327. The piezoelectric element PZ includes an upper electrode Zu, a lower electrode Zd, and a piezoelectric body Zm provided between the upper electrode Zu and the lower electrode Zd. The lower electrode Zd is electrically coupled to a power feed line Ld that is set to a potential VBS. Then, as the supplied driving signal Vin is supplied to the upper electrode Zu and a voltage is applied between the upper electrode Zu and the lower electrode Zd, the piezoelectric element PZ is displaced either in the +Z direction or the −Z direction depending on the applied voltage, and the piezoelectric element PZ vibrates as a consequence. The lower electrode Zd is joined to the vibrating plate 321. Accordingly, when the piezoelectric element PZ vibrates by being driven with the supplied driving signal Vin, the vibrating plate 321 vibrates as well. Moreover, a volume in the cavity 322 and a pressure inside the cavity 322 change due to the vibration of the vibrating plate 321, whereby the ink filling the inside of the cavity 322 is ejected from the nozzle N.

Figure 5:
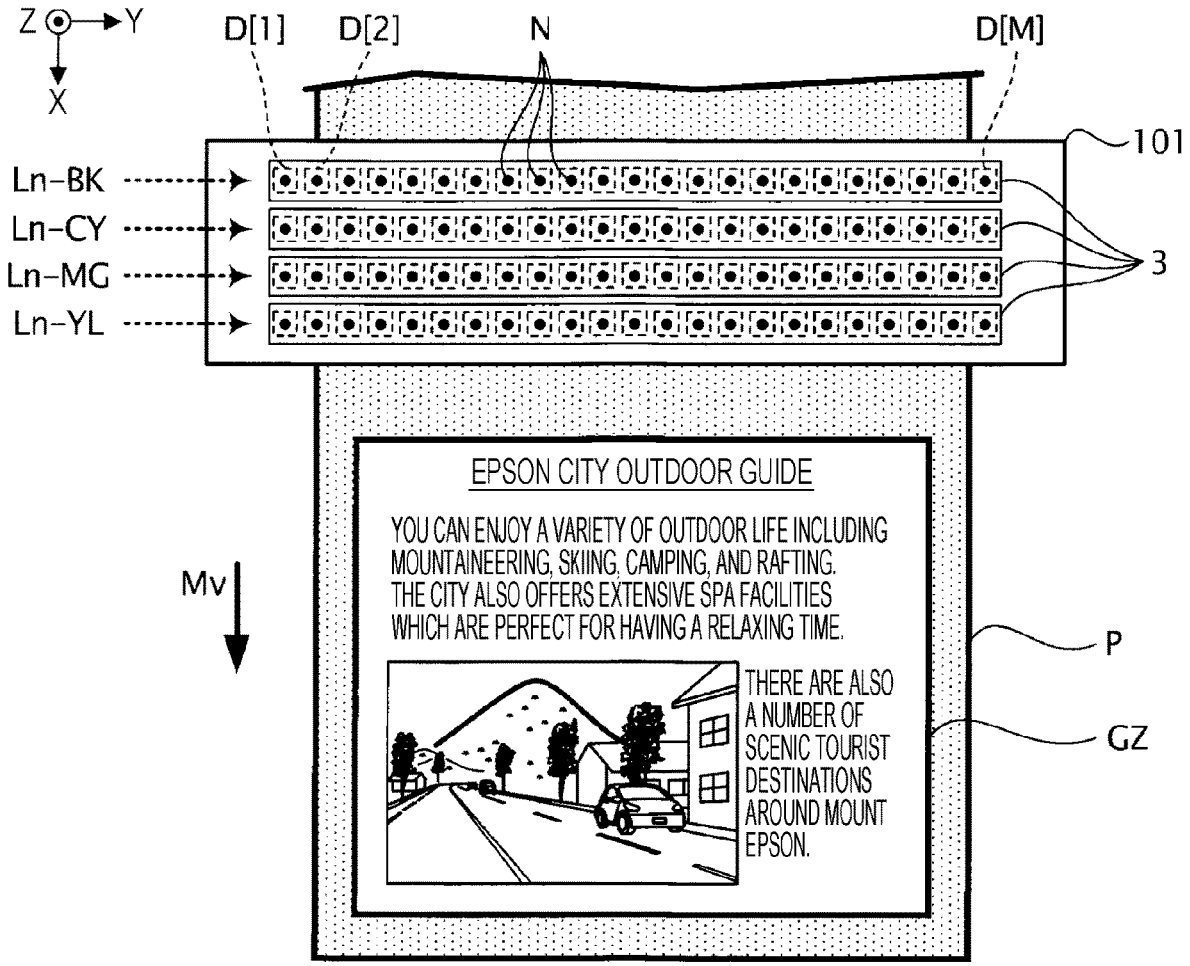
FIG. 5 is a plan view showing an example of a layout of nozzles N in a line head 101.

FIG. 5 is an explanatory diagram for explaining an example of a layout of the four head units 3 provided to the line head 101 and the 4M pieces of the ejecting portions D and nozzles N in total that are provided to the four head units 3 when the ink jet printer 1 is viewed from the −Z direction in a plan view.

As exemplarily shown in FIG. 5, each of the head units 3 provided to the line head 101 includes a nozzle array Ln. Here, the nozzle array Ln includes multiple nozzles N arranged in such a way as to extend in a line. As an example, this embodiment shows a case of providing each head unit 3 with one nozzle array Ln. Specifically, as an example, this embodiment assumes that the line head 101 is provided with a nozzle array Ln-CY that includes the multiple nozzles N corresponding to the multiple ejecting portions D for ejecting the cyan ink, a nozzle array Ln-MG that includes the multiple nozzles N corresponding to the multiple ejecting portions D for ejecting the magenta ink, a nozzle array Ln-YL that includes the multiple nozzles N corresponding to the multiple ejecting portions D for ejecting the yellow ink, and a nozzle array Ln-BK that includes the multiple nozzles N corresponding to the multiple ejecting portions D for ejecting the black ink.

This embodiment assumes that each nozzle array Ln is provided in such a way as to extend in a range in the Y-axis direction encompassing such a range in the Y-axis direction on the print sheet P that the ink jet printer 1 is supposed to form the image GZ in the printing process. Moreover, as an example, this embodiment assumes that the ejecting portion D[m+1] out of the M pieces of the ejecting portions D[1] to D[M] corresponding to the M pieces of the nozzles N constituting each nozzle array Ln is located at a position in the +Y direction from the ejecting portion D[m].

1.2 Outline of Head Unit

An outline of the head unit 3 according to this embodiment will be described below with reference to FIGS. 6 to 8.

Figure 6:
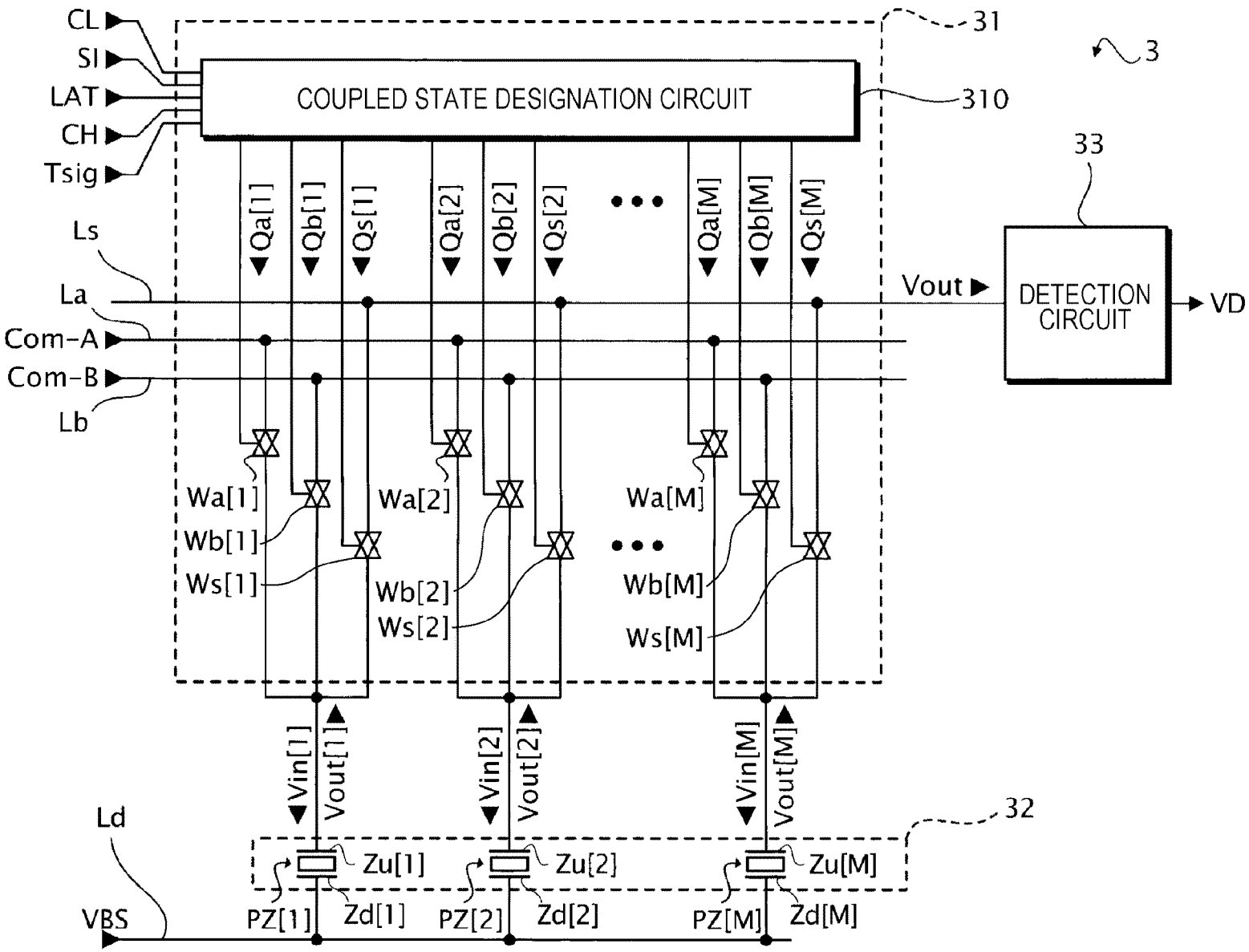
FIG. 6 is a block diagram showing an example of a configuration of a head unit 3.

FIG. 6 is a block diagram showing an example of a configuration of the head unit 3.

As discussed earlier, the head unit 3 includes the switching circuit 31, the print head 32, and the detection circuit 33. Moreover, the head unit 3 includes a line La to which the driving signal Com-A is supplied from the driving unit 4, a line Lb to which the driving signal Com-B is supplied from the driving unit 4, a Line Ls for supplying a detected potential signal Vout to the detection circuit 33, and the power feed line Ld to which the potential VBS is supplied.

As exemplarily shown in FIG. 6, the switching circuit 31 includes M pieces of switches Wa[1] to Wa[M], M pieces of switches Wb[1] to Wb[M], M pieces of switches Ws[1] to Ws[M], and a coupled state designation circuit 310 that designates a coupled state of each of the switches.

Among them, the coupled state designation circuit 310 generates a coupled state designation signal Qa[m] to designate on and off states of a switch Wa[m], a coupled state designation signal Qb[m] to designate on and off states of a switch Wb[m], and a coupled state designation signal Qs[m] to designate on and off states of a switch Ws[m] based on at least any of the print signal SI, a latch signal LAT, and a change signal CH which are supplied from the control unit 2.

Here, the switch Wa[m] switches conduction and non-conduction between the line La and the upper electrode Zu[m] of the piezoelectric element PZ[m] provided to the ejecting portion D[m] based on the coupled state designation signal Qa[m]. In this embodiment, the switch Wa[m] is turned on when the coupled state designation signal Qa[m] is set to a high level and is turned off when the coupled state designation signal Qa[m] is set to a low level. Meanwhile, the switch Wb[m] switches conduction and non-conduction between the line Lb and the upper electrode Zu[m] of the piezoelectric element PZ[m] provided to the ejecting portion D[m] based on the coupled state designation signal Qb[m]. In this embodiment, the switch Wb[m] is turned on when the coupled state designation signal Qb[m] is set to a high level and is turned off when the coupled state designation signal Qb[m] is set to a low level. In the meantime, the switch Ws[m] switches conduction and non-conduction between the line Ls and the upper electrode Zu[m] of the piezoelectric element PZ[m] provided to the ejecting portion D[m] based on the coupled state designation signal Qs[m]. In this embodiment, the switch Ws[m] is turned on when the coupled state designation signal Qs[m] is set to a high level and is turned off when the coupled state designation signal Qs[m] is set to a low level.

As mentioned earlier, the supplied driving signal Vin[m] is one of the driving signal Com-A and the driving signal Com-B to be supplied to the piezoelectric element PZ[m] of the ejecting portion D[m] through the switch Wa[m] or the switch Wb[m].

The detected potential signal Vout[m], which indicates the potential of the piezoelectric element PZ[m] of the ejecting portion D[m] driven as the inspection target ejecting portion DK, is supplied to the detection circuit 33 through line Ls. The detection circuit 33 generates the residual vibration signal VD[m] based on the detected potential signal Vout [m].

Figure 7:
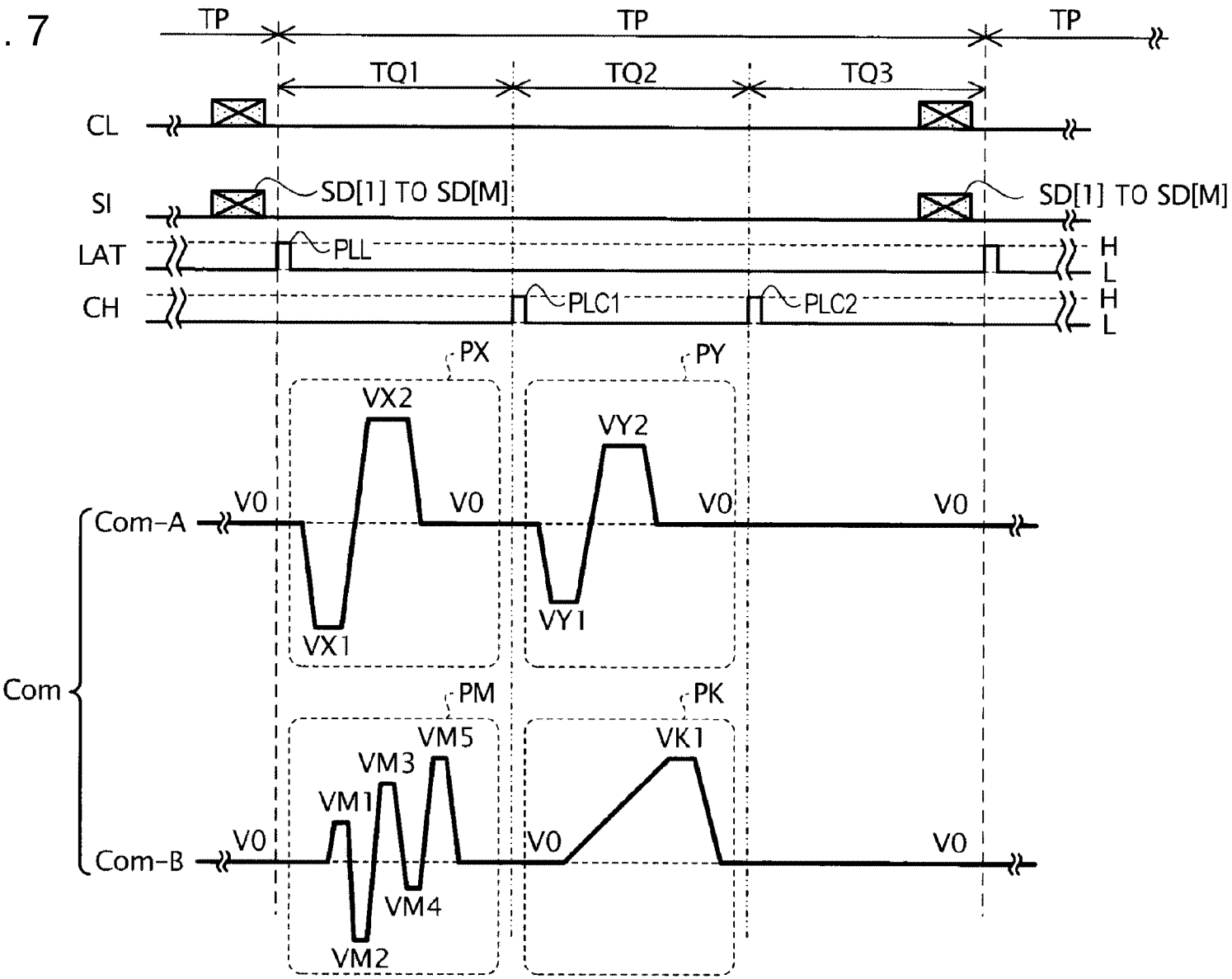
FIG. 7 is a timing chart showing an example of an operation of the ink jet printer 1.

FIG. 7 is a timing chart for explaining examples of various signals to be supplied to the head unit 3.

As exemplarily shown in FIG. 7, the control unit 2 outputs the latch signal LAT that includes pulses PLL. Thus, the control unit 2 defines a period from a rise of a first pulse PLL to a rise of a subsequent pulse PLL as a unit period TP.

An operating period of the ink jet printer 1 is defined by one or more unit periods TP in this embodiment. Moreover, the ink jet printer 1 according to this embodiment can drive the respective ejecting portion D in each unit period TP for the printing process. In addition, the ink jet printer 1 according to this embodiment is capable of driving the inspection target ejecting portion DK and detecting the detected potential signal Vout from the inspection target ejecting portion DK in each unit period TP.

Meanwhile, as an example, this embodiment assumes that the printing task is executed in K pieces of continuous unit periods TP. Here, the value K is a natural number that satisfies "K≥2". In the following description, a k-th unit period TP out of the K pieces of the unit periods TP in which the printing task is executed may be referred to as a unit period TP(k) when appropriate. Here, the variable k is a natural number that satisfies "1≤k≤K".

As exemplarily shown in FIG. 7, in the unit period TP, the control unit 2 outputs the change signal CH that includes a pulse PLC1 and a pulse PLC2. Then, the control unit 2 divides the unit period TP into a control period TQ1 from the rise of the pulse PLL to a rise of the pulse PLC1, a control period TQ2 from the rise of the pulse PLC1 to a rise of the pulse PLC2, and a control period TQ3 from the rise of the pulse PLC2 to the rise of the next pulse PLL.

As exemplarily shown in FIG. 7, the print signal SI includes individual designation signals SD[1] to SD[M] which designate driving aspects of the ejecting portions D[1] to D[M] in each unit period TP. Prior to each unit period TP, the control unit 2 synchronizes the print signal SI that includes the individual designation signals SD[1] to SD[M] with a clock signal CL and supplies these signals to the coupled state designation circuit 310. Thereafter, in each unit period TP, the coupled state designation circuit 310 generates the coupled state designation signal Qa[m], the coupled state designation signal Qb[m], and the coupled state designation signal Qs[m] based on the individual designation signal SD[m].

Here, this embodiment assumes that the ejecting portion D[m] is capable of forming a large dot, a medium dot smaller than the large dot, a small dot smaller than the medium dot, and a fine dot smaller than the small dot. Moreover, this embodiment assumes that the individual designation signal SD[m] can have any one of the following ten values in each unit period TP, namely, a value "1" that instructs the ejecting portion D[m] to be driven as a large dot forming ejecting portion DP1, a value "2" that instructs the ejecting portion D[m] to be driven as a medium dot forming ejecting portion DP2, a value "3" that instructs the ejecting portion D[m] to be driven as a small dot forming ejecting portion DP3, a value "4" that instructs the ejecting portion D[m] to be driven as a fine dot forming ejecting portion DP4, a value "5" that instructs the ejecting portion D[m] to be driven as a non-dot forming ejecting portion DP5, a value "6" that instructs the ejecting portion D[m] to be driven as a large dot forming inspection target ejecting portion DK1, a value "7" that instructs the ejecting portion D[m] to be driven as a medium dot forming inspection target ejecting portion DK2, a value "8" that instructs the ejecting portion D[m] to be driven as a small dot forming inspection target ejecting portion DK3, a value "9" that instructs the ejecting portion D[m] to be driven as a fine dot forming inspection target ejecting portion DK4, and a value "10" that instructs the ejecting portion D[m] to be driven as non-dot forming inspection target ejecting portion DK5.

Here, the large dot forming ejecting portion DP1 is the ejecting portion D other than inspection target ejecting portion DK, which ejects the ink in an ink quantity ξ1 corresponding to the large dot in the unit period TP. Meanwhile, the medium dot forming ejecting portion DP2 is the ejecting portion D other than inspection target ejecting portion DK, which ejects the ink in an ink quantity ξ2 corresponding to the medium dot in the unit period TP. Here, the ink quantity is an ink quantity less than the ink quantity ξ1. In the meantime, the small dot forming ejecting portion DP3 is the ejecting portion D other than inspection target ejecting portion DK, which ejects the ink in an ink quantity ξ3 corresponding to the small dot in the unit period TP. Here, the ink quantity ξ3 is an ink quantity less than the ink quantity ξ2. Meanwhile, the fine dot forming ejecting portion DP4 is the ejecting portion D other than inspection target ejecting portion DK, which ejects the ink in an ink quantity ξ4 corresponding to the fine dot in the unit period TP. Here, the ink quantity ξ4 is an ink quantity less than the ink quantity ξ3. In the meantime, the non-dot forming ejecting portion DP5 is the ejecting portion D other than inspection target ejecting portion DK, which does not eject the ink in the unit period TP.

In the following description, the large dot forming ejecting portion DP1, the medium dot forming ejecting portion DP2, the small dot forming ejecting portion DP3, the fine dot forming ejecting portion DP4, and the non-dot forming ejecting portion DP5 will be collectively referred to as non-inspection target ejecting portions DP. Meanwhile, in the following description, any one of the large dot forming ejecting portion DP1, the medium dot forming ejecting portion DP2, the small dot forming ejecting portion DP3, the fine dot forming ejecting portion DP4, and the non-dot forming ejecting portion DP5 may be expressed as a non-inspection target ejecting portion DPq when appropriate. Here, the variable q is a natural number that satisfies "$1 \leq q \leq 5$".

In the meantime, the large dot forming inspection target ejecting portion DK1 is the inspection target ejecting portion DK, which ejects the ink in the ink quantity ξ1 in the unit period TP. Meanwhile, the medium dot forming inspection target ejecting portion DK2 is the inspection target ejecting portion DK, which ejects the ink in the ink quantity ξ2 in the unit period TP. In the meantime, the small dot forming inspection target ejecting portion DK3 is the inspection target ejecting portion DK, which ejects the ink in the ink quantity ξ3 in the unit period TP. Meanwhile, the fine dot forming inspection target ejecting portion DK4 is the inspection target ejecting portion DK, which ejects the ink in the ink quantity ξ4 in the unit period TP. In the meantime, the non-dot forming inspection target ejecting portion DK5 is the inspection target ejecting portion DK, which does not eject the ink in the unit period TP.

In the following description, any one of the large dot forming inspection target ejecting portion DK1, the medium dot forming inspection target ejecting portion DK2, the small dot forming inspection target ejecting portion DK3, the fine dot forming inspection target ejecting portion DK4, and the non-dot forming inspection target ejecting portion DK5 will be expressed as an inspection target ejecting portion DKq when appropriate.

As exemplarily shown in FIG. 7, in this embodiment, the driving signal Com-A includes a waveform PX provided in the control period TQ1 and a waveform PY provided in the control period TQ2.

Of these waveforms, the waveform PX is a waveform that starts from a reference potential V0, then passes through a potential VX1 being a lower potential than the reference potential V0 and a potential VX2 being a higher potential than the reference potential V0, and then returns to the reference potential V0. As an example, this embodiment assumes that the volume of the cavity 322 provided to the ejecting portion D[m] becomes smaller when the potential of the supplied driving signal Vin[m] to be supplied to the ejecting portion D[m] is a high potential than the volume in the case of a low potential. As a consequence, when the ejecting portion D[m] is driven by the supplied driving signal Vin[m] having the waveform PX, the volume of the cavity 322 provided to the ejecting portion D[m] becomes smaller as the potential of the supplied driving signal Vin[m] changes from the potential VX1 to the potential VX2, whereby the ink inside the ejecting portion D[m] is ejected from the nozzle N. In this embodiment, when the driving signal Com-A having the waveform PX is supplied to the ejecting portion D[m] as the supplied driving signal Vin[m], the waveform PX is determined such that the ejecting portion D[m] is driven in a mode to eject the ink in the ink quantity ξ2.

Meanwhile, the waveform PY is a waveform that starts from the reference potential V0, then passes through a potential VY1 being a lower potential than the reference potential V0 and a potential VY2 being a higher potential than the reference potential V0, and then returns to the reference potential V0. In this embodiment, when the driving signal Com-A having the waveform PY is supplied to the ejecting portion D[m] as the supplied driving signal Vin[m], the waveform PY is determined such that the ejecting portion D[m] is driven in a mode to eject the ink in the ink quantity ξ3.

In this embodiment, the driving signal Com-A retains the reference potential V0 in the control period TQ3.

As exemplarily shown in FIG. 7, in this embodiment, the driving signal Com-B includes a waveform PM provided in the control period TQ1 and a waveform PK provided in the control period TQ2.

Of these waveforms, the waveform PM is a waveform that starts from the reference potential V0, then passes through a potential VM1 being a higher potential than the reference potential V0, a potential VM2 being a lower potential than the reference potential V0, a potential VM3 being a higher potential than the reference potential V0, a potential VM4 being a lower potential than the reference potential V0, and a potential VM5 being a higher potential than the reference potential V0, and then returns to the reference potential V0. In this embodiment, when the driving signal Com-B having the waveform PM is supplied to the ejecting portion D[m] as the supplied driving signal Vin[m], the waveform PM is determined such that the ejecting portion D[m] is driven in a mode to eject the ink in the ink quantity ξ4.

Meanwhile, the waveform PK is a waveform that starts from the reference potential V0, then passes through a potential VK1 being a higher potential than the reference potential V0, and then returns to the reference potential V0. In this embodiment, when the driving signal Com-B having the waveform PK is supplied to the ejecting portion D[m] as the supplied driving signal Vin[m], the waveform PK is determined such that the ejecting portion D[m] is driven in a mode not to eject the ink.

In this embodiment, the driving signal Com-B retains the reference potential V0 in the control period TQ3.

FIG. 8 is an explanatory diagram for explaining an example of relations among the individual designation signal SD[m], the coupled state designation signal Qa[m], the coupled state designation signal Qb[m], and the coupled state designation signal Qs[m].

As exemplarily shown in FIG. 8, when the individual designation signal SD[m] shows the value "1" in the unit period TP, which instructs the ejecting portion D[m] to be driven as the large dot forming ejecting portion DP1, the coupled state designation circuit 310 sets the coupled state designation signal Qa[m] to a high level throughout the control periods TQ1 and TQ2. In this case, the switch Wa[m] is turned on throughout the control periods TQ1 and TQ2. Moreover, in this case, the ejecting portion D[m] is driven by the supplied driving signal Vin[m] having the waveform PX in the control period TQ1 and is driven by the supplied driving signal Vin[m] having the waveform PY in the control period TQ2. As a consequence, the ejecting portion D[m] ejects the ink in the ink quantity ξ1.

Meanwhile, when the individual designation signal SD[m] shows the value "2" in the unit period TP, which instructs the ejecting portion D[m] to be driven as the medium dot forming ejecting portion DP2, the coupled state designation circuit 310 sets the coupled state designation signal Qa[m] to the high level in the control period TQ1. In this case, the switch Wa[m] is turned on in the control period TQ1. Moreover, in this case, the ejecting portion D[m] is driven by the supplied driving signal Vin[m] having the waveform PX in the control period TQ1. As a consequence, the ejecting portion D[m] ejects the ink in the ink quantity ξ2.

In the meantime, when the individual designation signal SD[m] shows the value "3" in the unit period TP, which instructs the ejecting portion D[m] to be driven as the small dot forming ejecting portion DP3, the coupled state designation circuit 310 sets the coupled state designation signal Qa[m] to the high level in the control period TQ2. In this case, the switch Wa[m] is turned on in the control period TQ2. Moreover, in this case, the ejecting portion D[m] is driven by the supplied driving signal Vin[m] having the waveform PY in the control period TQ2. As a consequence, the ejecting portion D[m] ejects the ink in the ink quantity ξ3.

Meanwhile, when the individual designation signal SD[m] shows the value "4" in the unit period TP, which instructs the ejecting portion D[m] to be driven as the fine dot forming ejecting portion DP4, the coupled state designation circuit 310 sets the coupled state designation signal Qb[m] to a high level in the control period TQ1. In this case, the switch Wb[m] is turned on in the control period TQ1. Moreover, in this case, the ejecting portion D[m] is driven by the supplied driving signal Vin[m] having the waveform PM in the control period TQ1. As a consequence, the ejecting portion D[m] ejects the ink in the ink quantity ξ4.

In the meantime, when the individual designation signal SD[m] shows the value "5" in the unit period TP, which instructs the ejecting portion D[m] to be driven as the non-dot forming ejecting portion DP5, the coupled state designation circuit 310 sets the coupled state designation signal Qb[m] to the high level in the control period TQ2. In this case, the switch Wb[m] is turned on in the control period TQ2. Moreover, in this case, the ejecting portion D[m] is driven by the supplied driving signal Vin[m] having the waveform PK in the control period TQ2. As a consequence, the ejecting portion D[m] does not eject the ink.

As exemplarily shown in FIG. 8, when the individual designation signal SD[m] shows the value "6" in the unit period TP, which instructs the ejecting portion D[m] to be driven as the large dot forming inspection target ejecting portion DK1, the coupled state designation circuit 310 sets the coupled state designation signal Qa[m] to the high level throughout the control periods TQ1 and TQ2, and sets the coupled state designation signal Qs[m] to a high level in the control period TQ3. In this case, the switch Wa[m] is turned on throughout the control periods TQ1 and TQ2, and the switch Ws[m] is turned on in the control period TQ3. Moreover, in this case, the ejecting portion D[m] is driven by the supplied driving signal Vin[m] having the waveform PX in the control period TQ1 and is driven by the supplied driving signal Vin[m] having the waveform PY in the control period TQ2. As a consequence, the ejecting portion D[m] ejects the ink in the ink quantity ξ1. Furthermore, in this case, the detection circuit 33 detects the detected potential signal Vout[m] based on the vibration that is generated in the ejecting portion D[m] in the control period TQ3.

Meanwhile, when the individual designation signal SD[m] shows the value "7" in the unit period TP, which instructs the ejecting portion D[m] to be driven as the medium dot forming inspection target ejecting portion DK2, the coupled state designation circuit 310 sets the coupled state designation signal Qa[m] to the high level in the control period TQ1, and sets the coupled state designation signal Qs[m] to the high level in the control period TQ3. In this case, the switch Wa[m] is turned on in the control period TQ1, and the switch Ws[m] is turned on in the control period TQ3. Moreover, in this case, the ejecting portion D[m] is driven by the supplied driving signal Vin[m] having the waveform PX in the control period TQ1. As a consequence, the ejecting portion D[m] ejects the ink in the ink quantity ξ2. Furthermore, in this case, the detection circuit 33 detects the detected potential signal Vout[m] based on the vibration that is generated in the ejecting portion D[m] in the control period TQ3.

In the meantime, when the individual designation signal SD[m] shows the value "8" in the unit period TP, which instructs the ejecting portion D[m] to be driven as the small dot forming inspection target ejecting portion DK3, the coupled state designation circuit 310 sets the coupled state designation signal Qa[m] to the high level in the control period TQ2, and sets the coupled state designation signal Qs[m] to the high level in the control period TQ3. In this case, the switch Wa[m] is turned on in the control period TQ2, and the switch Ws[m] is turned on in the control period TQ3. Moreover, in this case, the ejecting portion D[m] is driven by the supplied driving signal Vin[m] having the waveform PY in the control period TQ2. As a consequence, the ejecting portion D[m] ejects the ink in the ink quantity ξ3. Furthermore, in this case, the detection circuit 33 detects the detected potential signal Vout[m] based on the vibration that is generated in the ejecting portion D[m] in the control period TQ3.

Meanwhile, when the individual designation signal SD[m] shows the value "9" in the unit period TP, which instructs the ejecting portion D[m] to be driven as the fine dot forming inspection target ejecting portion DK4, the coupled state designation circuit 310 sets the coupled state designation signal Qb[m] to the high level in the control period TQ1, and sets the coupled state designation signal Qs[m] to the high level in the control period TQ3. In this case, the switch Wb[m] is turned on in the control period TQ1, and the switch Ws[m] is turned on in the control period TQ3. Moreover, in this case, the ejecting portion D[m] is driven by the supplied driving signal Vin[m] having the waveform PM in the control period TQ1. As a consequence, the ejecting portion D[m] ejects the ink in the ink quantity ξ4. Furthermore, in this case, the detection circuit 33 detects the detected potential signal Vout[m] based on the vibration that is generated in the ejecting portion D[m] in the control period TQ3.

In the meantime, when the individual designation signal SD[m] shows the value "10" in the unit period TP, which instructs the ejecting portion D[m] to be driven as the non-dot forming inspection target ejecting portion DK5, the coupled state designation circuit 310 sets the coupled state designation signal Qb[m] to the high level in the control period TQ2, and sets the coupled state designation signal Qs[m] to the high level in the control period TQ3. In this case, the switch Wb[m] is turned on in the control period TQ2, and the switch Ws[m] is turned on in the control period TQ3. Moreover, in this case, the ejecting portion D[m] is driven by the supplied driving signal Vin[m] having the waveform PK in the control period TQ2. As a consequence, the ejecting portion D[m] does not eject the ink. Furthermore, in this case, the detection circuit 33 detects the detected potential signal Vout[m] based on the vibration that is generated in the ejecting portion D[m] in the control period TQ3.

As described above, the detection circuit 33 generates the residual vibration signal VD[m] based on the detected potential signal Vout[m]. Specifically, the detection circuit 33 generates the residual vibration signal VD[m] that is shaped into a waveform suitable for the process with the vibration analysis unit 5 by amplifying the detected potential signal Vout[m] and removing a noise component therefrom. That is to say, in this embodiment, the residual vibration signal VD[m] shows a waveform of the vibration generated in the control period TQ3 at the ejecting portion D[m] to be driven as the inspection target ejecting portion DK.

Figure 9:
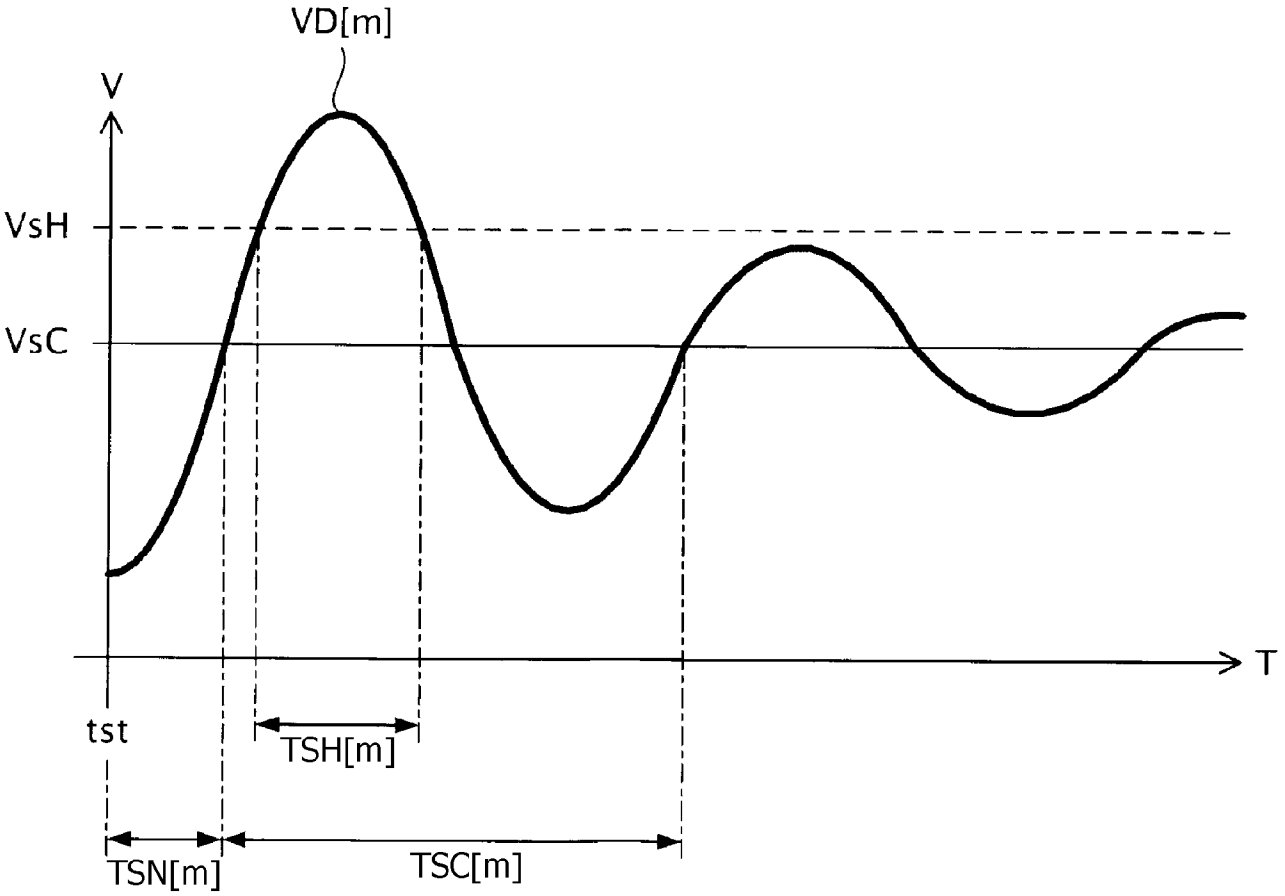
FIG. 9 is an explanatory diagram for explaining an example of a residual vibration signal VD[m].

FIG. 9 is an explanatory diagram for explaining an example of a process by the vibration analysis unit 5 to create the vibration information SJ[m] based on the residual vibration signal VD[m].

As exemplarily shown in FIG. 9, the vibration analysis unit 5 compares the residual vibration signal VD[m] with a potential VsC at a central level of amplitude of the residual vibration signal VD[m]. Based on a result of the comparison, the vibration analysis unit 5 obtains a time length TSN[m] from time of start of the control period TQ3 to time when the residual vibration signal VD[m] reaches the potential VsC for the first time in the control period TQ3, and a time length TSC[m] from the time when the residual vibration signal VD[m] reaches the potential VsC for the first time in the control period TQ3 to time when the residual vibration signal VD[m] reaches the potential VsC for the third time in the control period TQ3. Meanwhile, the vibration analysis unit 5 compares the residual vibration signal VD[m] with a potential VsH that is a higher potential than the potential VsC. Based on a result of the comparison, the vibration analysis unit 5 obtains a time length TSH[m] from time when the residual vibration signal VD[m] reaches the potential VsH for the first time in the control period TQ3 to time when the residual vibration signal VD[m] reaches the potential VsH for the second time in the control period TQ3.

Then, the vibration analysis unit 5 outputs the vibration information SJ[m] that indicates the time length TSN[m], the time length TSC[m], and the time length TSH[m].

In general, the vibration that is generated in the ejecting portion D has the waveform which is determined by shapes and sizes of the nozzle N and the cavity 322 as well as a weight of the ink filling the cavity 322, and so forth. In general, when there is an abnormality in ejection due to a bubble that is trapped in the cavity 322 of the ejecting portion D, for example, a cycle of the vibration generated in the ejecting portion D becomes shorter as compared to the case where the state of ejection is normal. Moreover, in general, when there is an abnormality in ejection due to adhesion of a foreign matter such as paper powder to the neighborhood of the nozzle N of the ejecting portion D, the cycle of the vibration generated in the ejecting portion D becomes longer as compared to the case where the state of ejection is normal. On the other hand, in general, when there is an abnormality in ejection due to an increase in viscosity of the ink inside the cavity 322 of the ejecting portion D, the cycle of the vibration generated in the ejecting portion D becomes longer as compared to the case where the state of ejection is normal. As described above, the waveform of the vibration generated in the ejecting portion D varies depending on the state of ejection of the ink from the ejecting portion D. For this reason, the state of ejection of the ink from the ejecting portion D[m] can generally be inspected based on the waveform of the vibration generated in the ejecting portion D.

1.3 Operation of Ink Jet Printer

An operation of the ink jet printer 1 according to this embodiment will be described below with reference to FIGS. 10 and 11.

Figure 10:
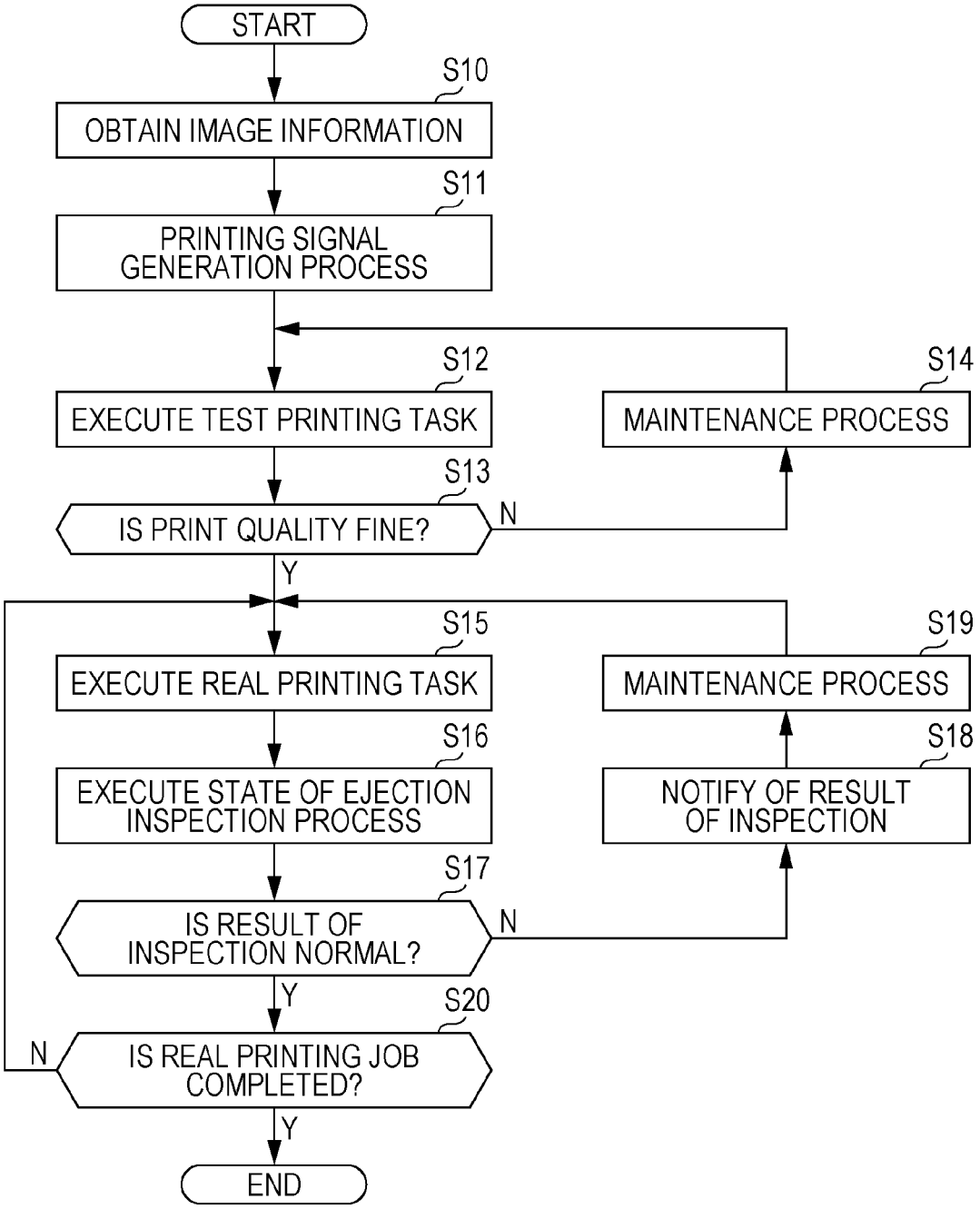
FIG. 10 is a flowchart for explaining an example of an operation of the ink jet printer 1.

FIG. 10 is a flowchart showing an example of an operation of the ink jet printer 1 when the printing job is executed. In this embodiment, the ink jet printer 1 executes the printing task to form the image GZ on the print sheet P based on the image information Img prior to execution of the printing job to form the WCP pieces of the images GZ on the print sheet P based on the image information Img.

In the following description, each of WCP times of the printing tasks to be executed in the printing job may be referred to as a real printing task while the printing task to be executed before starting the printing job may be referred to as a test printing task when appropriate.

As exemplarily shown in FIG. 10, when the ink jet printer 1 executes the printing job, the host information acceptance unit 23 of the control unit 2 obtains the image information Img and the number-of-copies information CP from the host computer 9 (S10).

Next, the control unit 2 executes a printing signal generation process (S11). The printing signal generation process is a process to generate the print signal SI based on the image information Img. Details of this process will be described later.

Next, the control unit 2 controls the respective units in the ink jet printer 1 such that the test printing task is executed (S12).

In the following description, the ejecting portion D[m] in the unit period TP(k) out of K pieces of the unit periods TP(1) to TP(K), in which the printing task is executed, may be expressed as an ejecting portion D[m][TP(k)] when appropriate. Moreover, in the following description, the individual designation signal SD[m] that designates the driving aspect of the ejecting portion D[m][TP(k)] may be expressed as an individual designation signal SD[m][TP(k)] when appropriate.

Meanwhile, in the following description, a reference sign corresponding to the real printing task will be expressed by addition of a suffix "h" thereto when the real printing task has to be distinguished from the test printing task. Specifically, when the real printing task has to be distinguished from the test printing task in the following description, the image GZ formed in the real printing task will be referred to as an image GZh, the unit period TP(k) in which the real printing task is executed will be referred to as a unit period TPh(k), the ejecting portion D[m] corresponding to the unit period TPh(k) will be referred to as an ejecting portion Dh[m][TP(k)], the individual designation signal SD[m] instructing the driving aspect of the ejecting portion Dh[m][TP(k)] will be referred to as an individual designation signal SDh[m][TP(k)], the residual vibration signal VD[m] based on the detected potential signal Vout[m] outputted from the ejecting portion Dh[m][TP(k)] will be referred to as a residual vibration signal VDh[m][TP(k)], the vibration information SJ[m] created based on the residual vibration signal VDh[m][TP(k)] will be referred to as vibration information SJh[m][TP(k)], and the time length TSN[m], the time length TSC[m], and the time length TSH[m] included in the vibration information SJh[m][TP(k)] will be referred to as a time length TSNh[m][TP(k)], a time length TSCh[m][TP(k)], and a time length TSHh[m][TP(k)], respectively.

Meanwhile, in the following description, a reference sign corresponding to the test printing task will be expressed with addition of a suffix "t" thereto when the test printing task has to be distinguished from the real printing task. Specifically, when the test printing task has to be distinguished from the real printing task in the following description, the image GZ formed in the test printing task will be referred to as an image GZt, the unit period TP(k) in which the test printing task is executed will be referred to as a unit period TPt(k), the ejecting portion D[m] corresponding to the unit period TPt(k) will be referred to as an ejecting portion Dt[m][TP(k)], the individual designation signal SD[m] instructing the driving aspect of the ejecting portion Dt[m][TP(k)] will be referred to as an individual designation signal SDt[m][TP(k)], the residual vibration signal VD[m] based on the detected potential signal Vout[m] outputted from the ejecting portion Dt[m][TP(k)] will be referred to as a residual vibration signal VDt[m][TP(k)], the vibration information SJ[m] created based on the residual vibration signal VDt[m][TP(k)] will be referred to as vibration information SJt[m][TP(k)], and the time length TSN[m], the time length TSC[m], and the time length TSH[m] included in the vibration information SJt[m][TP(k)] will be referred to as a time length TSNt[m][TP(k)], a time length TSCt[m][TP(k)], and a time length TSHt[m][TP(k)], respectively.

In this embodiment, both of the image GZh formed in the real printing task and the image GZt formed in the test printing task are images based on the image information Img. Accordingly, in this embodiment, the image GZh and the image GZt are the same image when the states of ejection of the ejecting portions D[1] to D[M] are normal in the real printing task and the states of ejection of the ejecting portions D[1] to D[M] are normal in the test printing task.

In the test printing task in step S12, the print control unit 21 of the control unit 2 forms the image GZt indicated by the image information Img on the print sheet P by controlling the head unit 3 based on the print signal SI generated in step S11. Meanwhile, in the test printing task in step S12, the vibration information acquisition unit 22 of the control unit 2 obtains the vibration information SJt[m][TP(k)] based on the detected potential signal Vout[m] outputted from the ejecting portion Dt[m][TP(k)] selected as the inspection target ejecting portion DK, and stores the obtained vibration information SJt[m][TP(k)] in the storage unit 61.

In this embodiment, the host computer 9 creates the print quality approval information JH, which indicates whether or not the image GZt formed on the print sheet P in the test printing task satisfies print quality desired by a user of the printing system Sys based on an operation of the operating unit 93 by the user. Then, the host information acceptance unit 23 of the control unit 2 determines whether or not the print quality approval information JH supplied from the host computer 9 indicates that the print quality of the image GZt formed on the print sheet P in the test printing task satisfies the print quality desired by the user of the printing system Sys (S13).

When a result of determination in step S13 is negative, the control unit 2 controls the maintenance unit 63 in such a way as to execute the maintenance process (S14), and proceeds to the process in step S12. Here, the maintenance process collectively refers to processes to bring the state of ejection of the ink from the ejecting portion D back to normal, which include a flushing process of discharging the ink out of the ejecting portion D, a wiping process of wiping a foreign matter such as paper powder adhering to the neighborhood of the nozzle N of the ejecting portion D off with a wiper, a pumping process of suctioning the ink inside the ejecting portion D with a tube pump, and the like.

When the result of determination in step S13 is affirmative, the control unit 2 controls the respective units in the ink jet printer 1 in such a way as to execute the real printing task (S15). Specifically, the print control unit 21 of the control unit 2 controls the head unit 3 based on the print signal SI generated in step S11 in the real printing task in step S15, thereby forming the image GZh indicated by the image information Img on the print sheet P. Meanwhile, in the real printing task in step S15, the vibration information acquisition unit 22 of the control unit 2 obtains the vibration information SJh[m][TP(k)] based on the detected potential signal Vout[m] outputted from the ejecting portion Dh[m][TP(k)] selected as the inspection target ejecting portion DK, and stores the obtained vibration information SJh[m][TP(k)] in the storage unit 61.

Next, the ejection state inspection unit 25 of the control unit 2 executes an ejecting state inspection process based on the vibration information SJt[m][TP(k)] obtained in step S12 and on the vibration information SJh[m][TP(k)] obtained in step S15 (S16). Here, the ejecting state inspection process is a process to inspect the state of ejection of the ink from the ejecting portion D.

As discussed earlier, the waveform of the vibration generated in the ejecting portion D varies depending on the state of ejection of the ink from the ejecting portion D. Moreover, in this embodiment, both of the individual designation signal SDt[m][TP(k)] and the individual designation signal SDh[m][TP(k)] are formed based on the image information Img. In other words, in this embodiment, the individual designation signal SDt[m][TP(k)] and the individual designation signal SDh[m][TP(k)] have an equal value. As a consequence, if the state of ejection of the ink from the ejecting portion Dt[m][TP(k)] is normal and the state of ejection of the ink from the ejecting portion Dh[m][TP(k)] is normal, then the waveform of the residual vibration signal VDt[m][TP(k)] becomes substantially equal to the waveform of the residual vibration signal VDh[m][TP(k)]. Moreover, if the waveform of the residual vibration signal VDt[m][TP(k)] is substantially equal to the waveform of the residual vibration signal VDh[m][TP(k)], then the value indicated by the vibration information SJt[m][TP(k)] becomes substantially equal to the value indicated by the vibration information SJh[m][TP(k)]. Accordingly, if the state of ejection of the ink from the ejecting portion Dt[m][TP(k)] is normal, then the state of ejection of the ink from the ejecting portion Dh[m][TP(k)] is also deemed to be normal on the condition that the value indicated by the vibration information SJt[m][TP(k)] is substantially equal to the value indicated by the vibration information SJh[m][TP(k)]. In other words, if the print quality approval information JH indicates that the print quality of the image GZt in the test printing task is good, then the print quality of the image GZh in the real printing task is also supposed to be good on the condition that the value indicated by the vibration information SJt[m][TP(k)] is substantially equal to the value indicated by the vibration information SJh[m][TP(k)].

For this reason, in this embodiment, when the result of determination in step S13 turns out to indicate the good print quality of the image GZt in the test printing task by the print quality approval information JH, an inspection is carried out as to whether or not the print quality of the image GZh formed in the real printing task is good by determining whether or not the value indicated by the vibration information SJt[m][TP(k)] is substantially equal to the value indicated by the vibration information SJh[m][TP(k)] in the ejecting state inspection process in step S16.

In this specification, the expression "substantially equal" is a concept that includes a case of being regarded as equal in consideration of an allowance as well as a case of being strictly equal.

To be more precise, in this embodiment, the ejection state inspection unit 25 of the control unit 2 determines in the ejecting state inspection process in step S16 whether or not the value indicated by the vibration information SJt[m][TP(k)] and the value indicated by the vibration information SJh[m][TP(k)] satisfy all of the following formulae (1) to (3). Then, the ejection state inspection unit 25 generates a result of inspection indicating that the state of ejection of the ejecting portion Dh[m][TP(k)] is normal when the value indicated by the vibration information SJt[m][TP(k)] and the value indicated by the vibration information SJh[m][TP(k)] satisfy all of the following formulae (1) to (3). On the other hand, the ejection state inspection unit 25 generates a result of inspection indicating that the state of ejection of the ejecting portion Dh[m][TP(k)] is abnormal when the value indicated by the vibration information SJt[m][TP(k)] and the value indicated by the vibration information SJh[m][TP(k)] do not satisfy part or all of the following formulae (1) to (3).

$$|TSNt[m][TP(k)]-TSNh[m][TP(k)]|\leq\alpha1*TSNt[m][TP(k)] \quad (1)$$

$$|TSCt[m][TP(k)]-TSCh[m][TP(k)]|\leq\alpha2*TSCt[m][TP(k)] \quad (2)$$

$$|TSHt[m][TP(k)]-TSHh[m][TP(k)]|\leq\alpha3*TSHt[m][TP(k)] \quad (3)$$

Here, the value $\alpha1$ satisfies "$0\leq\alpha1\leq0.3$" or preferably satisfies "$0\leq\alpha1\leq0.1$". Meanwhile, the value $\alpha2$ satisfies "$0\leq\alpha2\leq0.3$" or preferably satisfies "$0\leq\alpha2\leq0.1$". In the meantime, the value $\alpha3$ satisfies "$0\leq\alpha3\leq0.3$" or preferably satisfies "$0\leq\alpha3\leq0.1$".

In this embodiment, the ejection state inspection unit 25 generates the result of inspection indicating that the state of ejection of the ejecting portion Dh[m][TP(k)] is normal in the ejecting state inspection process when the value indicated by the vibration information SJt[m][TP(k)] and the value indicated by the vibration information SJh[m][TP(k)] satisfy all the formulae (1) to (3). However, the present disclosure is not limited only to this aspect.

The ejection state inspection unit 25 may generate the result of inspection indicating that the state of ejection of the ejecting portion Dh[m][TP(k)] is normal in the ejecting state inspection process when the value indicated by the vibration information SJt[m][TP(k)] and the value indicated by the vibration information SJh[m][TP(k)] satisfy part of the formulae (1) to (3).

For example, the ejection state inspection unit 25 may generate the result of inspection indicating that the state of ejection of the ejecting portion Dh[m][TP(k)] is normal in the ejecting state inspection process when the value indicated by the vibration information SJt[m][TP(k)] and the value indicated by the vibration information SJh[m][TP(k)] satisfy the formula (2). In this case, the ejection state inspection unit 25 may generate the result of inspection indicating that the state of ejection of the ejecting portion Dh[m][TP(k)] is abnormal when the value indicated by the vibration information SJt[m][TP(k)] and the value indicated by the vibration information SJh[m][TP(k)] do not satisfy the formula (2).

As exemplarily shown in FIG. 10, the ejection state inspection unit 25 of the control unit 2 determines whether or not the result of inspection generated in the ejecting state inspection process in step S16 indicates that the state of ejection of the ejecting portion Dh[m][TP(k)] is normal (S17).

When a result of determination in step S17 is negative, the control unit 2 controls the notification unit 62 in such a way as to notify of the result of inspection in the ejecting state inspection process (S18), and proceeds to the process in S19.

Next, the control unit 2 controls the maintenance unit 63 in such a way as to execute the maintenance process (S19), and proceeds to the process in step S15.

The control unit 2 may carry out a supplementary printing process in S18 instead of executing the maintenance process. Here, the supplementary printing process is a process to suspend ejection of the ink from the ejecting portion D[m] determined to have the abnormal state of ejection in the ejecting state inspection process in S16, and then to increase an ejection quantity of the ink from one or both of the ejecting portion D[m−1] and the ejecting portion D[m+1] adjacent to the ejecting portion D[m] instead of ejecting the ink from the ejecting portion D[m].

When the result of determination in step S17 is affirmative, the print control unit 21 of the control unit 2 determines whether or not the printing job is completed (S20). Specifically, in step S20, the print control unit 21 determines whether or not the state of ejection is determined as normal in the ejecting state inspection process in step S16 and WCP pieces of the images GZh in good print quality are successfully formed on the print sheet P.

When a result of determination in step S20 is negative, the control unit 2 proceeds to the process in step S15.

When the result of determination in step S20 is affirmative, the control unit 2 terminates the series of processes shown in FIG. 10.

As described above, according to this embodiment, the ejection state inspection unit 25 inspects the state of ejection of the ink from the ejecting portion Dh[m][TP(k)] by comparing the vibration information SJt[m][TP(k)] obtained when printing the image GZt that is determined to have the good print quality in the test printing task with the vibration information SJh[m][TP(k)] obtained in the real printing task. Therefore, according to this embodiment, by comparing the value indicated by the vibration information SJh[m][TP(k)] with a predetermined reference value, for example, it is possible to inspect the state of ejection of the ink from the ejecting portion Dh[m][TP(k)] accurately based on the vibration information SJt[m][TP(k)] obtained by actual printing in a similar surrounding environment and with similar ejecting characteristics to those at the time of printing in the real printing task even when the surrounding environment of the ink jet printer 1 such as a temperature and a humidity of the environment where the ink jet printer 1 is present is changed and when the ink jet printer 1 is degraded with age and the ejection characteristic of the ink from the ejecting portion D is changed over time in comparison with the aspect of inspecting the state of ejection of the ink from the ejecting portion Dh[m][TP(k)]. As a consequence, according to this embodiment, it is possible to form the image GZh having the good print quality in the real printing task as compared to the aspect of inspecting the state of ejection of the ink from the ejecting portion Dh[m][TP(k)] by comparing the value indicated by the vibration information SJh[m][TP(k)] with the predetermined reference value, for example.

Moreover, in this embodiment, the state of ejection of the ink from the ejecting portion Dh[m][TP(k)] can be inspected while carrying out the real printing task. Accordingly, productivity is improved since it is not necessary to suspend the printing job for inspecting the state of ejection of the ink from the ejecting portion Dh[m][TP(k)].

Meanwhile, a meniscus inside the nozzle is repeatedly vibrated by the actions to eject the ink from the nozzle. Accordingly, even when the state of ejection of the ink from the ejecting portion Dh[m][TP(k)] causes an abnormality during the real printing task, the state of ejection may be recovered thereafter as a consequence of continuing the real printing task and keeping the meniscus in the nozzle vibrated. In this case, the mere inspection of the state of ejection of the ink from the ejecting portion D during the real printing tasks and during the printing jobs may not be able to detect an abnormality of the state of ejection if an abnormality in print quality actually occurs during the real printing tasks but is recovered later. In this embodiment, however, the state of ejection of the ink from the ejecting portion Dh[m][TP(k)] can be inspected while carrying out the real printing task, and a printing failure can be directly detected in the course of the real printing task. Thus, it is possible to detect an abnormality in quality of the image GZh more accurately.

Next, the printing signal generation process in step S11 of the flowchart shown in FIG. 10 will be described.

Figure 11:
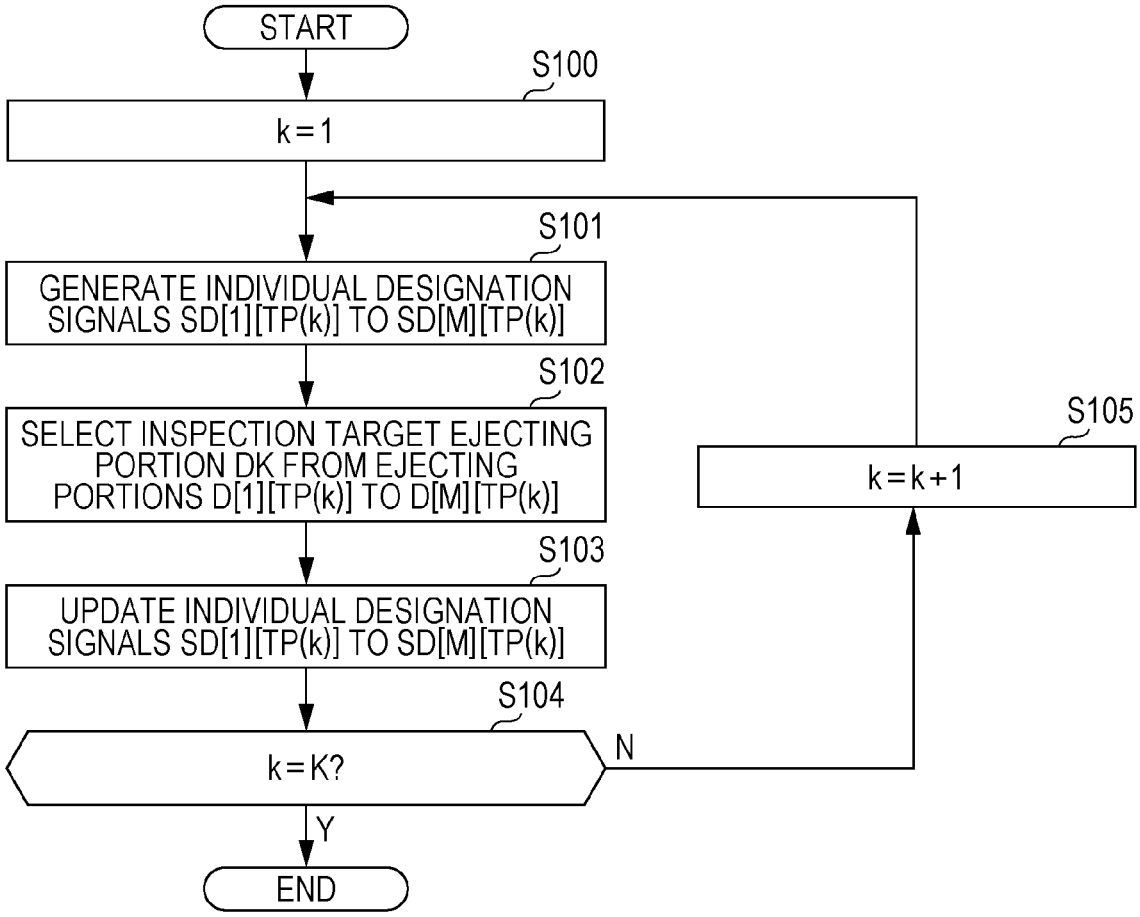
FIG. 11 is a flowchart for explaining an example of an operation of the ink jet printer 1.

FIG. 11 is a flowchart showing an example of an operation of the ink jet printer 1 when the printing signal generation process is executed.

As exemplarily shown in FIG. 11, in the printing signal generation process, the print control unit 21 sets a variable k to "1" to begin with (S100).

Next, the print control unit 21 generates the individual designation signals SD[1][TP(k)] to SD[M][TP(k)] based on the image information Img (S101). Here, in step S101, the print control unit 21 generates the individual designation signal SD[m][TP(k)] in such a way as to instruct the ejecting portion D[m][TP(k)] to be driven as the non-inspection target ejecting portion DP.

Next, the inspection target selection unit 24 selects the inspection target ejecting portion DK out of the ejecting portions D[1][TP(k)] to D[M][TP(k)] (S102). In this embodiment, the inspection target selection unit 24 selects the inspection target ejecting portion DK at random out of the ejecting portions D[1][TP(k)] to D[M][TP(k)] in step S102. Nonetheless, the inspection target selection unit 24 may select the inspection target ejecting portion DK out of the ejecting portions D[1][TP(k)] to D[M][TP(k)] according to a prescribed rule in step S102.

Thereafter, the print control unit 21 updates the individual designation signals SD[1][TP(k)] to SD[M][TP(k)] generated in step S101 so as to reflect a result of selection of the inspection target ejecting portion DK in step S102 (S103).

Specifically, when the individual designation signal SD[m][TP(k)] generated in step S101 indicates the value to instruct the drive as the non-inspection target ejecting portion DPq in step S103 and when the ejecting portion D[m][TP(k)] is selected as the inspection target ejecting portion DK in step S102, the print control unit 21 updates the individual designation signals SD[1][TP(k)] to SD[M][TP(k)] by changing the individual designation signal SD[m][TP(k)] corresponding to the ejecting portion D[m][TP(k)] from the value to instruct the drive as the non-inspection target ejecting portion DPq to the value to instruct the drive as the inspection target ejecting portion DKq.

To be more precise, when the individual designation signal SD[m][TP(k)] generated in step S101 indicates the value to instruct the drive as the large dot forming ejecting portion DP1 in step S103 and when the ejecting portion D[m][TP(k)] is selected as the inspection target ejecting portion DK in step S102, the print control unit 21 changes the individual designation signal SD[m][TP(k)] to the value to instruct the drive as the large dot forming inspection target ejecting portion DK1. Meanwhile, when the individual designation signal SD[m][TP(k)] generated in step S101 indicates the value to instruct the drive as the medium dot forming ejecting portion DP2 in step S103 and when the ejecting portion D[m][TP(k)] is selected as the inspection target ejecting portion DK in step S102, the print control unit 21 changes the individual designation signal SD[m][TP(k)] to the value to instruct the drive as the medium dot forming inspection target ejecting portion DK2. In the meantime, when the individual designation signal SD[m][TP(k)] generated in step S101 indicates the value to instruct the drive as the small dot forming ejecting portion DP3 in step S103 and when the ejecting portion D[m][TP(k)] is selected as the inspection target ejecting portion DK in step S102, the print control unit 21 changes the individual designation signal SD[m][TP(k)] to the value to instruct the drive as the small dot forming inspection target ejecting portion DK3. Meanwhile, when the individual designation signal SD[m][TP(k)] generated in step S101 indicates the value to instruct the drive as the fine dot forming ejecting portion DP4 in step S103 and when the ejecting portion D[m][TP(k)] is selected as the inspection target ejecting portion DK in step S102, the print control unit 21 changes the individual designation signal SD[m][TP(k)] to the value to instruct the drive as the fine dot forming inspection target ejecting portion DK4. In the meantime, when the individual designation signal SD[m][TP(k)] generated in step S101 indicates the value to instruct the drive as the non-dot forming ejecting portion DP5 in step S103 and when the ejecting portion D[m][TP(k)] is selected as the inspection target ejecting portion DK in step S102, the print control unit 21 changes the individual designation signal SD[m][TP(k)] to the value to instruct the drive as the non-dot forming inspection target ejecting portion DK5.

Next, the print control unit 21 determines whether or not the variable k satisfies "k=K" (S104).

When a result of determination in step S104 is negative, the print control unit 21 adds "1" to the variable k (S105) and then proceeds to the process in step S101.

When the result of determination in step S104 is affirmative, the print control unit 21 terminates the printing signal generation process exemplarily shown in FIG. 11.

In this embodiment, the image GZt represents an example of a "first printed image". The image GZh represents an example of a "second printed image". The unit periods TPt(1) to TPt(K) in which the test printing task for forming the image GZt is executed represent an example of a "first period". The unit periods TPh(1) to TPh(K) in which the real printing task for forming the image GZh is executed represent an example of a "second period". In the unit period TPt(k), the control period TQ3 to detect the detected potential signal Vout[m] from the ejecting portion Dt[m][TP(k)] represents an example of a "first detection period". In the unit period TPh(k), the control period TQ3 to detect the detected potential signal Vout[m] from the ejecting portion Dh[m][TP(k)] represents an example of a "second detection period". The vibration information SJt[m][TP(k)] based on the residual vibration signal VDt[m][TP(k)] detected from the ejecting portion Dt[m][TP(k)] represents an example of "first vibration information". The vibration information SJh[m][TP(k)] based on the residual vibration signal VDh[m][TP(k)] detected from the ejecting portion Dh[m][TP(k)] represents an example of "second vibration information". In the unit period TPt(k), the control period TQ1 and the control period TQ2 that precede the control period TQ3 represent an example of a "first driving period". In the unit period TPh(k), the control period TQ1 and the control period TQ2 that precede the control period TQ3 represent an example of a "second driving period". Of the waveform PX, the waveform PY, the waveform PM, and the waveform PK provided to the driving signal Com-A and the driving signal Com-B, the waveform provided to the supplied driving signal Vin[m] supplied to the ejecting portion D[m] in the unit period TPt(k) and the unit period TPh(k) represents an example of a "first waveform".

Meanwhile, in this embodiment, the control unit 2 executes the test printing task in step S12 after generating the individual designation signals SD[1][TP(k)] to SD[M][TP(k)] corresponding to the K pieces of the unit periods TP of the unit periods TP(1) to TP(K) in the printing signal generation process in step S11. However, the present disclosure is not limited only to this aspect. For example, the control unit 2 may execute a printing process concerning the unit period TP(k) corresponding to the individual designation signals SD[1][TP(k)] to SD[M][TP(k)] out of the printing task in step S12 every time the individual designation signals SD[1][TP(k)] to SD[M][TP(k)] corresponding to one unit period TP(k) are generated.

1.4 Summary of First Embodiment

As described above, the ink jet printer 1 according to this embodiment includes the ejecting portions D[1] to D[M] that are driven by the driving signal Com and configured to eject the inks. The ink jet printer 1 is configured to form the image GZ on the print sheet P by using the inks ejected from the ejecting portions D[1] to D[M]. Here, the ink jet printer 1 includes the vibration information acquisition unit 22 that acquires the vibration information SJt[m][TP(k)] concerning the vibration generated in the control period TQ3 included in the unit period TPt(k) out of the unit periods TPt(1) to TPt(K) being periods in which the test printing task to cause the ink jet printer 1 to form the image GZt on the print sheet P regarding the ejecting portion D[m] selected as the inspection target ejecting portion DK out of the ejecting portions D[1] to D[M], and acquires the vibration information SJh[m][TP(k)] concerning the vibration generated in the control period TQ3 included in the unit period TPh(k) out of the unit periods TPh(1) to TPh(K) that starts after completion of printing of the image GZ on the print sheet P in the unit periods TPt(1) to TPt(K), the unit periods TPh(1) to TPh(K) being periods in which the real printing task to cause the ink jet printer 1 to form the image GZh related to the image GZt on the print sheet P regarding the ejecting portion D[m] selected as the inspection target ejecting portion DK out of the ejecting portions D[1] to D[M]. The ink jet printer 1 also includes the ejection state inspection unit 25 that inspects the state of ejection of the ink from the ejecting portion D[m] based on the vibration information SJt[m][TP(k)] and the vibration information SJh[m][TP(k)].

Specifically, according to this embodiment, the state of ejection of the ink from the ejecting portion D[m] is inspected based on the vibration information SJt[m][TP(k)] obtained in the test printing task and the vibration information SJh[m][TP(k)] obtained in the real printing task. Therefore, according to this embodiment, by comparing the value indicated by the vibration information SJh[m][TP(k)] with the predetermined reference value, for example, it is possible to inspect the state of ejection of the ink from the ejecting portion D[m] accurately even when the surrounding environment of the ink jet printer 1 such as a temperature and a humidity of the environment where the ink jet printer 1 is present is changed and when the ink jet printer 1 is degraded with age and the ejection characteristic of the ink from the ejecting portion D[m] is changed over time in comparison with the aspect of inspecting the state of ejection of the ink from the ejecting portion D[m]. As a consequence, according to this embodiment, it is possible to form the image GZh having the good print quality in the real printing task as compared to the aspect of inspecting the state of ejection of the ink from the ejecting portion D[m] by comparing the value indicated by the vibration information SJh[m][TP(k)] with the predetermined reference value, for example.

Meanwhile, the ink jet printer 1 according to this embodiment may include the notification unit 62 that notifies of the result of inspection by the ejection state inspection unit 25 when the result of inspection indicates that the state of ejection of the ink from the ejecting portion D[m] selected as the inspection target ejecting portion DK is abnormal.

For this reason, according to this embodiment, the user of the printing system Sys can recognize the abnormality in ejection promptly when the state of ejection of the ink from the ejecting portion D[m] is abnormal. As a consequence, according to this embodiment, it is possible to prevent the real printing task to form the image GZh in low print quality from being continued in the printing job.

Meanwhile, in the ink jet printer 1 according to this embodiment, the ejecting portion D[m] selected as the inspection target ejecting portion DK may be driven in the control period TQ1 and the control period TQ2 that precede the control period TQ3 included in the unit period TPt(k) out of the unit periods TPt(1) to TPt(K) by the supplied driving signal Vin[m] that has any of one or both of the waveform PX and the waveform PY, the waveform PM, and the waveform PK, and may be driven in the control period TQ1 and the control period TQ2 that precede the control period TQ3 included in the unit period TPh(k) out of the unit periods TPh(1) to TPh(K) by the supplied driving signal Vin[m] that has any of the aforementioned waveforms.

For this reason, according to this embodiment, if the state of ejection of the ink from the ejecting portion D[m] is normal in both of the unit period TPt(k) in the test printing task and the unit period TPh(k) in the real printing task, then it is possible to set the waveform of the detected potential signal Vout[m] detected from the ejecting portion D[m] in the unit period TPt(k) substantially equal to the waveform of the detected potential signal Vout[m] detected from the ejecting portion D[m] in the unit period TPh(k). As a consequence, according to this embodiment, it is possible to inspect the state of ejection of the ink from the ejecting portion D[m] based on a degree of difference between the vibration information SJt[m][TP(k)] obtained in the test printing task and the vibration information SJh[m][TP(k)] obtained in the real printing task.

2. Second Embodiment

A second embodiment of the present disclosure will be described below. In the respective modes exemplified below, constituents having the same workings and functions as those in the first embodiment will be denoted by the corresponding reference signs used in the description of the first embodiment and detailed explanations thereof will be omitted as appropriate.

2.1 Outline of Printing System

An outline of the printing system Sys according to the second embodiment will be described below with reference to FIGS. 12 to 14.

Figure 12:
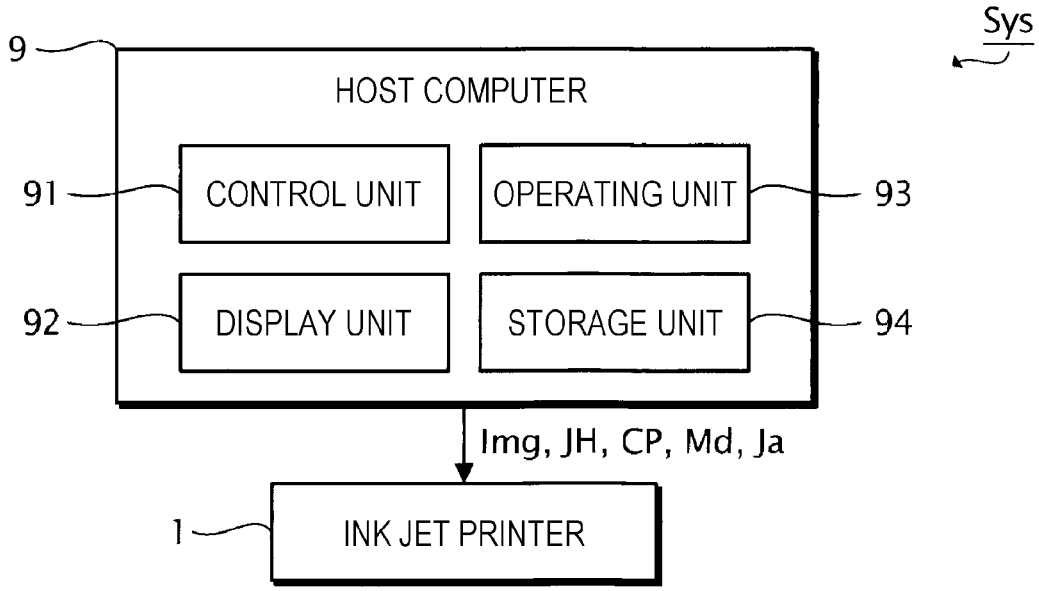
FIG. 12 is a block diagram showing an example of a configuration of a printing system Sys according to a second embodiment of the present disclosure.

FIG. 12 is a functional block diagram showing an example of a configuration of the printing system Sys according to this embodiment.

As exemplarily shown in FIG. 12, the printing system Sys of this embodiment is different from the printing system Sys according to the first embodiment in that inspection mode information Md is supplied from the host computer 9 to the ink jet printer 1.

Here, the inspection mode information Md is information indicating an inspection mode concerning an aspect of selection of the inspection target ejecting portion DK serving as a target for the ejecting state inspection process. This embodiment assumes a case where the ink jet printer 1 can select the inspection target ejecting portion DK by using multiple types of inspection modes. Specifically, as an example, this embodiment assumes a case where the ink jet printer 1 can select the inspection target ejecting portion DK by using five types of inspection modes, namely, a continuous ejection inspection mode, a continuous non-ejection inspection mode, an adjacent ejection inspection mode, an adjacent non-ejection inspection mode, and a random inspection mode. Details of the respective inspection modes will be described later.

In this embodiment, the control unit 91 causes the display unit 92 to display an inspection mode selection screen G1 for allowing the user of the printing system Sys to select one inspection mode out of the five types of the inspection modes. The user of the printing system Sys selects one inspection mode out of the five types of the inspection modes on the inspection mode selection screen G1 by operating the operating unit 93. The control unit 91 creates the inspection mode information Md that indicates a result of selection of the inspection mode on the inspection mode selection screen G1 by the user of the printing system Sys.

Figure 13:
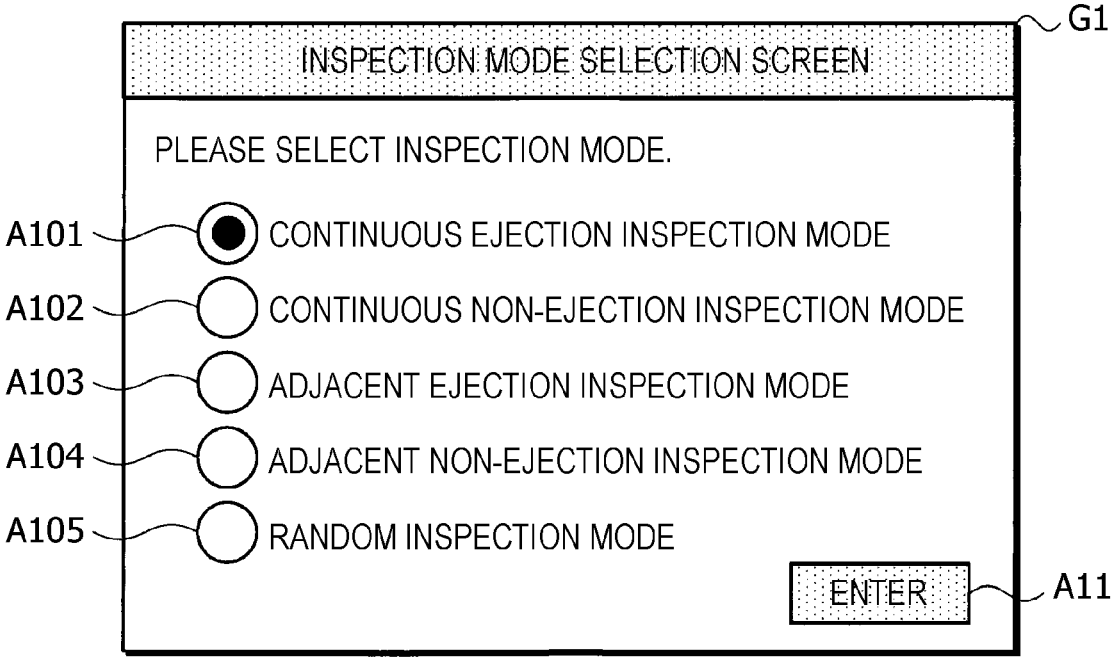
FIG. 13 is an explanatory diagram for explaining an example of an inspection mode selection screen G1.

FIG. 13 is an explanatory diagram for explaining an example of the inspection mode selection screen G1.

As exemplarily shown in FIG. 13, the inspection mode selection screen G1 is provided with five selection images A101 to A105 corresponding one-to-one to the five types of the inspection modes that can be executed by the ink jet printer 1. The user of the printing system Sys operates the operating unit 93, thus selecting one selection image out of the five selection images A101 to A105. Then, the user selects one inspection mode out of the five types of the inspection modes by pressing an enter button A11. In this case, the control unit 91 creates the inspection mode information Md that indicates the one inspection mode selected by the user of the printing system Sys.

Moreover, as exemplarily shown in FIG. 12, the printing system Sys of this embodiment is different from the printing system Sys according to the first embodiment in that inspection range information Ja is supplied from the host computer 9 to the ink jet printer 1.

Here, the inspection range information Ja is information that indicates an intensive inspection area Ar which is an area in the image GZ formed in the real printing task to be intensively inspected in the ejecting state inspection process.

In this embodiment, the control unit 91 causes the display unit 92 to display an intensive inspection area selection screen G2 for allowing the user of the printing system Sys to designate the intensive inspection area Ar in the image GZ. The user of the printing system Sys selects the intensive inspection area Ar in the image GZ on the intensive inspection area selection screen G2 by operating the operating unit 93.

Figure 14:
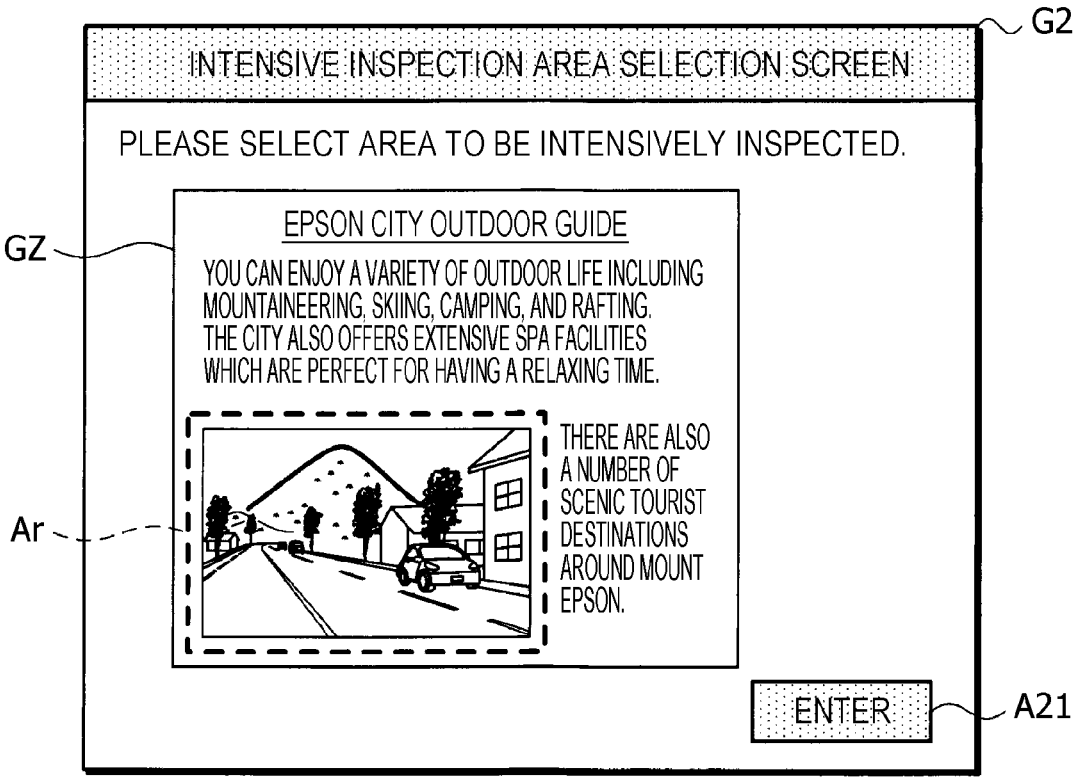
FIG. 14 is an explanatory diagram for explaining an example of an intensive inspection area selection screen G2.

FIG. 14 is an explanatory diagram for explaining an example of the intensive inspection area selection screen G2.

As exemplarily shown in FIG. 14, the image GZ based on the image information Img is displayed on the intensive inspection area selection screen G2. The user of the printing system Sys operates the operating unit 93, thus designating a range of the intensive inspection area Ar in the image GZ. Then, the user selects the intensive inspection area Ar in the image GZ by pressing an enter button A21. In this case, the control unit 91 creates the inspection range information Ja that indicates the intensive inspection area Ar selected by the user of the printing system Sys.

2.2 Operation of Ink Jet Printer

An operation of the ink jet printer 1 according to this embodiment will be described below with reference to FIGS. 15 and 16.

Figure 15:
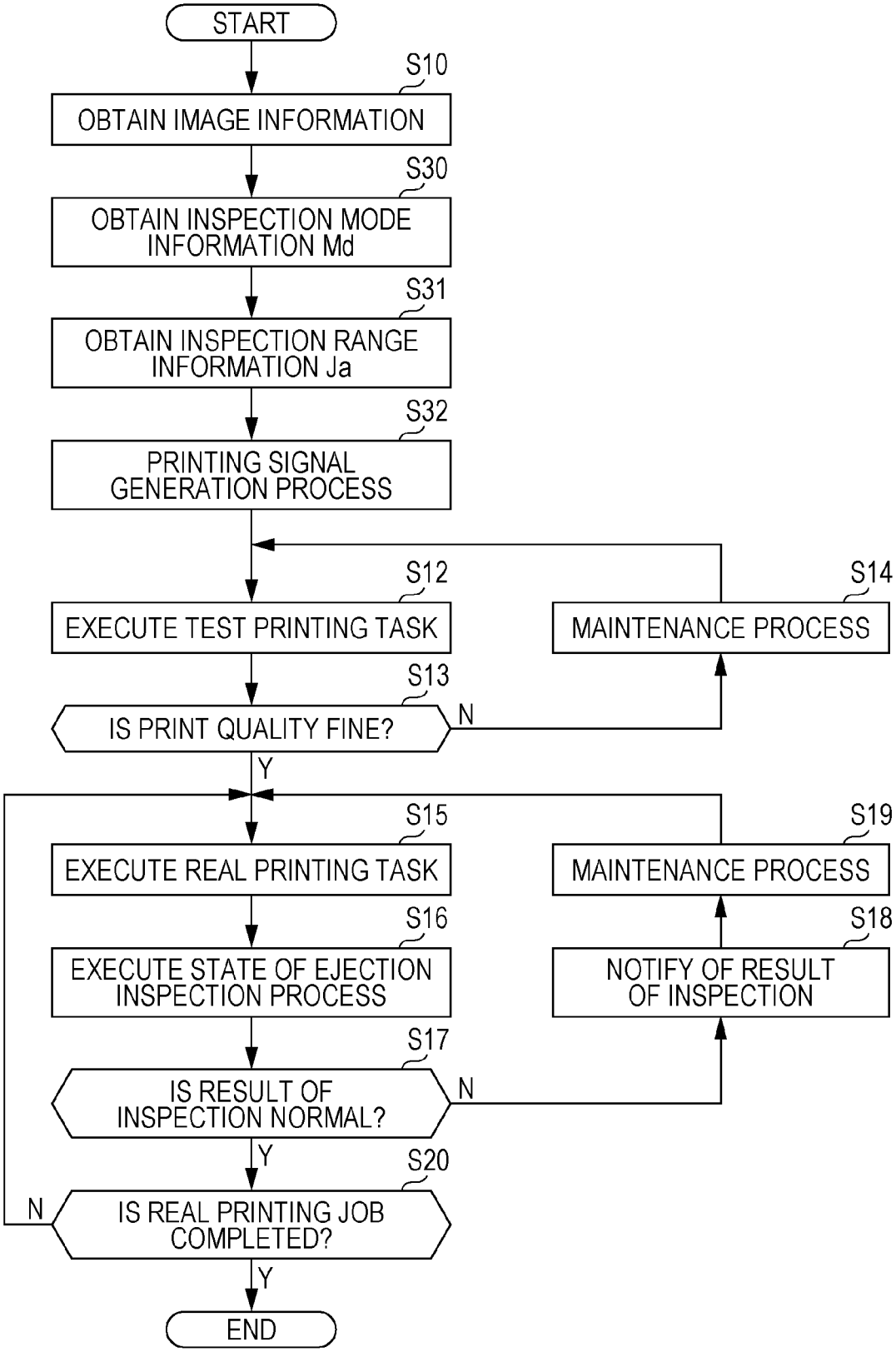
FIG. 15 is a flowchart for explaining an example of an operation of the ink jet printer 1.

FIG. 15 is a flowchart showing an example of an operation of the ink jet printer 1 when the ink jet printer 1 executes the printing job.

As exemplarily shown in FIG. 15, when the ink jet printer 1 according to this embodiment executes the printing job, the host information acceptance unit 23 of the control unit 2 obtains the image information Img and the number-of-copies information CP from the host computer 9 as with the first embodiment (S10).

Moreover, the host information acceptance unit 23 of the control unit 2 obtains the inspection mode information Md from the host computer 9 (S30).

Furthermore, the host information acceptance unit 23 of the control unit 2 obtains the inspection range information Ja from the host computer 9 (S31).

Then, the control unit 2 executes the printing signal generation process (S32).

Thereafter, the control unit 2 executes the processes in steps S12 to S20 explained in the first embodiment.

Figure 16:
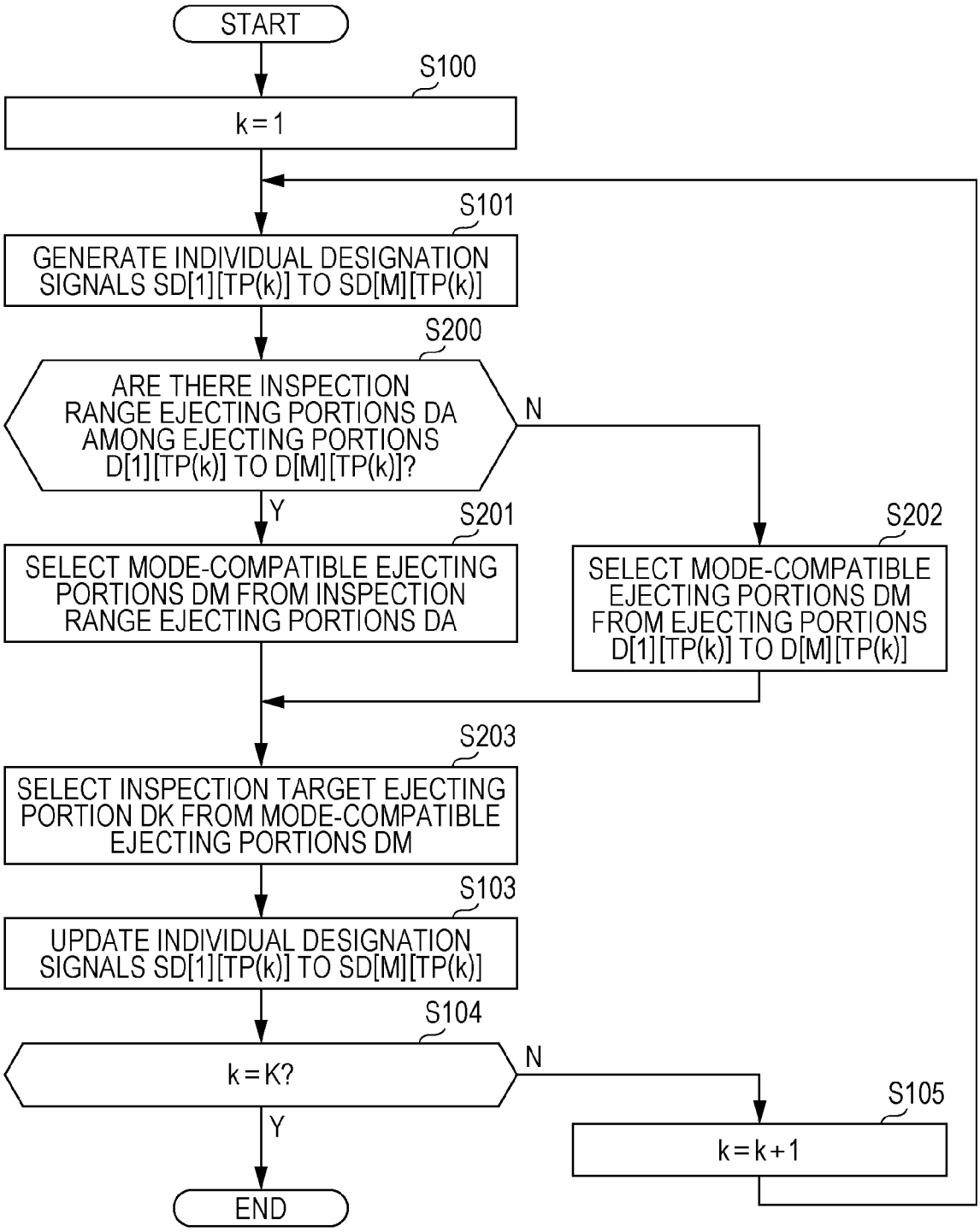
FIG. 16 is a flowchart for explaining an example of an operation of the ink jet printer 1.

FIG. 16 is a flowchart showing an example of an operation of the ink jet printer 1 according to this embodiment when the ink jet printer 1 executes the printing signal generation process.

As exemplarily shown in FIG. 16, in the printing signal generation process of this embodiment, the print control unit 21 executes the processes in steps S100 and S101 as with the first embodiment.

Next, the inspection target selection unit 24 determines whether or not there are inspection range ejecting portions DA in the ejecting portions D[1][TP(k)] to D[M][TP(k)] (S200). Here, the inspection range ejecting portion DA is the ejecting portion D that forms a dot included in the intensive inspection area Ar indicated by the inspection range information Ja in the image GZ.

In this embodiment, the inspection target selection unit 24 may determine in step S200 whether or not the dot formed by the ejecting portion D[m][TP(k)] is included in the intensive inspection area Ar in the image GZ. However, the present disclosure is not limited only this aspect. For example, the inspection target selection unit 24 may specify the inspection range ejecting portions DA that form the dots included in the intensive inspection area Ar before carrying out the process in step S200 by obtaining combinations of the unit periods TP(k) and the number m in the ejecting portions D[m] involved in the formation of the dots located in the intensive inspection area Ar out of combinations of the unit periods TP(1) to TP(K) that represent the periods in which the printing task is executed and the ejecting portions D[1] to D[M].

When a result of determination in step S200 is affirmative, the inspection target selection unit 24 selects mode-compatible ejecting portions DM out of the inspection range ejecting portions DA existing in the ejecting portions D[1][TP(k)] to D[M][TP(k)] based on the inspection mode information Md (S201). The mode-compatible ejecting portion DM is the ejecting portion D selectable as the inspection target ejecting portion DK in the inspection mode indicated by the inspection mode information Md. Details of the mode-compatible ejecting portion DM will be described later.

When the result of determination in step S200 is negative, the inspection target selection unit 24 selects the mode-compatible ejecting portions DM out of the ejecting portions D[1][TP(k)] to D[M][TP(k)] based on the inspection mode information Md (S202).

Then, the inspection target selection unit 24 selects the inspection target ejecting portion DK out of the mode-compatible ejecting portions DM selected in step S201 or S202 (S203).

Thereafter, the print control unit 21 executes the processes in steps S103 to S105 as with the first embodiment.

2.3 Outlines of Inspection Modes

The mode-compatible ejecting portions DM in the respective inspection modes will be described below with reference to FIGS. 17 to 21.

Figure 17:
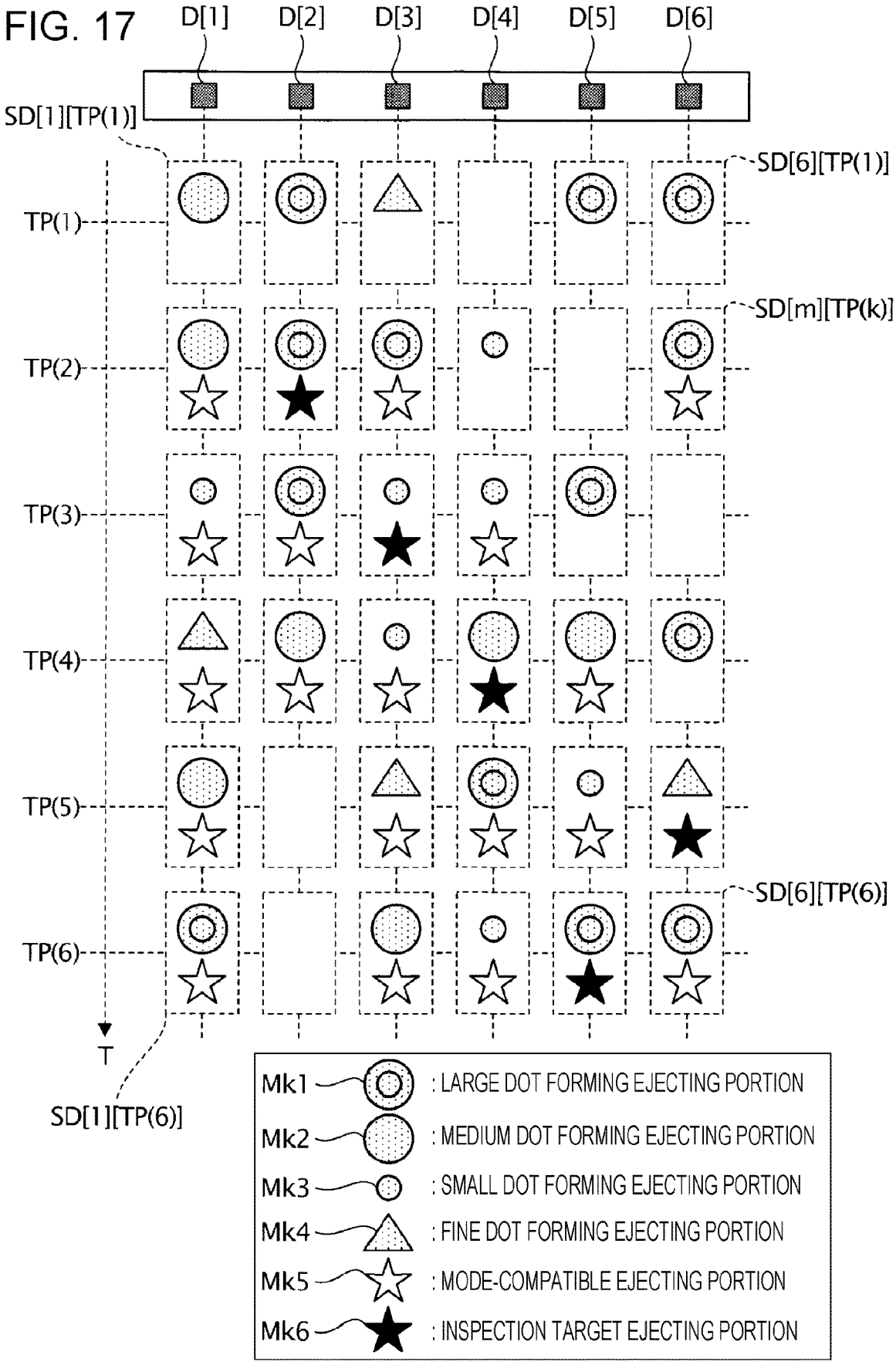
FIG. 17 is an explanatory diagram for explaining an example of a continuous ejection inspection mode.
Figure 18:
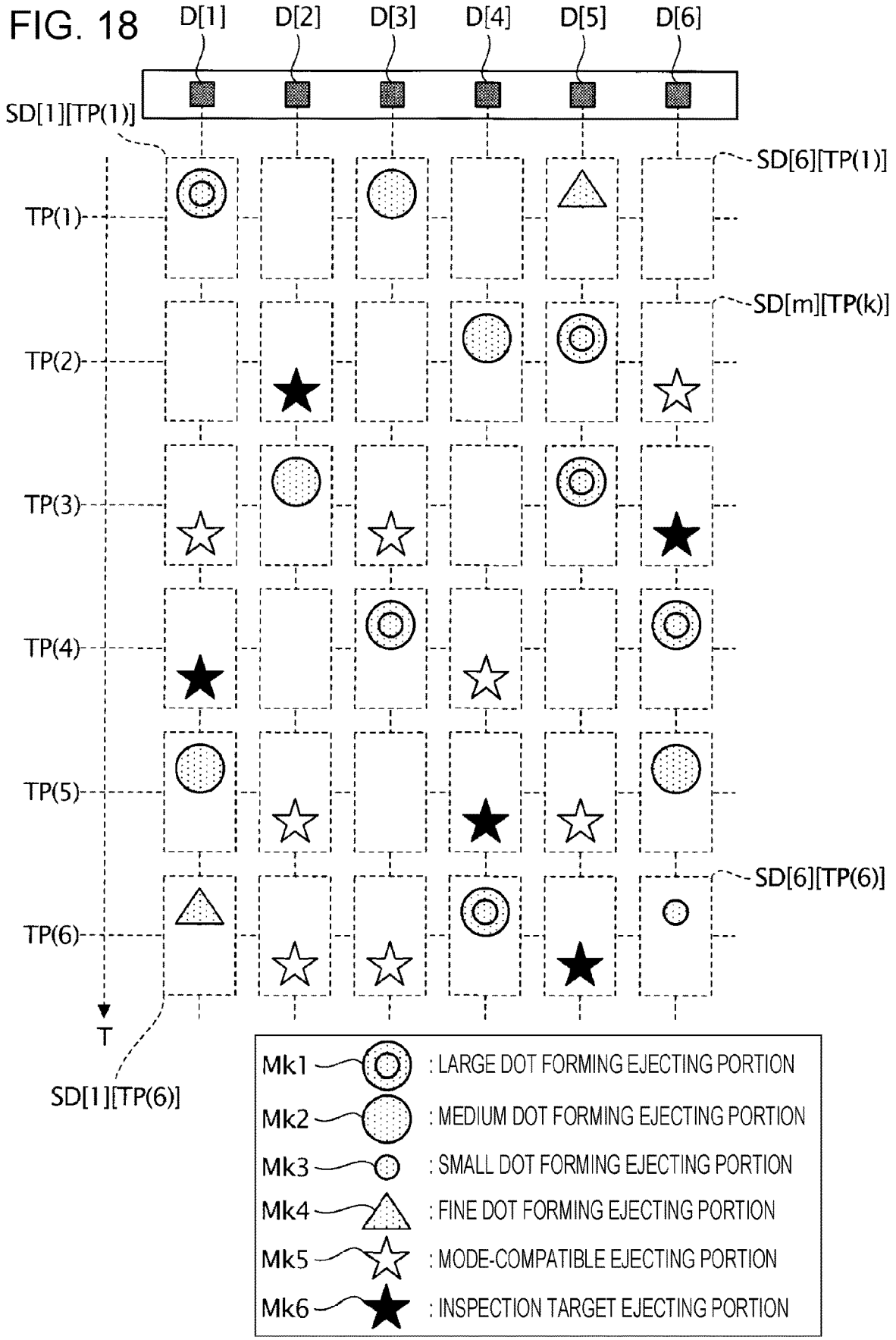
FIG. 18 is an explanatory diagram for explaining an example of a continuous non-ejection inspection mode.
Figure 19:
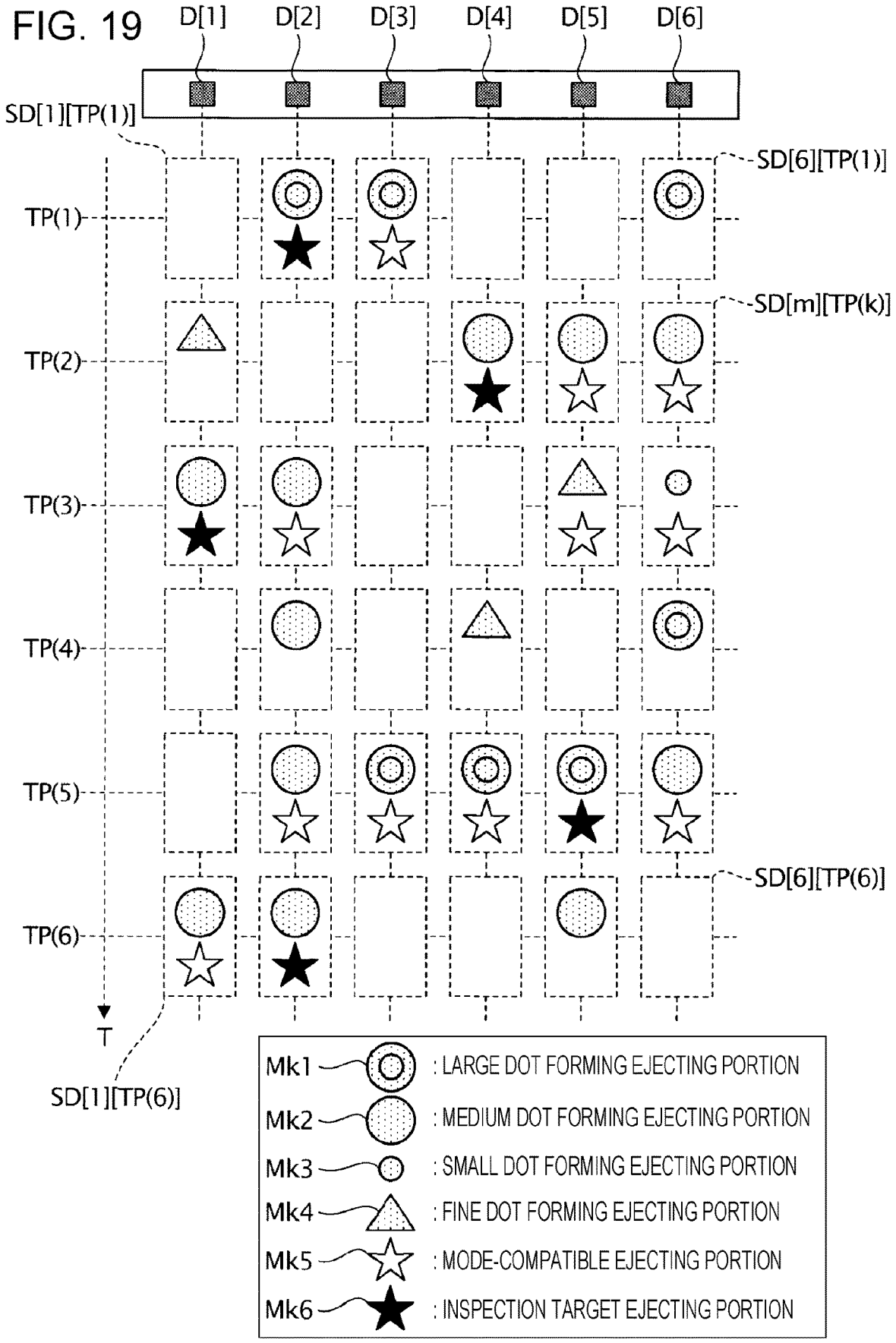
FIG. 19 is an explanatory diagram for explaining an example of an adjacent ejection inspection mode.
Figure 20:
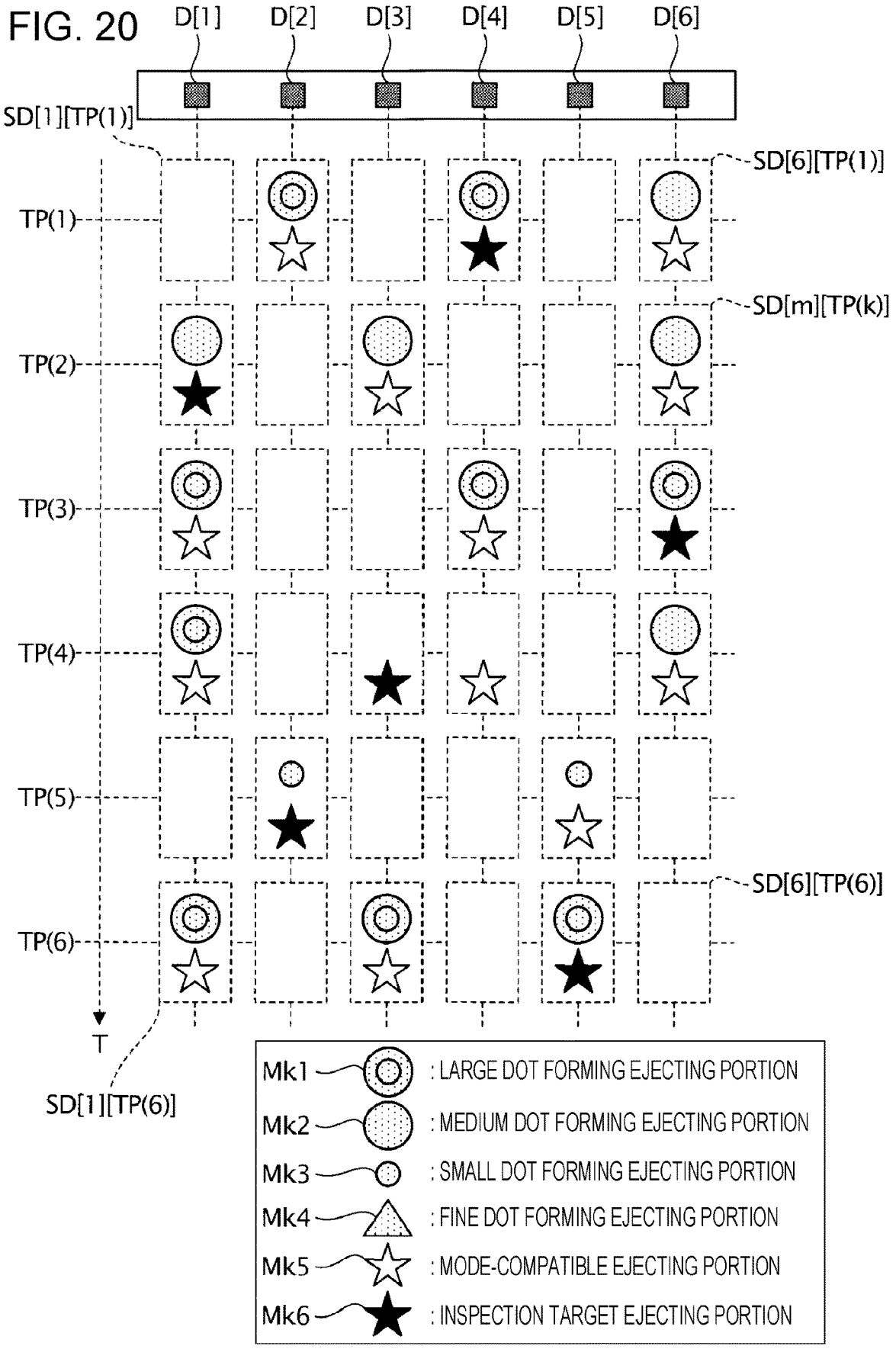
FIG. 20 is an explanatory diagram for explaining an example of an adjacent non-ejection inspection mode.
Figure 21:
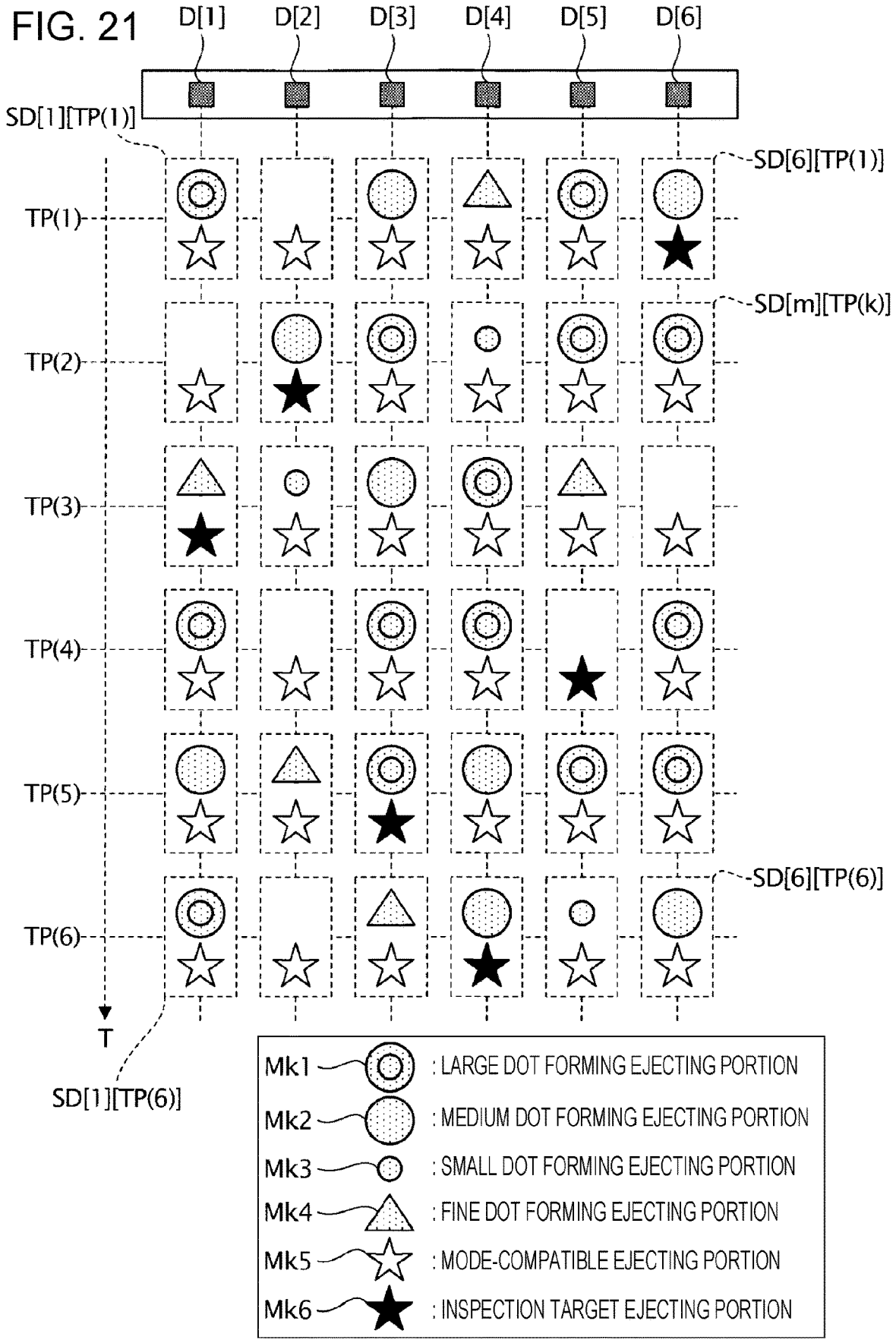
FIG. 21 is an explanatory diagram for explaining an example of a random inspection mode.

FIG. 17 is an explanatory diagram for explaining an example of a relation between the individual designation signal SD[m][TP(k)] and the mode-compatible ejecting portion DM in the continuous ejection inspection mode. FIG. 18 is an explanatory diagram for explaining an example of a relation between the individual designation signal SD[m][TP(k)] and the mode-compatible ejecting portion DM in the continuous non-ejection inspection mode. FIG. 19 is an explanatory diagram for explaining an example of a relation between the individual designation signal SD[m][TP(k)] and the mode-compatible ejecting portion DM in the adjacent ejection inspection mode. FIG. 20 is an explanatory diagram for explaining an example of a relation between the individual designation signal SD[m][TP(k)] and the mode-compatible ejecting portion DM in the adjacent non-ejection inspection mode. FIG. 21 is an explanatory diagram for explaining an example of a relation between the individual designation signal SD[m][TP(k)] and the mode-compatible ejecting portion DM in the random inspection mode.

The examples shown in FIGS. 17 to 21 assume a case where the value K is set to "6", or in other words, the case where the printing task is executed in unit periods TP(1) to TP(6). Moreover, the examples shown in FIGS. 17 to 21 assume the case where the value M is set to "6", or in other words, the case where the head unit 3 includes the ejecting portions D[1] to D[6]. Furthermore, the examples shown in FIGS. 17 to 21 assume the case where the intensive inspection area Ar is the entire image GZ, or in other words, all of the ejecting portions D[1][TP(k)] to D[M][TP(k)] are the inspection range ejecting portions DA throughout the unit periods TP(1) to TP(6).

Meanwhile, in the examples shown in FIGS. 17 to 21, a mark MU of a double circle, a mark Mk2 of a large single circle, a mark Mk3 of a small single circle, a mark Mk4 of a triangle, a mark Mk5 of a white star, and a mark Mk6 of a black star are marks that indicate the aspects of the drive of the ejecting portion D[m][TP(k)] designated by the individual designation signal SD[m][TP(k)], or the types of the ejecting portion D[m][TP(k)].

Specifically, in the examples shown in FIGS. 17 to 21, when the mark Mk5 is attached to the individual designation signal SD[m][TP(k)], this case means that the ejecting portion D[m][TP(k)] corresponding to the individual designation signal SD[m][TP(k)] is the mode-compatible ejecting portion DM. Meanwhile, when the mark Mk6 is attached to the individual designation signal SD[m][TP(k)], this case means that the individual designation signal SD[m][TP(k)] instructs the ejecting portion D[m][TP(k)] to be driven as the inspection target ejecting portion DK.

In the meantime, in the examples shown in FIGS. 17 to 21, when the mark Mk1 is attached to the individual designation signal SD[m][TP(k)] and the mark Mk6 is not attached to the individual designation signal SD[m][TP(k)], this case means that the individual designation signal SD[m][TP(k)] instructs the ejecting portion D[m][TP(k)] to be driven as the large dot forming ejecting portion DP1. Meanwhile, when the mark Mk2 is attached to the individual designation signal SD[m][TP(k)] and the mark Mk6 is not attached to the individual designation signal SD[m][TP(k)], this case means that the individual designation signal SD[m][TP(k)] instructs the ejecting portion D[m][TP(k)] to be driven as the medium dot forming ejecting portion DP2. In the meantime, when the mark Mk3 is attached to the individual designation signal SD[m][TP(k)] and the mark Mk6 is not attached to the individual designation signal SD[m][TP(k)], this case means that the individual designation signal SD[m][TP(k)] instructs the ejecting portion D[m][TP(k)] to be driven as the small dot forming ejecting portion DP3. Meanwhile, when the mark Mk4 is attached to the individual designation signal SD[m][TP(k)] and the mark Mk6 is not attached to the individual designation signal SD[m][TP(k)], this case means that the individual designation signal SD[m][TP(k)] instructs the ejecting portion D[m][TP(k)] to be driven as the fine dot forming ejecting portion DP4. In the meantime, when none of the marks Mk1 to Mk4 is attached to the individual designation signal SD[m][TP(k)] and the mark Mk6 is not attached to the individual designation signal SD[m][TP(k)], this case means that the individual designation signal SD[m][TP(k)] instructs the ejecting portion D[m][TP(k)] to be driven as the non-dot forming ejecting portion DP5.

On the other hand, in the examples shown in FIGS. 17 to 21, when the mark Mk1 is attached to the individual designation signal SD[m][TP(k)] and the mark Mk6 is attached to the individual designation signal SD[m][TP(k)], this case means that the individual designation signal SD[m][TP(k)] instructs the ejecting portion D[m][TP(k)] to be driven as the large dot forming inspection target ejecting portion DK1. Meanwhile, when the mark Mk2 is attached to the individual designation signal SD[m][TP(k)] and the mark Mk6 is attached to the individual designation signal SD[m][TP(k)], this case means that the individual designation signal SD[m][TP(k)] instructs the ejecting portion D[m][TP(k)] to be driven as the medium dot forming inspection target ejecting portion DK2. In the meantime, when the mark Mk3 is attached to the individual designation signal SD[m][TP(k)] and the mark Mk6 is attached to the individual designation signal SD[m][TP(k)], this case means that the individual designation signal SD[m][TP(k)] instructs the ejecting portion D[m][TP(k)] to be driven as the small dot forming inspection target ejecting portion DK3. Meanwhile, when the mark Mk4 is attached to the individual designation signal SD[m][TP(k)] and the mark Mk6 is attached to the individual designation signal SD[m][TP(k)], this case means that the individual designation signal SD[m][TP(k)] instructs the ejecting portion D[m][TP(k)] to be driven as the fine dot forming inspection target ejecting portion DK4. In the meantime, when none of the marks Mk1 to Mk4 is attached to the individual designation signal SD[m][TP(k)] and the mark Mk6 is attached to the individual designation signal SD[m][TP(k)], this case means that the individual designation signal SD[m][TP(k)] instructs the ejecting portion D[m][TP(k)] to be driven as the non-dot forming inspection target ejecting portion DK5.

In the continuous ejection inspection mode, the inspection target selection unit 24 selects a continuous ejection inspection mode-compatible ejecting portion DM1 as the mode-compatible ejecting portion DM. Here, the continuous ejection inspection mode-compatible ejecting portion DM1 is the ejecting portion D that continuously ejects the ink during multiple continuous unit periods TP. In this embodiment, when the ejecting portion D[m][TP(k−1)] corresponds neither to the non-dot forming ejecting portion DP5 nor to the non-dot forming inspection target ejecting portion DK5 and the ejecting portion D[m][TP(k)] corresponds neither to the non-dot forming ejecting portion DP5 nor to the non-dot forming inspection target ejecting portion DK5 in the continuous ejection inspection mode as exemplarily shown in FIG. 17, the inspection target selection unit 24 specifies the ejecting portion D[m][TP(k)] as the continuous ejection inspection mode-compatible ejecting portion DM1.

In general, when the ink is continuously ejected from the ejecting portion D, it is more likely that a bubble be trapped into the cavity 322 of the ejecting portion D. Moreover, in general, when the ink is continuously ejected from the ejecting portion D, it is more likely that a foreign matter such as paper powder adhere to the neighborhood of the nozzle N of the ejecting portion D. Furthermore, in general, when the ink is continuously ejected from the ejecting portion D, vibration of the meniscus constituting an interface of the ink inside the nozzle N of the ejecting portion D is prone to be unstable. Hence, a flying direction and a flying speed of a droplet ejected from the nozzle N may be different from supposed features, and the print quality may be temporarily deteriorated as a consequence. Such unstableness of the vibration of the meniscus inside the nozzle may be recovered in the course of a subsequent printing operation. In that case, however, no ejection abnormalities are detected when inspecting the state of ejection of the ink from the ejecting portion D between the printing tasks or between the printing jobs. As a consequence, it is not possible to detect an actual abnormality on a printed material. On the other hand, according to this embodiment, the ejecting state inspection process can be executed in the continuous ejection inspection mode. Thus, it is possible to promptly discover an ejection abnormality attributed to the bubble trapped in the ejecting portion D and an ejection abnormality attributed to adhesion of a foreign matter to the ejecting portion D, and to discover a deterioration in print quality due to the ejection abnormality attributable to the unstable meniscus inside the nozzle N in the course of printing.

In the continuous non-ejection inspection mode, the inspection target selection unit 24 selects a continuous non-ejection inspection mode-compatible ejecting portion DM2 as the mode-compatible ejecting portion DM. Here, the continuous non-ejection inspection mode-compatible ejecting portion DM2 is the ejecting portion D that does not eject the ink during multiple continuous unit periods TP. In this embodiment, when the ejecting portion D[m][TP(k−1)] corresponds either to the non-dot forming ejecting portion DP5 or to the non-dot forming inspection target ejecting portion DK5 and the ejecting portion D[m][TP(k)] corresponds either to the non-dot forming ejecting portion DP5 or to the non-dot forming inspection target ejecting portion DK5 in the continuous non-ejection inspection mode as exemplarily shown in FIG. 18, the inspection target selection unit 24 specifies the ejecting portion D[m][TP(k)] as the continuous non-ejection inspection mode-compatible ejecting portion DM2.

In general, when a period of not ejecting the ink from the ejecting portion D is extended, the ink inside the cavity 322 of the ejecting portion D is more likely to increase a viscosity. On the other hand, according to this embodiment, the ejecting state inspection process can be executed in the continuous non-ejection inspection mode. Thus, it is possible to promptly discover an ejection abnormality attributed to the increase in viscosity of the ink in the ejecting portion D.

In the adjacent ejection inspection mode, the inspection target selection unit 24 selects an adjacent ejection inspection mode-compatible ejecting portion DM3 as the mode-compatible ejecting portion DM. Here, the adjacent ejection inspection mode-compatible ejecting portion DM3 is the ejecting portion D to which an adjacent ejecting portion D is ejecting the ink. In this embodiment, when any of the ejecting portion D[m−1][TP(k)] or the ejecting portion D[m+1][TP(k)] corresponds neither to the non-dot forming ejecting portion DP5 nor to the non-dot forming inspection target ejecting portion DK5 and the ejecting portion D[m][TP(k)] corresponds neither to the non-dot forming ejecting portion DP5 nor to the non-dot forming inspection target ejecting portion DK5 in the adjacent ejection inspection mode as exemplarily shown in FIG. 19, the inspection target selection unit 24 specifies the ejecting portion D[m][TP(k)] as the adjacent ejection inspection mode-compatible ejecting portion DM3.

In general, when the ink is ejected from a second ejecting portion D that is adjacent to a first ejecting portion D, it is more likely that the vibration propagates from the second ejecting portion D to the first ejecting portion D. On the other hand, according to this embodiment, the ejecting state inspection process can be executed in the adjacent ejection inspection mode. Thus, it is possible to promptly discover an ejection abnormality attributed to the vibration propagating from the second ejecting portion D.

In the adjacent non-ejection inspection mode, the inspection target selection unit 24 selects an adjacent non-ejection inspection mode-compatible ejecting portion DM4 as the mode-compatible ejecting portion DM. Here, the adjacent non-ejection inspection mode-compatible ejecting portion DM4 is the ejecting portion D to which an adjacent ejecting portion D is not ejecting the ink. In this embodiment, when the ejecting portion D[m−1][TP(k)] and the ejecting portion D[m+1][TP(k)] correspond either to the non-dot forming ejecting portion DP5 or to the non-dot forming inspection target ejecting portion DK5 in the adjacent non-ejection inspection mode as exemplarily shown in FIG. 20, the inspection target selection unit 24 specifies the ejecting portion D[m][TP(k)] as the adjacent non-ejection inspection mode-compatible ejecting portion DM4.

In general, when the second ejecting portion D adjacent to the first ejecting portion D is not ejecting the ink, it is possible to reduce a possibility that noise attributed to the vibration of the second ejecting portion D overlaps the detected potential signal Vout detected from the first ejecting portion D. Moreover, when the noise does not overlap the detected potential signal Vout detected from the first ejecting portion D, it is likely that the state of ejection of the first ejecting portion D is more accurately inspected than the case where the noise overlaps the detected potential signal Vout. On the other hand, according to this embodiment, the ejecting state inspection process can be executed in the adjacent non-ejection inspection mode. Thus, it is possible to accurately inspect the state of ejection of the first ejecting portion D.

In the random inspection mode, the inspection target selection unit 24 selects a random inspection mode-compatible ejecting portion DM5 as the mode-compatible ejecting portion DM. Here, the random inspection mode-compatible ejecting portion DM5 is an arbitrary ejecting portion D. In this embodiment, the inspection target selection unit 24 specifies the arbitrary ejecting portion D[m][TP(k)] as the random inspection mode-compatible ejecting portion DM5 as exemplarily shown in FIG. 21.

According to this embodiment, the ejecting state inspection process can be executed in the random inspection mode. Thus, it is possible to evenly inspect states of ejection of the ejecting portions D[1] to D[M] provided to the head unit 3.

In this embodiment, the unit period TPt(k) represents an example of a "first unit period", the unit period TPt(k−1) represents an example of a "first preceding unit period", the unit period TPh(k) represents an example of a "second unit period", and the unit period TPh(k−1) represents an example of a "second preceding unit period".

2.4 Summary of Second Embodiment

As described above, in the ink jet printer 1 according to this embodiment, the ejecting portion D[m] selected as the inspection target ejecting portion DK may be configured to be driven in the control period TQ1 and the control period TQ2 that precede the control period TQ3 included in the unit period TPt(k) out of the unit periods TPt(1) to TPt(K) by the supplied driving signal Vin[m] that has any of one or both of the waveform PX and the waveform PY, and the waveform PM, to be driven in the control period TQ1 and the control period TQ2 that precede the control period TQ3 included in the unit period TPh(k) out of the unit periods TPh(1) to TPh(K) by the supplied driving signal Vin[m] that has any of the aforementioned waveforms, to be driven in the unit period TPt(k−1) by the supplied driving signal Vin[m] that has an ejection waveform being any of one or both of the waveform PX and the waveform PY, and the waveform PM, and to be driven in the unit period TPh(k−1) by the supplied driving signal Vin[m] having the ejection waveform.

As a consequence, according to this embodiment, it is possible to promptly discover an ejection abnormality attributed to the bubble trapped in the ejecting portion D[m] and an ejection abnormality attributed to adhesion of a foreign matter to the ejecting portion D[m], and to discover an ejection abnormality attributed to unstableness of the vibration of the meniscus inside the nozzle N more reliably.

Meanwhile, in the ink jet printer 1 according to this embodiment, the ejecting portion D[m] selected as the inspection target ejecting portion DK may be configured to be driven in the control period TQ1 and the control period TQ2 that precede the control period TQ3 included in the unit period TPt(k) out of the unit periods TPt(1) to TPt(K) by the supplied driving signal Vin[m] that has the waveform PK, to be driven in the control period TQ1 and the control period TQ2 that precede the control period TQ3 included in the unit period TPh(k) out of the unit periods TPh(1) to TPh(K) by the supplied driving signal Vin[m] that has the waveform PK, not to eject the ink in the unit period TPt(k−1), and not to eject the ink in the unit period TPh(k−1).

As a consequence, according to this embodiment, it is possible to promptly discover an ejection abnormality attributed to an increase in viscosity of the ink in the ejecting portion D[m].

In the meantime, in the ink jet printer 1 according to this embodiment, the adjacent ejecting portion being either the ejecting portion D[m+1] or the ejecting portion D[m−1] that is adjacent to the ejecting portion D[m] selected as the inspection target ejecting portion DK may be configured to be driven in the unit period TPt(k) by the supplied driving signal Vin[m] that has the ejection waveform being any of one or both of the waveform PX and the waveform PY, and the waveform PM, and to be driven in the unit period TPh(k) by the supplied driving signal Vin[m] that has the ejection waveform.

As a consequence, according to this embodiment, it is possible to promptly discover an ejection abnormality of the ejecting portion D[m] which is attributed to the vibration from the adjacent ejecting portion.

Meanwhile, in the ink jet printer 1 according to this embodiment, the adjacent ejecting portion being either the ejecting portion D[m+1] or the ejecting portion D[m−1] that is adjacent to the ejecting portion D[m] selected as the inspection target ejecting portion DK may be configured not to eject the ink in the unit period TPt(k), and not to eject the ink in the unit period TPh(k).

As a consequence, according to this embodiment, it is possible to reduce the possibility that the noise attributed to the vibration from the adjacent ejecting portion overlaps the signal indicating the vibration generated in the ejecting portion D[m]. Thus, according to this embodiment, it is possible to accurately inspect the state of ejection of the ejecting portion D[m].

In the meantime, the ink jet printer 1 according to this embodiment may include the host information acceptance unit 23 that accepts the operation of the user of the ink jet printer 1, and the inspection target selection unit 24 that selects the inspection target ejecting portion DK out of the ejecting portions D[1] to D[M] based on the operation of the user accepted by the host information acceptance unit 23.

As a consequence, according to this embodiment, the ejection state inspection unit 25 can intensively inspect a location in the image GZh that the user of the ink jet printer 1 considers as important.

Meanwhile, the ink jet printer 1 according to this embodiment may include the inspection target selection unit 24 that selects the inspection target ejecting portion DK at random out of the ejecting portions D[1] to D[M].

As a consequence, according to this embodiment, it is possible to evenly inspect the states of ejection of the ejecting portions D[1] to D[M].

3. Third Embodiment

A third embodiment of the present disclosure will be described below. In the respective modes exemplified below, constituents having the same workings and functions as those in the first embodiment or the second embodiment will be denoted by the corresponding reference signs used in the description of the first embodiment or the second embodiment and detailed explanations thereof will be omitted as appropriate.

3.1 Operation of Ink Jet Printer

An outline of the printing system Sys according to the third embodiment will be described below with reference to FIGS. 22 and 23. The third embodiment is different from the second embodiment in that multiple inspection target ejecting portions DK are selected from the mode-compatible ejecting portions DM in the unit period TP(k).

Note that a configuration of the printing system Sys according to the third embodiment is the same as the configuration of the printing system Sys according to the second embodiment, and explanations thereof will be omitted.

Figure 22:
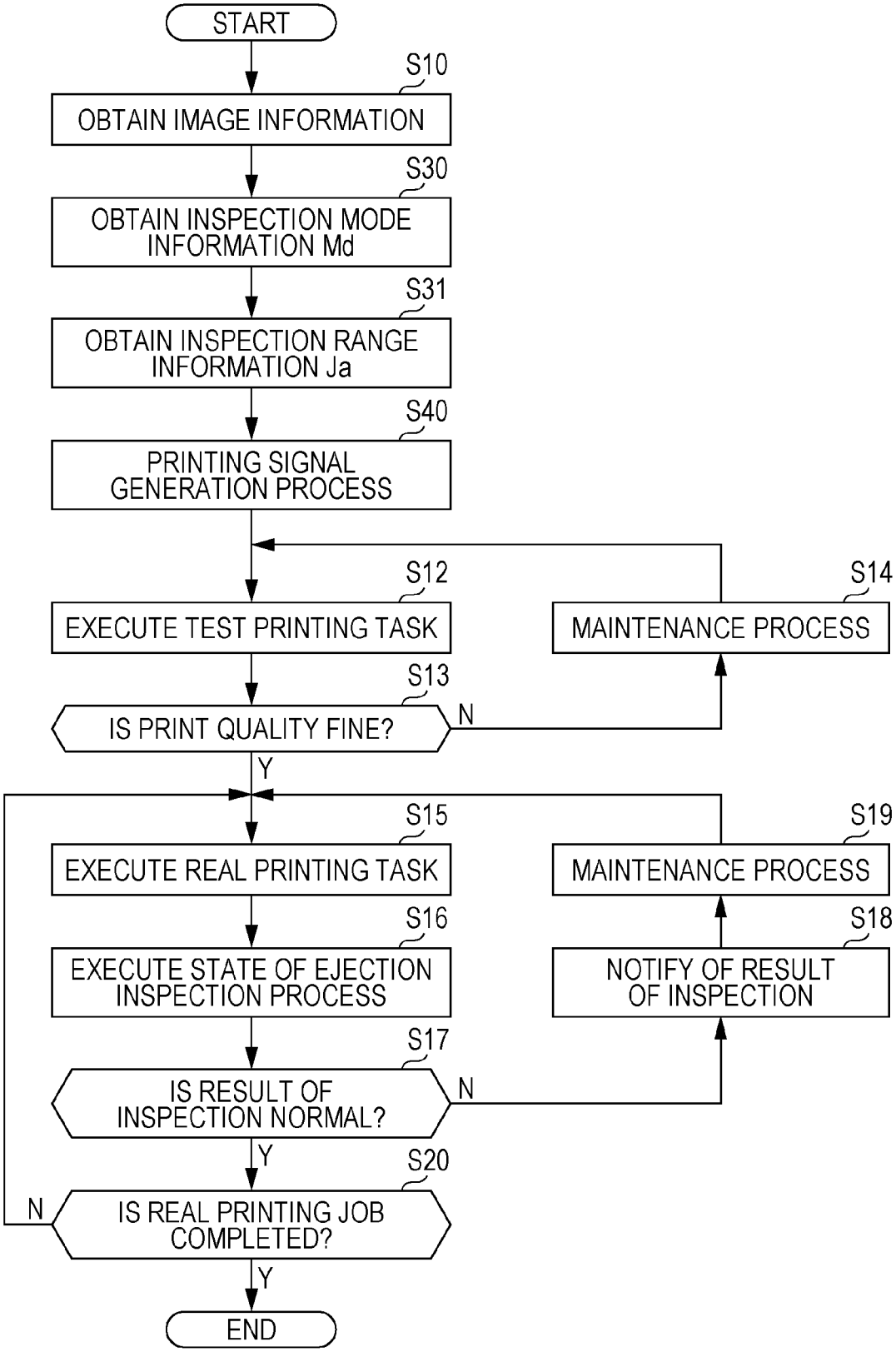
FIG. 22 is a flowchart for explaining an example of an operation of an ink jet printer 1 according to a third embodiment of the present disclosure.

FIG. 22 is a flowchart showing an example of an operation of the ink jet printer 1 according to this embodiment when the ink jet printer 1 executes the printing job.

As exemplarily shown in FIG. 22, when the ink jet printer 1 executes the printing job, the host information acceptance unit 23 of the control unit 2 executes the processes in steps S10, S30, and S31 described in the second embodiment.

Then, the control unit 2 executes the printing signal generation process (S40).

Thereafter, the control unit 2 executes the processes in steps S12 to S20 explained in the first embodiment.

Figure 23:
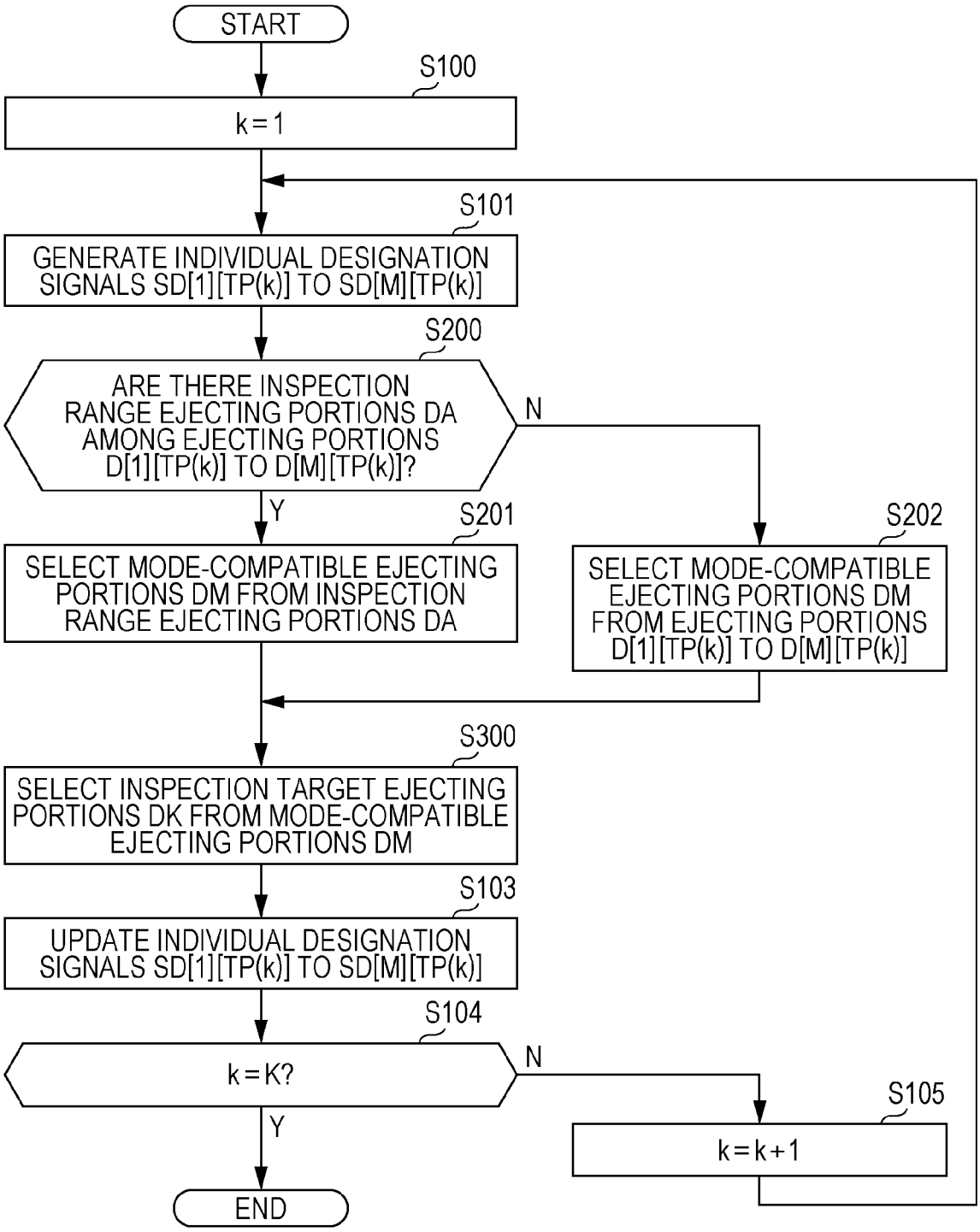
FIG. 23 is a flowchart for explaining an example of an operation of the ink jet printer 1.

FIG. 23 is a flowchart showing an example of an operation of the ink jet printer 1 according to this embodiment when the ink jet printer 1 executes the printing signal generation process.

As exemplarily shown in FIG. 23, in the printing signal generation process of this embodiment, the control unit 2 executes the processes in steps S100, S101, and S200 to S202 as with the second embodiment.

Then, the inspection target selection unit 24 selects multiple inspection target ejecting portions DK out of the mode-compatible ejecting portions DM selected in step S201 or S202 (S300). In step S300, the inspection target selection unit 24 selects the inspection target ejecting portions DK equal to or below a prescribed number MX. Here, the prescribed number MX is a natural number that satisfies "$MX \leq \beta * M$". In this embodiment, the coefficient β is a real number that satisfies "$0 < \beta \leq 0.5$". Here, the coefficient β may be a real number that satisfies "$0 < \beta \leq 0.2$" instead.

Thereafter, the print control unit 21 executes the processes in steps S103 to S105 as with the first embodiment.

3.2 Outlines of Inspection Modes

The mode-compatible ejecting portions DM in the respective inspection modes will be described below with reference to FIGS. 24 to 28.

Figure 24:
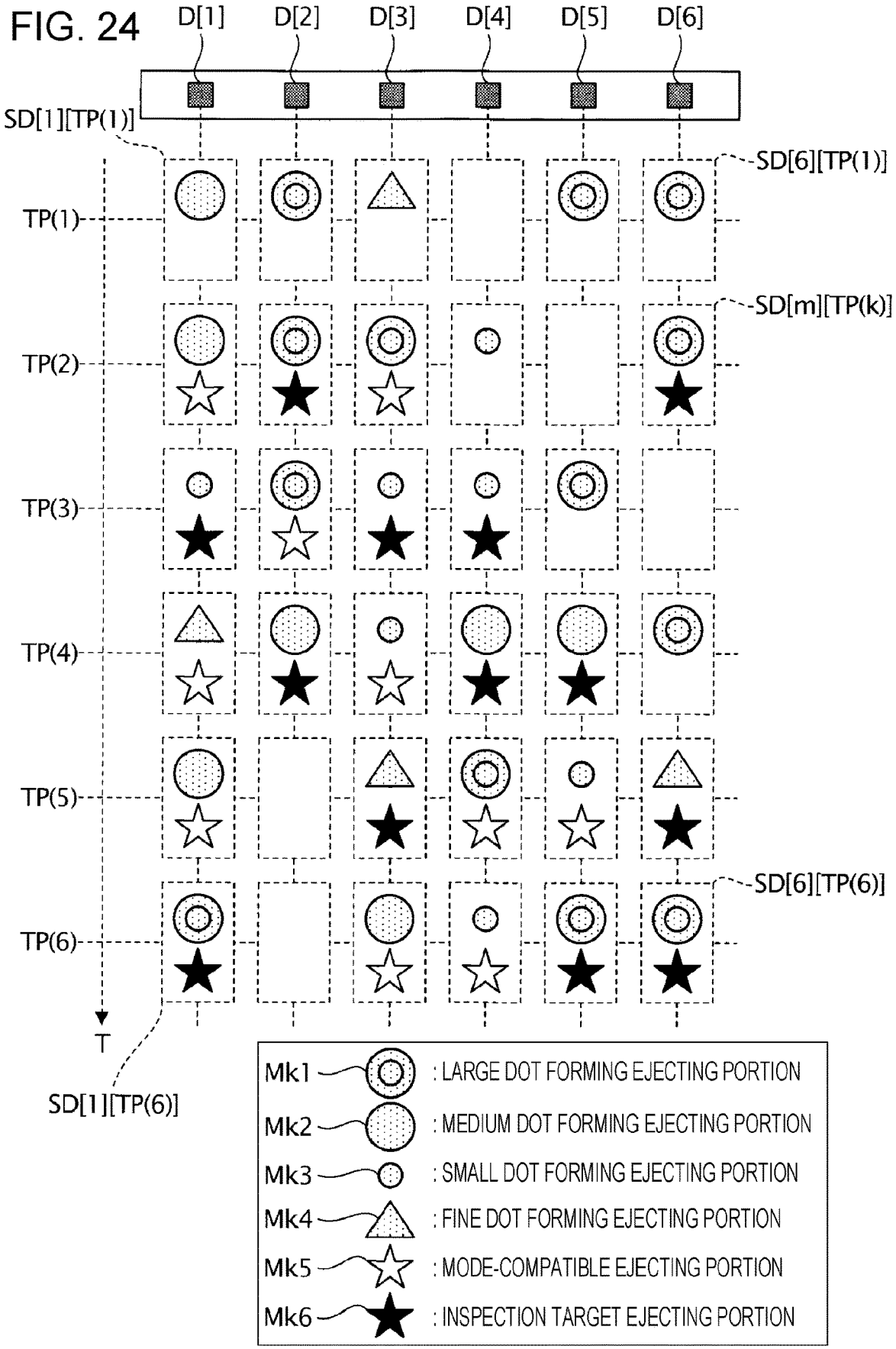
FIG. 24 is an explanatory diagram for explaining an example of the continuous ejection inspection mode.
Figure 25:
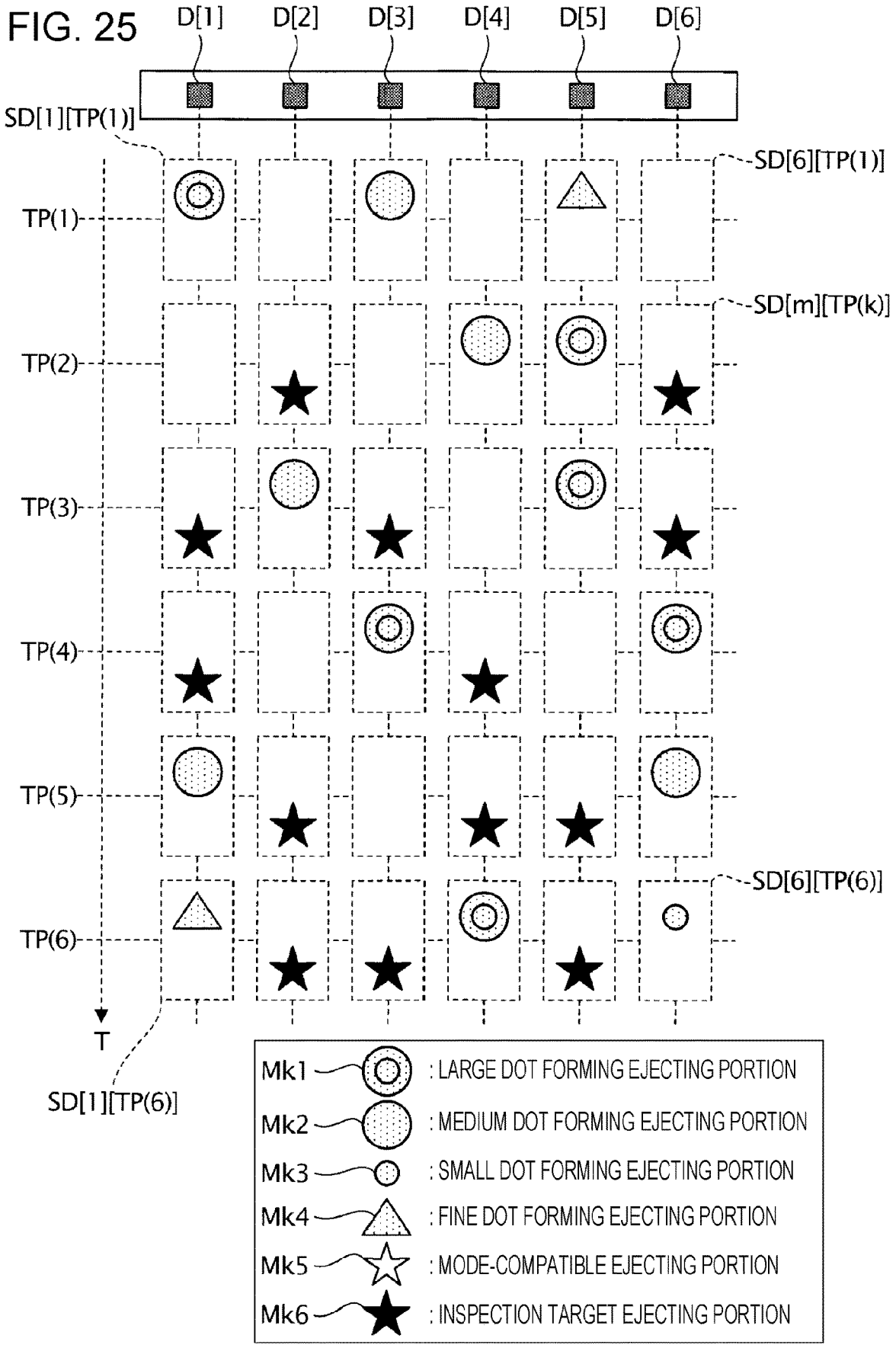
FIG. 25 is an explanatory diagram for explaining an example of the continuous non-ejection inspection mode.
Figure 26:
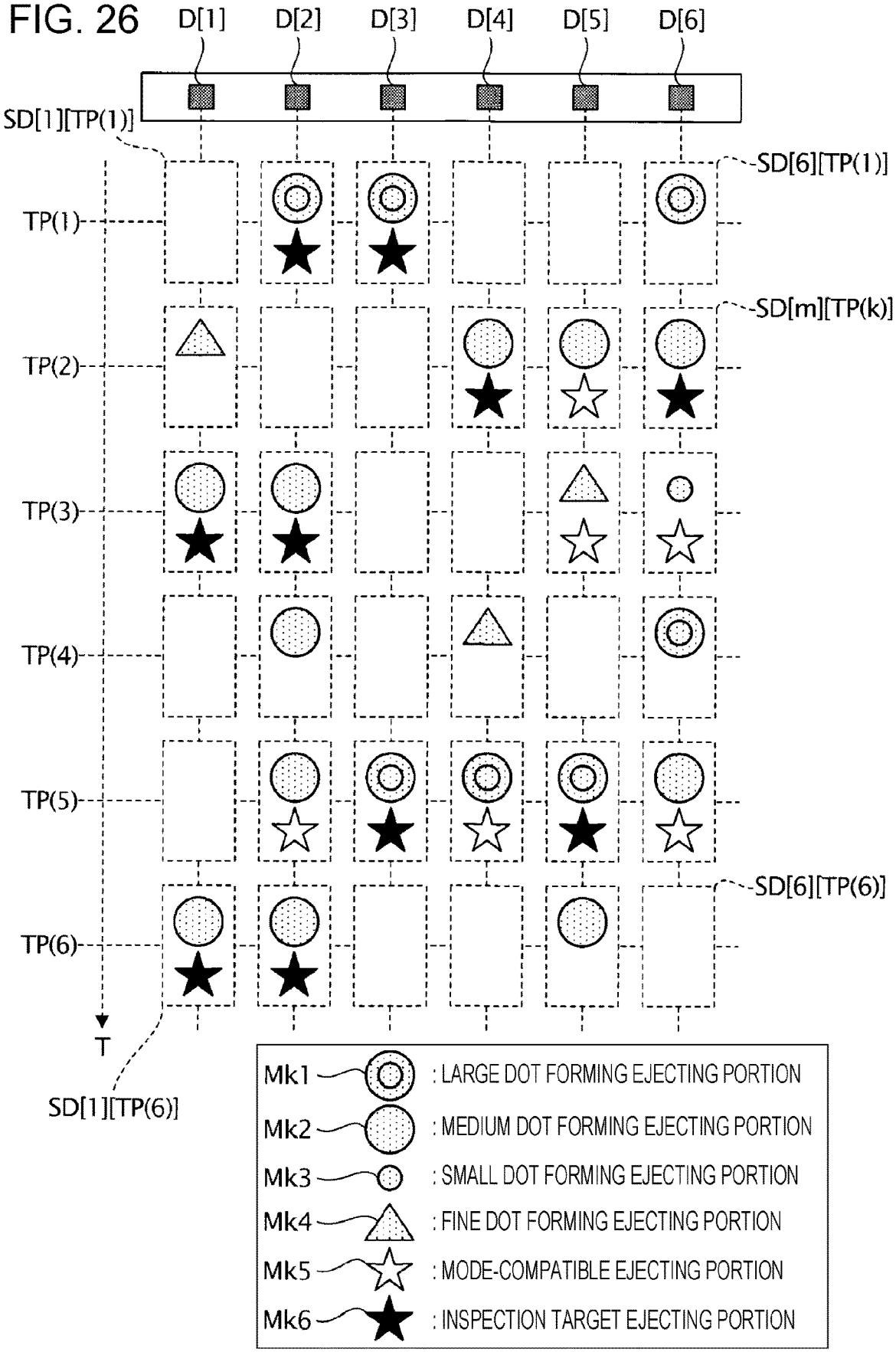
FIG. 26 is an explanatory diagram for explaining an example of the adjacent ejection inspection mode.
Figure 27:
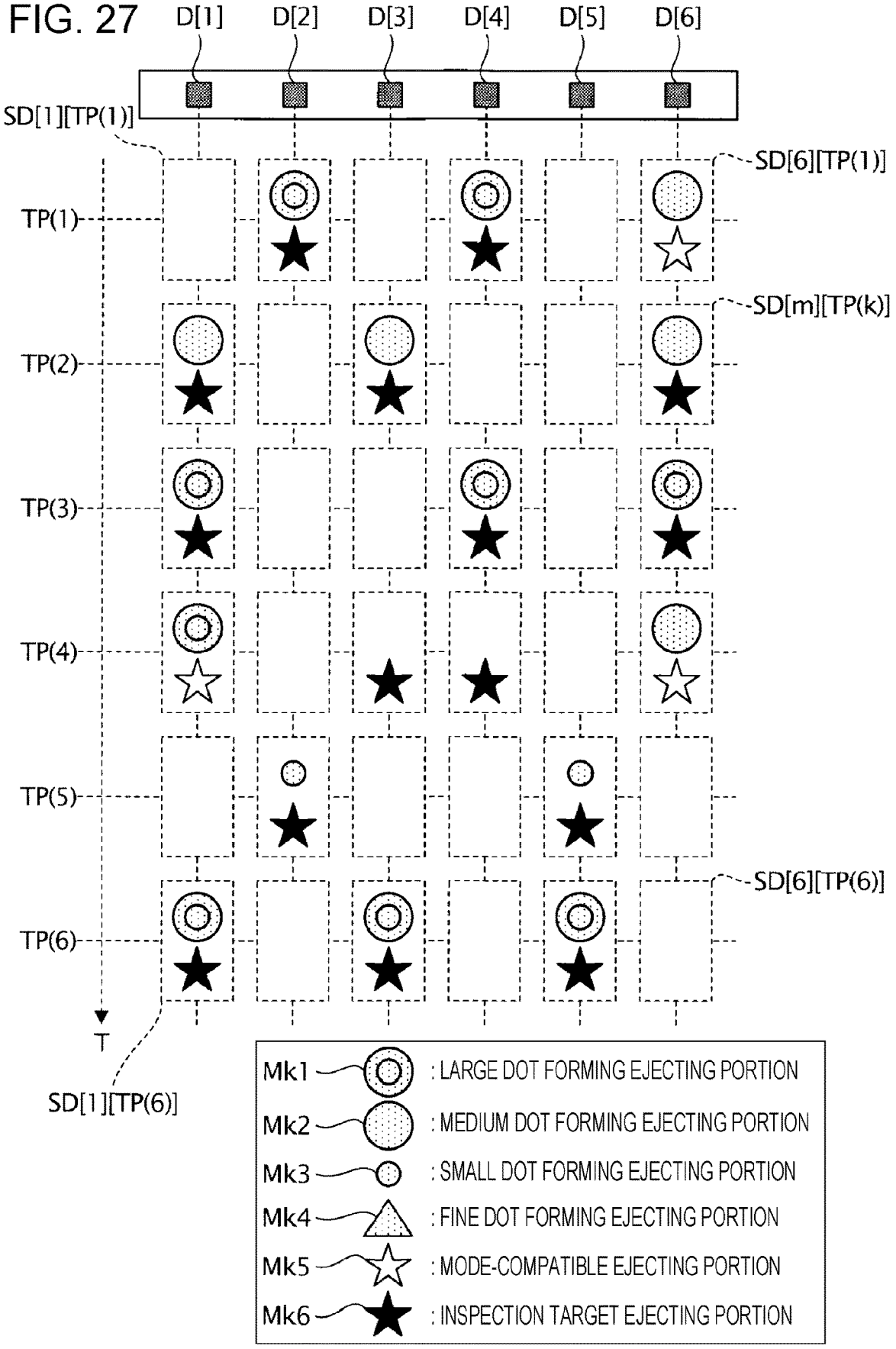
FIG. 27 is an explanatory diagram for explaining an example of the adjacent non-ejection inspection mode.
Figure 28:
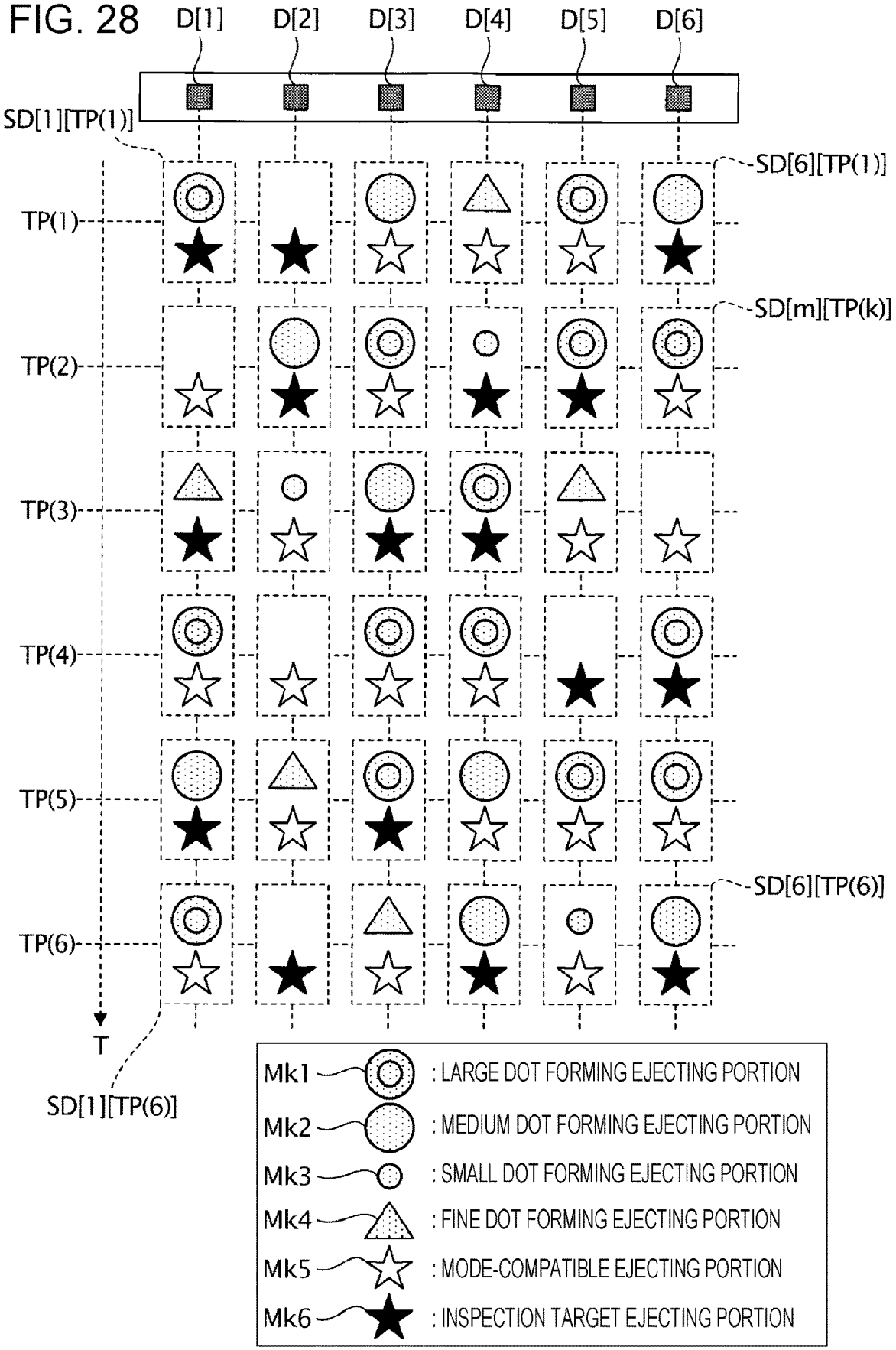
FIG. 28 is an explanatory diagram for explaining an example of the random inspection mode.

FIG. 24 is an explanatory diagram for explaining an example of a relation of the individual designation signal SD[m][TP(k)] with the mode-compatible ejecting portion DM as well as the inspection target ejecting portion DK in the continuous ejection inspection mode. FIG. 25 is an explanatory diagram for explaining an example of a relation of the individual designation signal SD[m][TP(k)] with the mode-compatible ejecting portion DM as well as the inspection target ejecting portion DK in the continuous non-ejection inspection mode. FIG. 26 is an explanatory diagram for explaining an example of a relation of the individual designation signal SD[m][TP(k)] with the mode-compatible ejecting portion DM as well as the inspection target ejecting portion DK in the adjacent ejection inspection mode. FIG. 27 is an explanatory diagram for explaining an example of a relation of the individual designation signal SD[m][TP(k)] with the mode-compatible ejecting portion DM as well as the inspection target ejecting portion DK in the continuous non-ejection inspection mode. FIG. 28 is an explanatory diagram for explaining an example of a relation of the individual designation signal SD[m][TP(k)] with the mode-compatible ejecting portion DM as well as the inspection target ejecting portion DK in the random inspection mode.

Note that FIGS. 24 to 28 are the same as FIGS. 17 to 21 described above except that the multiple inspection target ejecting portions DK are selected from the multiple mode-compatible ejecting portions DM when there are the multiple mode-compatible ejecting portions DM in each unit period TP(k).

Specifically, when there are multiple continuous ejection inspection mode-compatible ejecting portions DM1 in the unit period TP(k) in the continuous ejection inspection mode as shown in FIG. 24, the inspection target selection unit 24 according to this embodiment selects the multiple inspection target ejecting portions DK out of the multiple continuous ejection inspection mode-compatible ejecting portions DM1. Meanwhile, when there are multiple continuous non-ejection inspection mode-compatible ejecting portions DM2 in the unit period TP(k) in the continuous non-ejection inspection mode as shown in FIG. 25, the inspection target selection unit 24 according to this embodiment selects the multiple inspection target ejecting portions DK out of the multiple continuous non-ejection inspection mode-compatible ejecting portions DM2. In the meantime, when there are multiple adjacent ejection inspection mode-compatible ejecting portions DM3 in the unit period TP(k) in the adjacent ejection inspection mode as shown in FIG. 26, the inspection target selection unit 24 according to this embodiment selects the multiple inspection target ejecting portions DK out of the multiple adjacent ejection inspection mode-compatible ejecting portions DM3. Meanwhile, when there are multiple adjacent non-ejection inspection mode-compatible ejecting portions DM4 in the unit period TP(k) in the adjacent non-ejection inspection mode as shown in FIG. 27, the inspection target selection unit 24 according to this embodiment selects the multiple inspection target ejecting portions DK out of the multiple adjacent non-ejection inspection mode-compatible ejecting portions DM4. Meanwhile, when there are multiple random inspection mode-compatible ejecting portions DM5 in the unit period TP(k) in the random inspection mode as shown in FIG. 28, the inspection target selection unit 24 according to this embodiment selects the multiple inspection target ejecting portions DK out of the multiple random inspection mode-compatible ejecting portions DM5.

As described above, in this embodiment, when there are the multiple mode-compatible ejecting portions DM in each unit period TP(k), the inspection target selection unit 24 selects the multiple inspection target ejecting portions DK out of the multiple mode-compatible ejecting portions DM.

Meanwhile, in this embodiment, when there are the multiple mode-compatible ejecting portions DM in each unit period TP(k), the inspection target selection unit 24 may select, multiple inspection target ejecting portions DK, the mode-compatible ejecting portions DM having the same aspect of the drive out of the multiple mode-compatible ejecting portions DM.

Specifically, in the continuous ejection inspection mode, the adjacent ejection inspection mode, the adjacent non-ejection inspection mode, and the random inspection mode, when there are the multiple mode-compatible ejecting portions DM in the unit period TP(k) and there are the multiple large dot forming ejecting portions DP1 among the multiple mode-compatible ejecting portions DM, the inspection target selection unit 24 may select only the multiple large dot forming ejecting portions DP1 as the inspection target ejecting portions DK. In this case, the print control unit 21 changes the multiple large dot forming ejecting portions DP1 into the multiple large dot forming inspection target ejecting portions DK1. Likewise, in the continuous ejection inspection mode, the adjacent ejection inspection mode, the adjacent non-ejection inspection mode, and the random inspection mode, when there are the multiple mode-compatible ejecting portions DM in the unit period TP(k) and there are the multiple medium dot forming ejecting portions DP2 among the multiple mode-compatible ejecting portions DM, the inspection target selection unit 24 may select only the multiple medium dot forming ejecting portions DP2 as the inspection target ejecting portions DK. In this case, the print control unit 21 changes the multiple medium dot forming ejecting portions DP2 into the multiple medium dot forming inspection target ejecting portions DK2. Likewise, in the continuous ejection inspection mode, the adjacent ejection inspection mode, the adjacent non-ejection inspection mode, and the random inspection mode, when there are the multiple mode-compatible ejecting portions DM in the unit period TP(k) and there are the multiple small dot forming ejecting portions DP3 among the multiple mode-compatible ejecting portions DM, the inspection target selection unit 24 may select only the multiple small dot forming ejecting portions DP3 as the inspection target ejecting portions DK. In this case, the print control unit 21 changes the multiple small dot forming ejecting portions DP3 into the multiple small dot forming inspection target ejecting portions DK3. Likewise, in the continuous ejection inspection mode, the adjacent ejection inspection mode, the adjacent non-ejection inspection mode, and the random inspection mode, when there are the multiple mode-compatible ejecting portions DM in the unit period TP(k) and there are the multiple fine dot forming ejecting portions DP4 among the multiple mode-compatible ejecting portions DM, the inspection target selection unit 24 may select only the multiple fine dot forming ejecting portions DP4 as the inspection target ejecting portions DK. In this case, the print control unit 21 changes the multiple fine dot forming ejecting portions DP4 into the multiple fine dot forming inspection target ejecting portions DK4.

Meanwhile, in the continuous non-ejection inspection mode and the random inspection mode, when there are the multiple mode-compatible ejecting portions DM in the unit period TP(k) and there are the multiple non-dot forming ejecting portions DP5 among the multiple mode-compatible ejecting portions DM, the inspection target selection unit 24 may select only the non-dot forming ejecting portions DP5 as the inspection target ejecting portions DK. In this case, the print control unit 21 changes the multiple non-dot forming ejecting portions DP5 into the multiple non-dot forming inspection target ejecting portion DK5.

In the following, a case where an ejecting portion D[m1][TP(k)] and an ejecting portion D[m2][TP(k)] are the mode-compatible ejecting portions DM in the unit period TP(k) and the inspection target selection unit 24 selects the ejecting portion D[m1][TP(k)] and the ejecting portion D[m2][TP(k)] as the inspection target ejecting portions DK in the unit period TP(k) is assumed as an example. Here, the value m1 is a natural number which satisfies "$1 \leq m1 \leq M$". Meanwhile, the value m2 is a natural number other than the value m1 which satisfies "$1 \leq m2 \leq M$".

In this case, the detection circuit 33 detects a composite vibration of the vibration generated in the ejecting portion D[m1][TP(k)] and the vibration generated in the ejecting portion D[m2][TP(k)]. In the following, reference signs each representing a signal or the like related to the composite vibration of the vibration generated in the ejecting portion D[m1][TP(k)] and the vibration generated in the ejecting portion D[m2][TP(k)] may be expressed with addition of a suffix [m1,m2] when appropriate. Specifically, the detection circuit 33 detects the composite vibration of the vibration generated in the ejecting portion D[m1][TP(k)] and the vibration generated in the ejecting portion D[m2][TP(k)] as a detected potential signal Vout[m1,m2], and generates a residual vibration signal VD[m1,m2] based on the detected potential signal Vout[m1,m2]. Then, the vibration analysis unit 5 generates the vibration information SJ[[m1,m2] based on the residual vibration signal VD[m1,m2]. In other words, the vibration information acquisition unit 22 acquires the vibration information SJt[m1,m2][TP(k)] when the test printing task is executed, and obtains the vibration information SJh[m1,m2][TP(k)] when the real printing task is executed. Meanwhile, the ejection state inspection unit 25 inspects the states of ejection of the ejecting portion D[m1][TP(k)] and the ejecting portion D[m2][TP(k)] based on the vibration information SJt[m1,m2][TP(k)] and the vibration information SJh[m1,m2][TP(k)].

To be more precise, the ejection state inspection unit 25 determines whether or not a time length TSNt[m1,m2][TP(k)], a time length TSCt[m1,m2][TP(k)], and a time length TSHt[m1, m2][TP(k)] indicated by the vibration information SJt[m1,m2][TP(k)] and a time length TSNh[m1,m2][TP(k)], a time length TSCh[m1,m2][TP(k)], and a time length TSHh[m1, m2][TP(k)] indicated by the vibration information SJh[m1,m2][TP(k)] satisfy the above-mentioned formulae (1) to (3), for example. Then, the ejection state inspection unit 25 generates a result of inspection indicating that the states of ejection of the ejecting portion D[m1][TP(k)] and the ejecting portion D[m2][TP(k)] are normal when the formulae (1) to (3) are satisfied. On the other hand, the ejection state inspection unit 25 generates a result of inspection indicating that the state of ejection of the ejecting portion D[m1][TP(k)] or the ejecting portion D[m2][TP(k)] is abnormal when part of all of the formulae (1) to (3) are not satisfied.

Here, the ejection state inspection unit 25 may determine whether or not the time length TSNt[m1,m2][TP(k)], the time length TSCt[m1,m2][TP(k)], and the time length TSHt[m1, m2][TP(k)] and the time length TSNh[m1,m2][TP(k)], the time length TSCh[m1,m2][TP(k)], and the time length TSHh[m1, m2][TP(k)] satisfy part of the formulae (1) to (3). In this case, the ejection state inspection unit 25 generates the result of inspection indicating that the states of ejection of the ejecting portion D[m1][TP(k)] and the ejecting portion D[m2][TP(k)] are normal when part of the formulae (1) to (3) is satisfied. On the other hand, the ejection state inspection unit 25 generates the result of inspection indicating that the state of ejection of the ejecting portion D[m1][TP(k)] or the ejecting portion D[m2][TP(k)] is abnormal when part of the formulae (1) to (3) is not satisfied.

3.3 Summary of Third Embodiment

As described above, the ink jet printer 1 according to this embodiment includes the ejecting portions D[1] to D[M] that are driven by the driving signal Com and configured to eject the inks. The ink jet printer 1 is configured to form the image GZ on the print sheet P by using the inks ejected from the ejecting portions D[1] to D[M]. Here, the ink jet printer 1 includes the vibration information acquisition unit 22 that acquires the vibration information SJt concerning the composite vibration obtained by combining the vibrations generated in the control period TQ3 included in the unit period TPt(k) out of the unit periods TPt(1) to TPt(K) being periods in which the test printing task to cause the ink jet printer 1 to form the image GZt on the print sheet P regarding the multiple inspection target ejecting portions DK out of the ejecting portions D[1] to D[M], and acquires the vibration information SJh concerning the composite vibration obtained by combining the combining the vibrations generated in the control period TQ3 included in the unit period TPh(k) out of the unit periods TPh(1) to TPh(K) that starts after completion of printing of the image GZ on the print sheet P in the unit periods TPt(1) to TPt(K), the unit periods TPh(1) to TPh(K) being periods in which the real printing task to cause the ink jet printer 1 to form the image GZh related to the image GZt on the print sheet P regarding the multiple inspection target ejecting portions DK. The ink jet printer 1 also includes the ejection state inspection unit 25 that inspects the states of ejection of the inks from the multiple inspection target ejecting portions DK based on the vibration information SJt and the vibration information SJh.

Specifically, according to this embodiment, the ejection state inspection unit 25 can inspect the states of ejection of the inks from the multiple inspection target ejecting portions DK in the unit period TP(k) based on the composite vibration obtained by causing the vibration information acquisition unit 22 to combine the vibrations generated in the multiple inspection target ejecting portions DK. Therefore, according to this embodiment, the ejection state inspection unit 25 can inspect the states of ejection targeted for more ejecting portions D in the unit period TP(k) as compared to the aspect of inspecting the state of ejection of the ink from the single ejecting portion D. As a consequence, according to this embodiment, it is possible to promptly discover a deterioration in quality of the image GZh to be formed on the print sheet P in the real printing task.

Meanwhile, the ink jet printer 1 according to this embodiment may include the inspection target selection unit 24 that selects the ejecting portions D equal to or below the prescribed number MX as the inspection target ejecting portions DK out of the ejecting portions D[1] to D[M].

In other words, according to this embodiment, it is possible reduce to the number of the ejecting portions D selected as the inspection target ejecting portions DK to the prescribed number MX or less. This makes it possible to improve accuracy of inspection of the states of ejection of the inks from the inspection target ejecting portions DK as compared to an aspect in which the number of the ejecting portions D selected as the inspection target ejecting portions DK is larger than the prescribed number MX.

4. Modified Examples

The respective embodiments described above can be modified into various forms. Specific aspects of modification will be described below as examples. Two or more aspects to be arbitrarily selected from the following examples may be appropriately combined insofar as the aspects do not conflict with each other. In the modified examples shown below, constituents having the same workings and functions as those in any of the embodiments will be denoted by the corresponding reference signs used in the description of the relevant embodiment and detailed explanations thereof will be omitted as appropriate.

Modified Example 1

The above-described first to third embodiments assume the case where the image GZt formed in the test printing task and the image GZh formed in the real printing task are the same image. However, the present disclosure is not limited only to this aspect. There may be a different component AX between the image GZt and the image GZh.

In this modified example, the inspection target selection unit 24 may exclude the ejecting portion D[m][TP(k)] that forms the dot located in the different component AX from a target of selection as the inspection target ejecting portion DK. Alternatively, in this modified example, the ejection state inspection unit 25 may exclude the vibration information SJt[m][TP(k)] corresponding to the ejecting portion D[m][TP(k)] that forms the dot located in the different component AX from a target of the ejecting state inspection process.

Modified Example 2

In any of the above-described first to third embodiments and the modified example 1, the user of the printing system Sys may be able to set a non-inspection target area AY representing an area to be excluded from a target of inspection in the ejecting state inspection process in the image GZ by operating the operating unit 93.

Modified Example 3

In any of the above-described first to third embodiments and the modified examples 1 and 2, the user of the printing system Sys may be able to set at least any of the multiple intensive inspection areas Ar and the non-inspection target area AY in the image GZ by operating the operating unit 93.

Modified Example 4

In the above-described first to third embodiments and the modified examples 1 to 3, the control unit 91, the display unit 92, the operating unit 93, and the storage unit 94 are provided to the host computer 9. However, the present disclosure is not limited only to this aspect. Part or all of the control unit 91, the display unit 92, the operating unit 93, and the storage unit 94 may be provided to the ink jet printer 1.

Modified Example 5

In the above-described first to third embodiments and the modified examples 1 to 4, when the individual designation signal SD[m] indicates the value "7" in the unit period TP(k) which instructs the ejecting portion D[m] to be driven as the medium dot forming inspection target ejecting portion DK2, the coupled state designation circuit 310 sets the coupled state designation signal Qa[m] to the high level in the control period TQ1 and sets the coupled state designation signal Qs[m] to the high level in the control period TQ3. However, the present disclosure is not limited only to this aspect. When the individual designation signal SD[m] indicates the value "7" in the unit period TP which instructs the ejecting portion D[m] to be driven as the medium dot forming inspection target ejecting portion DK2, the coupled state designation circuit 310 may set the coupled state designation signal Qa[m] to the high level in the control period TQ1 and set the coupled state designation signal Qs[m] to the high level in the control period TQ2.

In the case of the unit period TPt(k) in which the ejecting portion D[m] is driven as the medium dot forming inspection target ejecting portion DK2 as described above, the control period TQ2 to detect the detected potential signal Vout[m] from the ejecting portion Dt[m][TP(k)] represents an example of the "first detection period". In the unit period TPh(k), the control period TQ2 to detect the detected potential signal Vout[m] from the ejecting portion Dh[m][TP(k)] represents an example of the "second detection period". In the unit period TPt(k), the control period TQ1 that precedes the control period TQ2 represents an example of the "first driving period". In the unit period TPh(k), the control period TQ1 that precedes the control period TQ2 represents an example of the "second driving period".

Modified Example 6

In the above-described first to third embodiments and the modified examples 1 to 5, when the individual designation signal SD[m] indicates the value "9" in the unit period TP(k) which instructs the ejecting portion D[m] to be driven as the fine dot forming inspection target ejecting portion DK4, the coupled state designation circuit 310 sets the coupled state designation signal Qb[m] to the high level in the control period TQ1 and sets the coupled state designation signal Qs[m] to the high level in the control period TQ3. However, the present disclosure is not limited only to this aspect. When the individual designation signal SD[m] indicates the value "9" in the unit period TP which instructs the ejecting portion D[m] to be driven as the fine dot forming inspection target ejecting portion DK4, the coupled state designation circuit 310 may set the coupled state designation signal Qb[m] to the high level in the control period TQ1 and set the coupled state designation signal Qs[m] to the high level in the control period TQ2.

In the case of the unit period TPt(k) in which the ejecting portion D[m] is driven as the fine dot forming inspection target ejecting portion DK4 as described above, the control period TQ2 to detect the detected potential signal Vout[m] from the ejecting portion Dt[m][TP(k)] represents an example of the "first detection period". In the unit period TPh(k), the control period TQ2 to detect the detected potential signal Vout[m] from the ejecting portion Dh[m][TP(k)] represents an example of the "second detection period". In the unit period TPt(k), the control period TQ1 that precedes the control period TQ2 represents an example of the "first driving period". In the unit period TPh(k), the control period TQ1 that precedes the control period TQ2 represents an example of the "second driving period".

Modified Example 7

Figure 29:
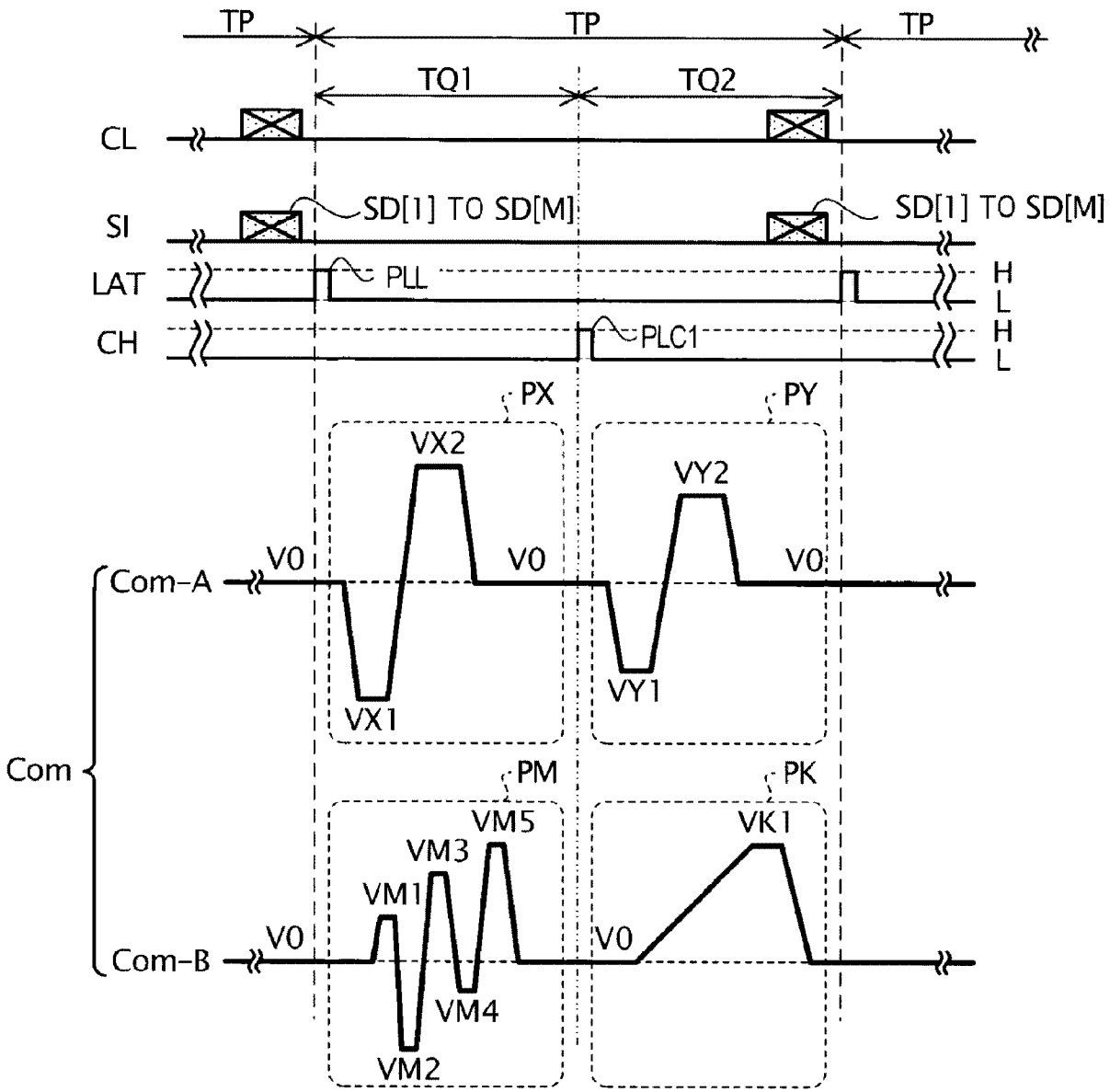
FIG. 29 is a timing chart showing an example of an operation of the ink jet printer 1.

In the above-described first to third embodiments and the modified examples 1 to 6, the control unit 2 outputs the change signal CH including the pulse PLC1 and the pulse PLC2 in the unit period TP. However, the present disclosure is not limited only to this aspect. As shown in FIG. 29, the control unit 2 may output the change signal CH that includes only the pulse PLC1 in the unit period TP. Adoption of the aspect of this modified example 7 makes it possible to achieve high-speed drive while shortening the unit period TP since the control period TQ3 is not provided in the unit period TP.

An example of a method of obtaining the vibration information SJ according to the aspect of the modified example 7 will be described below.

The modified example 7 assumes that the individual designation signal SD[m] can have any one of the following nine values in each unit period TP, namely, a value "11" that instructs the ejecting portion D[m] to be driven as a large dot forming ejecting portion DP1*a*, a value "12" that instructs the ejecting portion D[m] to be driven as a medium dot forming ejecting portion DP2*a*, a value "13" that instructs the ejecting portion D[m] to be driven as a small dot forming ejecting portion DP3*a*, a value "14" that instructs the ejecting portion D[m] to be driven as a fine dot forming ejecting portion DP4*a*, a value "15" that instructs the ejecting portion D[m] to be driven as a non-dot forming ejecting portion DP5*a*, a value "16" that instructs the ejecting portion D[m] to be driven as a medium dot forming inspection target ejecting portion DK2*a*, a value "17" that instructs the ejecting portion D[m] to be driven as a fine dot forming inspection target ejecting portion DK4*a*, a value "18" that instructs the ejecting portion D[m] to be driven as a post-detection small dot forming ejecting portion DK6*a*, and a value "19" that instructs the ejecting portion D[m] to be driven as a post-inspection non-dot forming ejecting portion DK7*a*.

The large dot forming ejecting portion DP1*a*, the medium dot forming ejecting portion DP2*a*, the small dot forming ejecting portion DP3*a*, the fine dot forming ejecting portion DP4*a*, and the non-dot forming ejecting portion DP5*a* will be collectively referred to as the non-inspection target ejecting portions DP.

Note that the large dot forming ejecting portion DP1*a*, the medium dot forming ejecting portion DP2*a*, the small dot forming ejecting portion DP3*a*, the fine dot forming ejecting portion DP4*a*, and the non-dot forming ejecting portion DP5*a* correspond to the description of the large dot forming ejecting portion DP1, the medium dot forming ejecting portion DP2, the small dot forming ejecting portion DP3, the fine dot forming ejecting portion DP4, and the non-dot forming ejecting portion DP5 according to the first embodiment, which are deprived of the explanations concerning the control period TQ3, and detailed explanations thereof will be omitted.

The medium dot forming inspection target ejecting portion DK2*a* is the ejecting portion D, which ejects the ink in the ink quantity ξ2 corresponding to the medium dot in the control period TQ1, and is subjected to detection of the detected potential signal Vout[m] therefrom based on the vibration generated in the ejecting portion D[m] in the control period TQ2 in the unit period TP. The fine dot forming inspection target ejecting portion DK4*a* is the ejecting portion D, which ejects the ink in the ink quantity ξ4 corresponding to the fine dot in the control period TQ1, and is subjected to detection of the detected potential signal Vout[m] therefrom based on the vibration generated in the ejecting portion D[m] in the control period TQ2 in the unit period TP. The post-detection small dot forming ejecting portion DK6*a* is the ejecting portion D, which is subjected to detection of the detected potential signal Vout[m] therefrom based on the vibration generated in the ejecting portion D[m] in the control period TQ1, and ejects the ink in the ink quantity ξ3 corresponding to the small dot in the control period TQ2 in the unit period TP. The post-inspection non-dot forming ejecting portion DK7*a* is the ejecting portion D, which is subjected to detection of the detected potential signal Vout[m] therefrom based on the vibration generated in the ejecting portion D[m] in the control period TQ1, and does not eject the ink in the control period TQ2 in the unit period TP.

FIG. 30 is an explanatory diagram for explaining an example of the relations among the individual designation signal SD[m], the coupled state designation signal Qa[m], the coupled state designation signal Qb[m], and the coupled state designation signal Qs[m].

As exemplarily shown in FIG. 30, when the individual designation signal SD[m] shows the value "16" in the unit period TP, which instructs the ejecting portion D[m] to be driven as the medium dot forming inspection target ejecting portion DK2*a*, the coupled state designation circuit 310 sets the coupled state designation signal Qa[m] to a high level in the control period TQ1 and sets the coupled state designation signal Qs[m] to a high level in the control period TQ2. In this case, the ejecting portion D[m] is driven by the supplied driving signal Vin[m] having the waveform PX in the control period TQ1. As a consequence, the ejecting portion D[m] ejects the ink in the ink quantity ξ2. Moreover, in this case, the detection circuit 33 detects the detected potential signal Vout[m] based on the vibration generated in the ejecting portion D[m] in the control period TQ2.

Meanwhile, when the individual designation signal SD[m] shows the value "17" in the unit period TP, which instructs the ejecting portion D[m] to be driven as the fine dot forming inspection target ejecting portion DK4*a*, the coupled state designation circuit 310 sets the coupled state designation signal Qb[m] to a high level in the control period TQ1 and sets the coupled state designation signal Qs[m] to a high level in the control period TQ2. In this case, the ejecting portion D[m] is driven by the supplied driving signal Vin[m] having the waveform PM in the control period TQ1. As a consequence, the ejecting portion D[m] ejects the ink in the ink quantity ξ4. Moreover, in this case, the detection circuit 33 detects the detected potential signal Vout[m] based on the vibration generated in the ejecting portion D[m] in the control period TQ2.

In the meantime, when the individual designation signal SD[m] shows the value "18" in the unit period TP, which instructs the ejecting portion D[m] to be driven as the post-detection small dot forming ejecting portion DK6*a*, the coupled state designation circuit 310 sets the coupled state designation signal Qs[m] to a high level in the control period TQ1 and sets the coupled state designation signal Qa[m] to a high level in the control period TQ2. In this case, the detection circuit 33 detects the detected potential signal Vout[m] based on the vibration generated in the ejecting portion D[m] in the control period TQ1. Moreover, in this case, the ejecting portion D[m] is driven by the supplied driving signal Vin[m] having the waveform PY in the control period TQ2. As a consequence, the ejecting portion D[m] ejects the ink in the ink quantity ξ3.

Meanwhile, when the individual designation signal SD[m] shows the value "19" in the unit period TP, which instructs the ejecting portion D[m] to be driven as the post-inspection non-dot forming ejecting portion DK7*a*, the coupled state designation circuit 310 sets the coupled state designation signal Qs[m] to a high level in the control period TQ1 and sets the coupled state designation signal Qb[m] to a high level in the control period TQ2. In this case, the detection circuit 33 detects the detected potential signal Vout[m] based on the vibration generated in the ejecting portion D[m] in the control period TQ1. Moreover, in this case, the ejecting portion D[m] is driven by the supplied driving signal Vin[m] having the waveform PK in the control period TQ2. As a consequence, the ejecting portion D[m] does not eject the ink.

A description will be given of selection of the inspection target ejecting portion DK in the modified example 7.

In the following description, of the K pieces of the unit periods TP in which the printing task is executed, the k-th unit period TP will be referred to as the unit period TP(k) while a k+1-th unit period TP will be referred to as a unit period TP(k+1).

In the modified example 7, regarding the unit period TP(k) in which the supplied driving signal Vin is supplied to the ejecting portion D[m] while selecting the waveform from the driving signal Com-A or the driving signal Com-B in the control period TQ2, it is not possible to detect the detected potential signal Vout[m] in the unit period TP(k). Accordingly, the detection of the detected potential signal Vout[m] after the supplied driving signal Vin is supplied to the ejecting portion D[m] while selecting the waveform from the driving signal Com-A or the driving signal Com-B in the control period TQ2 in the unit period TP(k) is possible only when the detected potential signal Vout[m] is detectable in the control period TQ1 in the subsequent unit period TP(k+1) without having to supply the supplied driving signal Vin to the ejecting portion D[m].

As a consequence, in the modified example 7, a non-inspectable ejecting portion DN that cannot be selected as the inspection target ejecting portion DK is specified before selecting the inspection target ejecting portion DK at random in step S102 in the first embodiment or before selecting the inspection target ejecting portion or portions DK out of the mode-compatible ejecting portions DM in step S203 in the second embodiment or in step S300 in the third embodiment.

Specifically, when the individual designation signal SD[m][TP(k)] out of the individual designation signals SD[m][TP(1)] to SD[m][TP(K)] generated in the same way as in step S101 in the first embodiment indicates the value to instruct the drive as the large dot forming ejecting portion DP1*a* and when the individual designation signal SD[m][TP(k+1)] is neither the value that indicates the drive as the small dot forming ejecting portion DP3*a* nor the value that indicates the drive as the non-dot forming ejecting portion DP5*a*, the individual designation signal SD[m][TP(k)] is specified as the non-inspectable ejecting portion DN. Moreover, when the individual designation signal SD[m][TP(k)] out of the individual designation signals SD[m][TP(1)] to SD[m][TP(K)] generated in step S101 indicates the value to instruct the drive as the small dot forming ejecting portion DP3*a* and when the individual designation signal SD[m][TP(k+1)] is neither the value that indicates the drive as the small dot forming ejecting portion DP3*a* nor the value that indicates the drive as the non-dot forming ejecting portion DP5*a*, the individual designation signal SD[m][TP(k)] is specified as the non-inspectable ejecting portion DN. Furthermore, when the individual designation signal SD[m][TP(k)] out of the individual designation signals SD[m][TP(1)] to SD[m][TP(K)] generated in step S101 indicates the value to instruct the drive as the non-dot forming ejecting portion DP5*a* and when the individual designation signal SD[m][TP(k+1)] is neither the value that indicates the drive as the small dot forming ejecting portion DP3*a* nor the value that indicates the drive as the non-dot forming ejecting portion DP5*a*, the individual designation signal SD[m][TP(k)] is specified as the non-inspectable ejecting portion DN.

Thereafter, the inspection target selection unit 24 can select the inspection target ejecting portion DK at random out of the individual designation signals SD[m][TP(1)] to SD[m][TP(K)] not specified as the non-inspectable ejecting portion DN as with step S102 in the first embodiment. Alternatively, the inspection target selection unit 24 can select the mode-compatible ejecting portions DM based on the inspection mode information Md, and further select the inspection target ejecting portion or portions DK out of the mode-compatible ejecting portions DM as with step S203 in the second embodiment or step S300 in the third embodiment.

Then, the print control unit 21 updates the individual designation signals SD[1][TP(k)] to SD[M][TP(k)] generated in step S101 so as to reflect the result of selection of the inspection target ejecting portion or portions DK.

Specifically, when the individual designation signal SD[m][TP(k)] generated in step S101 indicates the value to instruct the drive as the large dot forming ejecting portion DP1*a* and when the ejecting portion D[m][TP(k)] is selected as the inspection target ejecting portion DK, the print control unit 21 changes the individual designation signal SD[m][TP(k+1)] into the value to instruct the drive as the post-detection small dot forming ejecting portion DK6*a* on the condition that the individual designation signal SD[m][TP(k+1)] refers to the small dot forming ejecting portion DP3*a*. Meanwhile, when the individual designation signal SD[m][TP(k)] generated in step S101 indicates the value to instruct the drive as the large dot forming ejecting portion DP1*a* and when the ejecting portion D[m][TP(k)] is selected as the inspection target ejecting portion DK, the print control unit 21 changes the individual designation signal SD[m][TP(k+1)] into the value to instruct the drive as the post-inspection non-dot forming ejecting portion DK7*a* on the condition that the individual designation signal SD[m][TP(k+1)] refers to the non-dot forming ejecting portion DP5*a*.

In the meantime, when the individual designation signal SD[m][TP(k)] generated in step S101 indicates the value to instruct the drive as the medium dot forming ejecting portion DP2*a* and when the ejecting portion D[m][TP(k)] is selected as the inspection target ejecting portion DK, the print control unit 21 changes the individual designation signal SD[m][TP(k)] into the value to instruct the drive as the medium dot forming inspection target ejecting portion DK2*a*.

On the other hand, when the individual designation signal SD[m][TP(k)] generated in step S101 indicates the value to instruct the drive as the small dot forming ejecting portion DP3*a* and when the ejecting portion D[m][TP(k)] is selected as the inspection target ejecting portion DK, the print control unit 21 changes the individual designation signal SD[m][TP(k+1)] into the value to instruct the drive as the post-detection small dot forming ejecting portion DK6*a* on the condition that the individual designation signal SD[m][TP(k+1)] refers to the small dot forming ejecting portion DP3*a*. Meanwhile, when the individual designation signal SD[m][TP(k)] generated in step S101 indicates the value to instruct the drive as the small dot forming ejecting portion DP3*a* and when the ejecting portion D[m][TP(k)] is selected as the inspection target ejecting portion DK, the print control unit 21 changes the individual designation signal SD[m][TP(k+1)] into the value to instruct the drive as the post-inspection non-dot forming ejecting portion DK7*a* on the condition that the individual designation signal SD[m][TP(k+1)] refers to the non-dot forming ejecting portion DP5*a*.

In the meantime, when the individual designation signal SD[m][TP(k)] generated in step S101 indicates the value to instruct the drive as the fine dot forming ejecting portion DP4*a* and when the ejecting portion D[m][TP(k)] is selected as the inspection target ejecting portion DK, the print control unit 21 changes the individual designation signal SD[m][TP(k)] into the value to instruct the drive as the fine dot forming inspection target ejecting portion DK4*a*. On the other hand, when the individual designation signal SD[m][TP(k)] generated in step S101 indicates the value to instruct the drive as the non-dot forming ejecting portion DP5*a* and when the ejecting portion D[m][TP(k)] is selected as the inspection target ejecting portion DK, the print control unit 21 changes the individual designation signal SD[m][TP(k+1)] into the value to instruct the drive as the post-detection small dot forming ejecting portion DK6*a* on the condition that the individual designation signal SD[m][TP(k+1)] refers to the small dot forming ejecting portion DP3*a*. Meanwhile, when the individual designation signal SD[m][TP(k)] generated in step S101 indicates the value to instruct the drive as the non-dot forming ejecting portion DP5*a* and when the ejecting portion D[m][TP(k)] is selected as the inspection target ejecting portion DK, the print control unit 21 changes the individual designation signal SD[m][TP(k+1)] into the value to instruct the drive as the post-inspection non-dot forming ejecting portion DK7*a* on the condition that the individual designation signal SD[m][TP(k+1)] refers to the non-dot forming ejecting portion DP5*a*.

In the modified example 7, in terms of the unit periods TPt(1) to TPt(K) in which the test printing task for forming the image GZt is executed, when the detected potential signal Vout based on the vibration generated in the ejecting portion D[m] due to the supplied driving signal Vin supplied to the ejecting portion D[m] in the unit period TPt(k) is detected in the unit period TPt(k+1), the control period TQ1 in the unit period TPt(k+1) in which the detected potential signal Vout[m] is detected from the ejecting portion Dt[m][TP(k+1)] represents an example of the "first detection period". Meanwhile, in terms of the unit periods TPt(1) to TPt(K) in which the test printing task for forming the image GZt is executed, when the detected potential signal Vout based on the vibration generated in the ejecting portion D[m] due to the supplied driving signal Vin supplied to the ejecting portion D[m] in the control period TQ1 in the unit period TPt(k) is detected in the control period TQ2 in the unit period TPt(k), the control period TQ2 in the unit period TPt(k) in which the detected potential signal Vout[m] is detected from the ejecting portion Dt[m][TP(k)] represents an example of the "first detection period".

In the meantime, in terms of the unit periods TPh(1) to TPh(K) in which the real printing task for forming the image GZh is executed, when the detected potential signal Vout based on the vibration generated in the ejecting portion D[m] due to the supplied driving signal Vin supplied to the ejecting portion D[m] in the unit period TPh(k) is detected in the unit period TPh(k+1), the control period TQ1 in the unit period TPh(k+1) in which the detected potential signal Vout[m] is detected from the ejecting portion Dh[m][TP(k+1)] represents an example of the "second detection period". Meanwhile, in terms of the unit periods TPh(1) to TPh(K) in which the real printing task for forming the image GZh is executed, when the detected potential signal Vout based on the vibration generated in the ejecting portion D[m] due to the supplied driving signal Vin supplied to the ejecting portion D[m] in the control period TQ1 in the unit period TPh(k) is detected in the control period TQ2 in the unit period TPh(k), the control period TQ2 in the unit period TPh(k) in which the detected potential signal Vout[m] is detected from the ejecting portion Dh[m][TP(k)] represents an example of the "second detection period".

In the meantime, in terms of the unit periods TPt(1) to TPt(K) in which the test printing task for forming the image GZt is executed, when the detected potential signal Vout based on the vibration generated in the ejecting portion D[m] due to the supplied driving signal Vin supplied to the ejecting portion D[m] in the unit period TPt(k) is detected in the unit period TPt(k+1), the vibration information SJt[m][TP(k+1)] based on the residual vibration signal VDt[m][TP(k+1)] detected from the ejecting portion Dt[m][TP(k+1)] represents an example of the "first vibration information". Meanwhile, in terms of the unit periods TPt(1) to TPt(K) in which the test printing task for forming the image GZt is executed, when the detected potential signal Vout based on the vibration generated in the ejecting portion D[m] due to the supplied driving signal Vin supplied to the ejecting portion D[m] in the control period TQ1 in the unit period TPt(k) is detected in the control period TQ2 in the unit period TPt(k), the vibration information SJt[m][TP(k)] based on the residual vibration signal VDt[m][TP(k)] detected from the ejecting portion Dt[m][TP(k)] represents an example of the "first vibration information".

In the meantime, in terms of the unit periods TPh(1) to TPh(K) in which the real printing task for forming the image GZh is executed, the detected potential signal Vout based on the vibration generated in the ejecting portion D[m] due to the supplied driving signal Vin supplied to the ejecting portion D[m] in the unit period TPh(k) is detected in the unit period TPh(k+1), the vibration information SJh[m][TP(k+1)] based on the residual vibration signal VDh[m][TP(k+1)] detected from the ejecting portion Dh[m][TP(k+1)] represents an example of the "second vibration information". Meanwhile, in terms of the unit periods TPh(1) to TPh(K) in which the real printing task for forming the image GZh is executed, when the detected potential signal Vout based on the vibration generated in the ejecting portion D[m] due to the supplied driving signal Vin supplied to the ejecting portion D[m] in the control period TQ1 in the unit period TPh(k) is detected in the control period TQ2 in the unit period TPh(k), the vibration information SJh[m][TP(k)] based on the residual vibration signal VDh[m][TP(k)] detected from the ejecting portion Dh[m][TP(k)] represents an example of the "second vibration information".

In the meantime, in terms of the unit periods TPt(1) to TPt(K) in which the test printing task for forming the image GZt is executed, when the detected potential signal Vout based on the vibration generated in the ejecting portion D[m] due to the supplied driving signal Vin supplied to the ejecting portion D[m] in the unit period TPt(k) is detected in the unit period TPt(k+1), the unit period TPt(k) represents an example of the "first driving period". Meanwhile, in terms of the unit periods TPt(1) to TPt(K) in which the test printing task for forming the image GZt is executed, when the detected potential signal Vout based on the vibration generated in the ejecting portion D[m] due to the supplied driving signal Vin supplied to the ejecting portion D[m] in the control period TQ1 in the unit period TPt(k) is detected in the control period TQ2 in the unit period TPt(k), the control period TQ1 that precedes the control period TQ2 in the unit period TPt(k) represents an example of the "first driving period".

In the meantime, in terms of the unit periods TPh(1) to TPh(K) in which the real printing task for forming the image GZh is executed, when the detected potential signal Vout based on the vibration generated in the ejecting portion D[m] due to the supplied driving signal Vin supplied to the ejecting portion D[m] in the unit period TPh(k) is detected in the unit period TPh(k+1), the unit period TPh(k) represents an example of the "second driving period". Meanwhile, in terms of the unit periods TPh(1) to TPh(K) in which the real printing task for forming the image GZh is executed, when the detected potential signal Vout based on the vibration generated in the ejecting portion D[m] due to the supplied driving signal Vin supplied to the ejecting portion D[m] in the control period TQ1 in the unit period TPh(k) is detected in the control period TQ2 in the unit period TPh(k), the control period TQ1 that precedes the control period TQ2 in the unit period TPh(k) represents an example of the "second driving period".

Modified Example 8

The above-described first and second embodiments and the modified examples 1 to 7 exemplify the case where the single detection circuit 33 is provided to the multiple ejecting portions D, and the detected potential signal Vout is detected in the unit period TP(k) while coupling the single ejecting portion D to the detection circuit 33. However, the present disclosure is not limited only to this aspect. For example, the detected potential signals Vout of the multiple ejecting portions D may be detected in the unit period TP(k) by providing the multiple ejecting portions D with the multiple detection circuits 33 and setting multiple combinations of the ejecting portions D and the detection circuits 33.

Modified Example 9

The above-described first to third embodiments and the modified examples 1 to 8 exemplify the case where the ink jet printer 1 is the line printer. However, the present disclosure is not limited only to this aspect. The ink jet printer 1 may be a so-called serial printer, which executes a printing task while reciprocating the head unit 3 in the Y-axis direction.

What is claimed is:

1. A liquid ejecting apparatus comprising:

a plurality of ejecting portions driven by a driving signal and configured to eject a liquid to form an image on a medium by using the liquid;

an acquisition unit configured to acquire a first vibration information and a second vibration information, the first vibration information being an information on a vibration generated in an inspection target ejecting portion out of the plurality of ejecting portions in a first detection period included in a first period in which the liquid ejecting apparatus forms a first printed image on the medium, and the second vibration information being an information on a vibration in generated in the inspection target ejecting portion in a second detection period corresponding to the first detection period, the second detection period being included in a second period that starts after completion of printing of the first printed image on the medium in the first period, in which the liquid ejecting apparatus forms a second printed image related to the first printed image on the medium; and an inspection unit configured to inspect a state of ejection of the liquid from the inspection target ejecting portion based on the first vibration information and the second vibration information.

2. The liquid ejecting apparatus according to claim 1, further comprising:

a notification unit configured to notify of a result of inspection by the inspection unit when the result of inspection indicates that the state of ejection of the liquid from the inspection target ejecting portion is abnormal.

3. The liquid ejecting apparatus according to claim 1, wherein the inspection target ejecting portion is driven by the driving signal having a first waveform in a first driving period in the first period, the first driving period preceding the first detection period, and the inspection target ejecting portion is driven by the driving signal having the first waveform in a second driving period in the second period, the second driving period corresponding to the first driving period and preceding the second detection period.

4. The liquid ejecting apparatus according to claim 3, wherein the first waveform is a waveform that causes the inspection target ejecting portion to eject the liquid, and the inspection target ejecting portion is driven by the driving signal having an ejection waveform to cause the inspection target ejecting portion to eject the liquid in a first preceding unit period preceding a first unit period in the first period, the first unit period including the first driving period and the first detection period, and the inspection target ejecting portion is driven by the driving signal having the ejection waveform in a second preceding unit period preceding a second unit period in the second period, the second unit period including the second driving period and the second detection period.

5. The liquid ejecting apparatus according to claim 3, wherein the first waveform is a waveform that does not cause the inspection target ejecting portion to eject the liquid, and the inspection target ejecting portion does not eject the liquid in a first preceding unit period preceding a first unit period in the first period, the first unit period including the first driving period and the first detection period, and the inspection target ejecting portion does not eject the liquid in a second preceding unit period preceding a second unit period in the second period, the second unit period including the second driving period and the second detection period.

6. The liquid ejecting apparatus according to claim 3, wherein the plurality of ejecting portion includes an adjacent ejecting portion located adjacent to the inspection target ejecting portion, and the adjacent ejecting portion is configured to eject the liquid by being driven by the driving signal, wherein the adjacent ejecting portion is driven by the driving signal having an ejection waveform to cause the adjacent ejecting portion to eject the liquid in a first unit period in the first period, the first unit period including the first driving period and the first detection period, and the adjacent ejecting portion is driven by the driving signal having the ejection waveform in a second unit period in the second period, the second unit period including the second driving period and the second detection period.

7. The liquid ejecting apparatus according to claim 3, wherein the plurality of ejecting portion includes an adjacent ejecting portion located adjacent to the inspection target ejecting portion, and the adjacent ejecting portion is configured to eject the liquid by being driven by the driving signal, wherein the adjacent ejecting portion does not eject the liquid in a first unit period in the first period, the first unit period including the first driving period and the first detection period, and the adjacent ejecting portion does not eject the liquid in a second unit period in the second period, the second unit period including the second driving period and the second detection period.

8. The liquid ejecting apparatus according to claim 1, further comprising:

an acceptance unit configured to accept an operation by a user of the liquid ejecting apparatus; and a selection unit configured to select the inspection target ejecting portion out of the plurality of ejecting portions based on the operation of the user accepted by the acceptance unit.

9. The liquid ejecting apparatus according to claim 1, further comprising:

a selection unit configured to select the inspection target ejecting portion at random out of the plurality of ejecting portions.

10. A liquid ejecting apparatus comprising:

a plurality of ejecting portions driven by a driving signal and configured to eject a liquid to form an image on a medium by using the liquid;

an acquisition unit configured to acquire a first vibration information and a second vibration information, the first vibration information being an information on a composite vibration obtained by combining vibrations generated in a plurality of inspection target ejecting portions out of the plurality of ejecting portions in a first detection period included in a first period in which the liquid ejecting apparatus forms a first printed image on the medium, and the second vibration information being an information on a composite vibration obtained by combining vibrations generated in the plurality of inspection target ejecting portions in a second detection period corresponding to the first detection period, the second detection period being included in a second period that starts after completion of printing of the first printed image on the medium in the first period, in which the liquid ejecting apparatus forms a second printed image related to the first printed image on the medium; and an inspection unit configured to inspect states of ejection of the liquid from the plurality of inspection target ejecting portions based on the first vibration information and the second vibration information.

11. The liquid ejecting apparatus according to claim 10, further comprising:

a selection unit configured to select the ejecting portions equal to or below a predetermined number out of the plurality of ejecting portions as the inspection target ejecting portions.

12. The liquid ejecting apparatus according to claim 10, further comprising:

an acceptance unit configured to accept an operation by a user of the liquid ejecting apparatus; and a selection unit configured to select the inspection target ejecting portions out of the plurality of ejecting portions based on the operation of the user accepted by the acceptance unit.

13. The liquid ejecting apparatus according to claim 10, further comprising:

a selection unit configured to select the inspection target ejecting portions at random out of the plurality of ejecting portions.

14. A method of controlling a liquid ejecting apparatus provided with a plurality of ejecting portions driven by a driving signal and configured to eject a liquid, the liquid ejecting apparatus being configured to form an image on a medium by using the liquid ejected from the plurality of ejecting portions, the method comprising:

acquiring a first vibration information on an inspection target ejecting portion out of the plurality of ejecting portions concerning a vibration generated in a first detection period included in a first period in which the liquid ejecting apparatus forms a first printed image on the medium, and acquiring a second vibration information on the inspection target ejecting portion concerning a vibration generated in a second detection period corresponding to the first detection period, the second detection period being included in a second period that starts after completion of printing of the first printed image on the medium in the first period, in which the liquid ejecting apparatus forms a second printed image related to the first printed image on the medium; and inspecting a state of ejection of the liquid from the inspection target ejecting portion based on the first vibration information and the second vibration information.

* * * * *